US011561040B2

(12) United States Patent
Choi

(10) Patent No.: US 11,561,040 B2
(45) Date of Patent: Jan. 24, 2023

(54) REFRIGERATOR

(71) Applicant: LG Electronics Inc., Seoul (KR)

(72) Inventor: Kwanghyun Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/584,057

(22) Filed: Jan. 25, 2022

(65) Prior Publication Data

US 2022/0146188 A1 May 12, 2022

Related U.S. Application Data

(63) Continuation of application No. 16/557,338, filed on Aug. 30, 2019, now Pat. No. 11,248,837.

(30) Foreign Application Priority Data

Aug. 30, 2018 (KR) ..... 10-2018-0102967

(51) Int. Cl.
*F25D 29/00* (2006.01)
*F25D 11/02* (2006.01)
(Continued)

(52) U.S. Cl.
CPC ..... *F25D 25/025* (2013.01); *F25D 11/02* (2013.01); *F25D 23/021* (2013.01);
(Continued)

(58) Field of Classification Search
CPC ..... F25D 11/02; F25D 23/021; F25D 25/025; F25D 25/021; F25D 2700/00;
(Continued)

(56) References Cited

U.S. PATENT DOCUMENTS 7,396,093 B2 7/2008 Jeong et al.
7,581,796 B2 9/2009 Jeong et al.
(Continued)

FOREIGN PATENT DOCUMENTS

CN 1727829 2/2006
CN 1740712 3/2006
(Continued)

OTHER PUBLICATIONS

Office Action in Korean Application No. 10-2018-0102967, dated Aug. 17, 2022, 8 pages (with English translation).
(Continued)

*Primary Examiner* — Lionel Nouketcha
(74) *Attorney, Agent, or Firm* — Fish & Richardson P.C.

(57) ABSTRACT

A refrigerator includes a cabinet defining a storage chamber, a drawer door configured to be inserted into and withdrawn out of the storage chamber, a driving device provided at the door part, an elevation device provided at the drawer part and having a scissors lift assembly, and a connecting assembly that couples the driving device to the scissors lift assembly to transfer driving force from the driving device to the scissors lift assembly. The elevation device is configured, based on being uncoupled from the connecting assembly, to be separable from the drawer part, and the elevation device includes a restricting unit configured to restrict the scissors lift assembly from unfolding when the elevation device is separated from the drawer part. The drawer door includes a drawer part and a door part that is configured to, based on the drawer door being inserted into the storage chamber, close the storage chamber.

20 Claims, 36 Drawing Sheets

(51) Int. Cl.

| | |
|---|---|
| ***F25D 23/02*** | (2006.01) |
| ***F25D 25/02*** | (2006.01) |
| ***F25D 25/00*** | (2006.01) |
| ***F25D 25/04*** | (2006.01) |

(52) U.S. Cl.
CPC ..... *F25D 25/005* (2013.01); *F25D 25/021* (2013.01); *F25D 25/04* (2013.01); *F25D 29/003* (2013.01); *F25D 2325/021* (2013.01); *F25D 2500/06* (2013.01)

(58) Field of Classification Search
CPC ..... F25D 2325/021; F25D 29/005; A47B 88/457; A47B 88/90; A47B 2088/901; A47B 2210/175; A47B 2210/0056
See application file for complete search history.

(56) References Cited

U.S. PATENT DOCUMENTS

| | | | |
|---|---|---|---|
| 7,628,461 | B2 | 12/2009 | Carden et al. |
| 9,377,238 | B2 | 6/2016 | Hall et al. |
| 10,337,785 | B2 | 7/2019 | Yoon et al. |
| 10,598,426 | B2 | 3/2020 | Kang |
| 10,690,394 | B2 | 6/2020 | Yoon et al. |
| 10,900,709 | B2 | 1/2021 | Kang |
| 2006/0043848 | A1 | 3/2006 | Jeong et al. |
| 2006/0043849 | A1 | 3/2006 | Oh et al. |
| 2008/0018215 | A1 | 1/2008 | Carden et al. |
| 2008/0238278 | A1 | 10/2008 | Jeong et al. |
| 2014/0265806 | A1 | 9/2014 | Hall et al. |

FOREIGN PATENT DOCUMENTS

| | | |
|---|---|---|
| CN | 106068432 | 11/2016 |
| CN | 110274431 | 9/2019 |
| EP | 1621838 | 2/2006 |
| EP | 1881282 | 1/2008 |
| EP | 3540345 | 9/2019 |
| JP | 2013036675 | 2/2013 |
| KR | 20060011222 | 2/2006 |
| KR | 20170140010 | 12/2017 |

OTHER PUBLICATIONS

Chinese Office Action in CN Appln. No. 201910783519.4, dated Jan. 13, 2021, 13 pages (with English translation).
EP Search Report in European Application No. EP 19194356, dated Jan. 16, 2020, 6 pages.

REFRIGERATOR

CROSS-REFERENCE TO RELATED APPLICATIONS

The present application is a continuation of U.S. application Ser. No. 16/557,338, filed on Aug. 30, 2019, which claims priority under 35 U.S.C. 119 and 35 U.S.C. 365 to Korean Patent Application No. 10-2018-0102967, filed on Aug. 30, 2018, which are hereby incorporated by reference in their entirety.

TECHNICAL FIELD

The present disclosure relates to a refrigerator.

BACKGROUND

In general, refrigerators are home appliances for storing foods at a low temperature in a storage chamber that is covered by a door. Generally, refrigerators cool the inside of the storage chamber by using cool air generated by being heat-exchanged with a refrigerant circulated through a refrigeration cycle to store foods in an optimum state.

Recently, refrigerator are becoming larger and more multifunctional as dietary changes and user's preferences become more diverse, and thus, a refrigerator having various structures and convenience devices for user's convenience and freshness of stored foods have been introduced.

The storage chamber of the refrigerator may be opened/closed by the door. Also, refrigerators may be classified into various types according to an arranged configuration of the storage chamber and a structure of the door for opening and closing the storage chamber.

The refrigerator door may be classified into a rotation-type door that opens and closes a storage chamber through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to bend his/her back to take out a basket or foods in the drawer-type door. If the basket or the foods are heavy, the user may find it inconvenient to use the basket and/or may be injured.

SUMMARY

According to one aspect of the subject matter described in this application, a refrigerator includes a cabinet that defines a storage chamber, a drawer door configured to be inserted into and withdrawn out of the storage chamber, a driving device provided at the door part and configured to provide a driving force, an elevation device provided at the drawer part and having a scissors lift assembly, the scissors lift assembly being configured to be driven by the driving device to thereby unfold and raise the food object stored in the storage space, and a connecting assembly that couples the driving device to the scissors lift assembly to transfer the driving force from the driving device to the scissors lift assembly. The drawer door includes a drawer part that defines a storage space for storing a food object, and a door part that is configured to, based on the drawer door being inserted into the storage chamber, close the storage chamber. The elevation device is configured, based on being uncoupled from the connecting assembly, to be separable from the drawer part, and the elevation device includes a restricting unit that is configured, based on the elevation device being separated from the drawer part, to restrict the scissors lift assembly from unfolding.

Implementations according to this aspect may include one or more of the following features. For example, the drawer part may include a protrusion that protrudes upward from a bottom surface of the drawer part at a position that corresponds to the restricting unit. The restricting unit may be configured, based on the elevation device being separated from the drawer part and the restricting unit being separated from the protrusion, to be in a restriction state in which the restriction of the scissors lift assembly is enabled. The restricting unit may be configured, based on the elevation device being mounted on the drawer part and the restricting unit coming in contact with the protrusion, to be in a release state in which the restriction of the scissors lift assembly is released. In some cases, the restricting unit may be disposed at a center of the elevation device, and the protrusion may be disposed on the bottom surface of the drawer part at a position that corresponds to the restricting unit.

In some implementations, the restricting unit may include a plurality of restricting units, and the protrusion may include a corresponding number of protrusions at corresponding positions that face the restricting unit. In some cases, the restricting unit may include an upper locker that is attached to a portion of the elevation device that is elevated during operation of the elevation device, a lower locker that is configured to selectively contact the protrusion to thereby either move in a first direction that restricts the lower locker with the upper locker or in a second direction that releases the restriction between the lower locker and the upper locker, and an elastic member configured to provide an elastic force that moves the lower locker toward the upper locker.

In some implementations, the drawer part may be partitioned into a front space that is withdrawn out of the lower storage chamber based on the drawer part being withdrawn and a rear space that remains in the lower storage chamber, and the elevation device may be provided in the front space. In some cases, a drawer cover that covers the rear space may be provided in the drawer part. Here, the drawer cover may include a cover front surface part that partitions an inside of the drawer part into the front space and the rear space, and a cover top surface part that connects the cover front surface part to a rear end of the drawer part. A drawer opening through which a front end of the elevation device is exposed may be defined at a front surface of the drawer part. The elevation device may be connected to a connecting assembly of a rear surface of the door through the drawer opening.

In some implementation, corresponding surfaces of the connecting assembly and the elevation device that face each other respectively may include a projection part and a connection part, or vice versa, that have corresponding shapes that allow them to become coupled to each other. The connecting assembly may be disposed on each of both left and right sides of the door. The elevation device may further include a pair of scissors lift assemblies including a plurality of rods that are rotationally coupled to each other to cross each other, the pair of scissors lift assemblies being respectively coupled to the connecting assemblies disposed on both sides thereof, and a support plate supported by the scissors lift assemblies and configured to be elevated by the scissors lift assemblies, the support plate being configured to support foods or a container. The pair of scissors lift assemblies may be configured to operate at the same time by rotation of the connecting assemblies.

According to another aspect, a refrigerator includes a cabinet that defines a storage chamber, a drawer door configured to be inserted into and withdrawn out of the storage chamber, the drawer door including a door part configured to open and close the storage chamber and a drawer part that defines a storage space in a rear surface of the door part, a driving device provided at the door part and configured to provide a driving force, and an elevation device detachably disposed inside the drawer part, the elevation device being connected to a driving device within the drawer part so as to be elevated by the driving force from the driving device. The elevation device includes a lower frame configured to be seated on a bottom surface of the drawer part, an upper frame configured to be elevated to an upper side of the lower frame, a scissors lift assembly coupled to the lower frame and the upper frame in a scissors structure, the scissors lift assembly being configured to be unfolded and folded by the driving device, respectively, to elevate and lower the upper frame, and a restricting unit provided at each of the upper frame and the lower frame, the restricting unit being configured to restrict the upper frame and the lower frame from moving relative to each other.

Implementations according to this aspect may include one or more of the following features. For example, a bottom surface of the drawer part may include a protrusion that protrudes upward from the bottom surface, and the protrusion may be configured to contact the restricting unit based on the elevation device being mounted on the drawer part to thereby release the restriction of the restricting unit. In some cases, the restricting unit may include an upper locker fixed to the upper frame so as to be elevated together with the upper frame, a locker case fixed and mounted on the lower frame, a lower locker mounted on the locker case to move along the locker case, the lower locker being configured to be selectively restricted with the upper locker according to a movement of the lower locker, and an elastic member that connects the locker case to the lower locker, the elastic member being configured to provide an elastic force that moves the lower locker toward the upper locker.

In some implementations, a protrusion protruding upward and having an inclined or a rounded upper surface may be disposed on the drawer part, and the protrusion may be configured to contact the lower locker based on the elevation device being elevated to thereby allow the lower locker to move away from the upper locker and release the restriction of the restricting unit. In some cases, a bottom surface of the lower frame and a bottom surface of the locker case that correspond to the protrusion may include an opened surface, and the protrusion may protrude upward toward an inside of the locker case. In some cases, the upper locker may be disposed on an upper partition part disposed at a center of the upper frame to partition the upper frame into left and right frames, and the lower case and the lower locker may be disposed on a lower partition part disposed at a center of the lower frame to partition the lower frame into left and right frames. The upper partition part and the lower partition part may be disposed along a common extension line, and the scissors lift assembly may be provided as a pair of scissors lift assemblies that is disposed on both left and right sides of the upper partition part and the lower partition part, respectively.

In some implementations, the upper locker may include an upper restricting part protruding toward the lower locker and an upper accommodation part recessed from an upper portion of a lower restricting part. The lower locker may protrude toward the upper locker, the lower locker including a lower restricting part that is configured to be hooked to be restricted with the lower restricting part inside the upper accommodation part. In some cases, a first inclined surface may be disposed on a top surface of the upper restricting part, wherein a fourth inclined surface corresponding to the first inclined surface may be disposed on a bottom surface of the lower restricting part. Based on the lower locker being restricted to the upper locker, the first inclined surface and the fourth inclined surface may contact each other to allow the lower restricting part to move into the upper accommodation part. Also, a second inclined surface may be disposed on a bottom surface of the upper restricting par, and a third inclined surface may be disposed a top surface of the lower restricting part. Based on the upper locker moving downward, the second inclined surface and the third inclined surface may contact each other to allow the lower locker to move in a direction that is away from the upper locker.

The details of one or more implementations are set forth in the accompanying drawings and the description below. Other features will be apparent from the description and drawings, and from the claims.

DETAILED DESCRIPTION

Hereinafter, implementations of the present disclosure will be described in detail with reference to the accompanying drawings.

Figure 1:
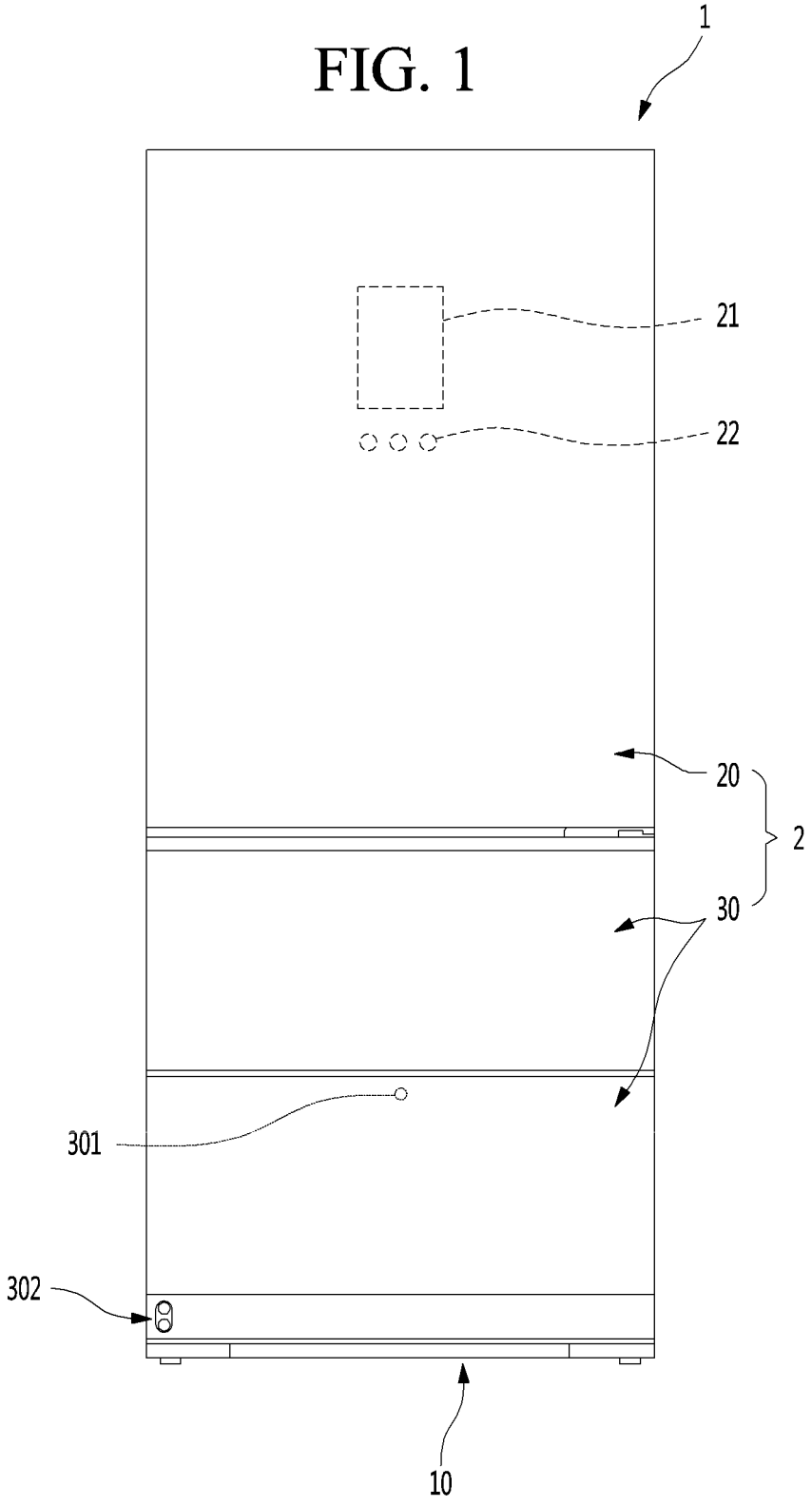
FIG. 1 is a front view of a refrigerator according to an implementation.
Figure 2:
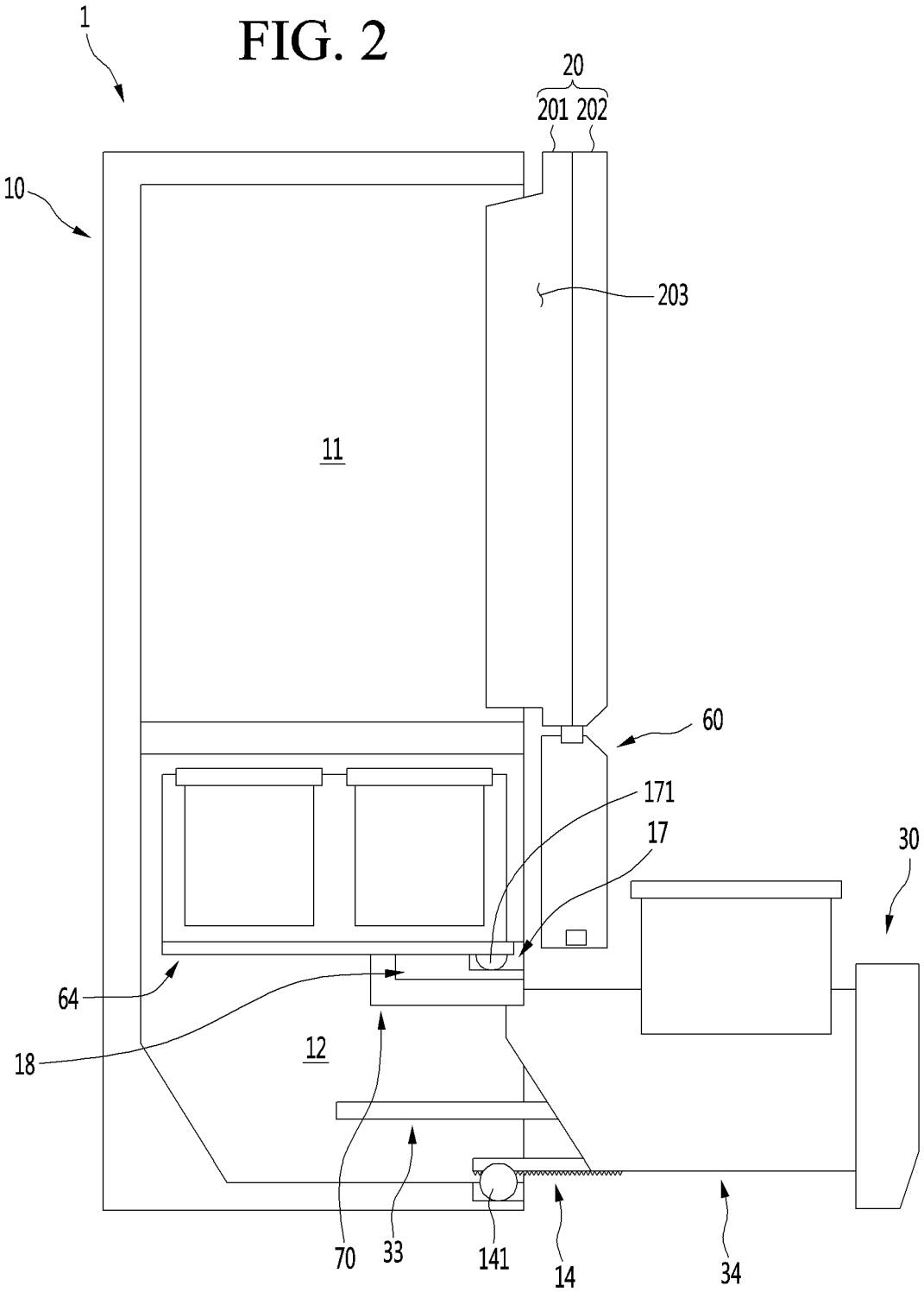
FIG. 2 is a schematic view illustrating a state in which a drawer door of the refrigerator is elevated.

FIG. 1 is a front view of a refrigerator according to an implementation. Also, FIG. 2 is a schematic view illustrating a state in which a drawer door of the refrigerator is elevated.

As illustrated in the drawing, the refrigerator 1 may have an outer appearance that is defined by a cabinet 10 defining a storage chamber and a door 2 covering an opened front surface of the cabinet 10.

The storage chamber of the cabinet 10 may be divided into a plurality of spaces. For example, an upper storage chamber 11 of the cabinet 10 may be provided as a refrigerating compartment, and a lower storage chamber 12 may be provided as a freezing compartment. Alternatively, the upper storage chamber and the lower storage chamber 12 may be provided as independent spaces that are maintained at temperatures different from each other, but are not the refrigerating compartment or the freezing compartment. Also, the lower storage chamber 12 may be divided into a plurality of spaces. As illustrated in the drawings, one space may be opened and closed by a plurality of doors 20 and 30.

The door 2 may include a rotation door 20 for opening and closing the upper space through rotation thereof and a drawer door 30 for opening and closing the lower space by being inserted or withdrawn in a drawer type configuration. The lower space may further be vertically divided into two separate spaces. The drawer door 30 may include an upper drawer door 30 and a lower drawer door 30. In some cases, an outer appearance of each of the rotation door 20 and the drawer door 30 may be made of a metal material and be exposed to the front side.

Although the refrigerator in which both the rotation door 20 and the drawer door 30 are provided is described, the present disclosure is not limited thereto. For example, the present disclosure may be applied to all refrigerators including a door that is inserted and withdrawn in the drawer type. Also, the rotation door 20 may be provided at an upper portion and thus called an upper door, and the drawer door 30 may be provided at a lower portion and thus called a lower door.

A display 21 may be disposed on one side of a front surface of the rotation door 20. In some cases, when the outer appearance of the door 2 is made of the metal material, a plurality of fine holes may be punched in the display 21 to display information by using light passing therethrough.

In some implementations, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of the user or provided as an input unit that operates by a user's motion or voice.

As illustrated in the drawings, a manipulation device 302 may be disposed on a lower end of the lower drawer door 30 to illuminate an image on a bottom surface and thereby to output a virtual switch and to input an operation when the user approaches a corresponding area.

The lower drawer door 30 may be automatically inserted and withdrawn according to the manipulation of the manipulation part 301. In some cases, a food or container within the lower drawer door 30 may be elevated in a state in which the drawer door 30 is withdrawn by the manipulation of the manipulation part 301.

The lower drawer door 30 may be a storage chamber defined in a lower side of the refrigerator 1 and may withdraw the lower drawer door 30 forward to accommodate a food stored in the lower drawer door 30, and then, the container 36 inside the drawer door 30 may be manipulated to be elevated.

The container 36 may have a predetermined height. Since the container 36 is seated on the elevation device 80, the height of the container 36 may increase by the height of the elevation device 80 when the elevation device 80 is elevated. Thus, when the elevation device 80 ascends, the container 36 may be disposed at a point at which the user is able to more easily access the container 36 and also more easily lift the container 36.

The container 326 may be completely accommodated in the accommodation part 32 when the door 30 is inserted and withdrawn. When the elevation device ascends, the container 36 may be disposed at a higher position than the lower storage chamber 12.

Although the shape of the container 36 is not limited, the container 36 may have a shape corresponding to the size of the front space S1 and may have a predetermined height to prevent the stored food from spilling out when the elevation device 80 ascends.

The food or container 36 inside the lower drawer door 30 disposed at the lowest position may be more easily lifted and used through the above-described manipulation.

The lower drawer door 30 may be automatically inserted and withdrawn forward and backward by the draw-out motor 14, the pinion 141 provided in the cabinet 10, and the draw-out rack 34 provided on the bottom surface of the lower drawer door 30.

Also, the container inside the lower drawer door 30 may be elevated by the driving device 40 and the elevation device 80 provided in the lower drawer door 30.

Hereinafter, the lower drawer door 30 and an operation of the lower drawer door 30 will be described in more detail, and also, the lower drawer door 30 will be referred to as a drawer door or a door unless otherwise specified.

The implementations are not limited to the number and shape of the drawer doors and may be applied to all refrigerators having a door that is inserted and withdrawn in a drawer type into/from the lower storage chamber.

Figure 3:
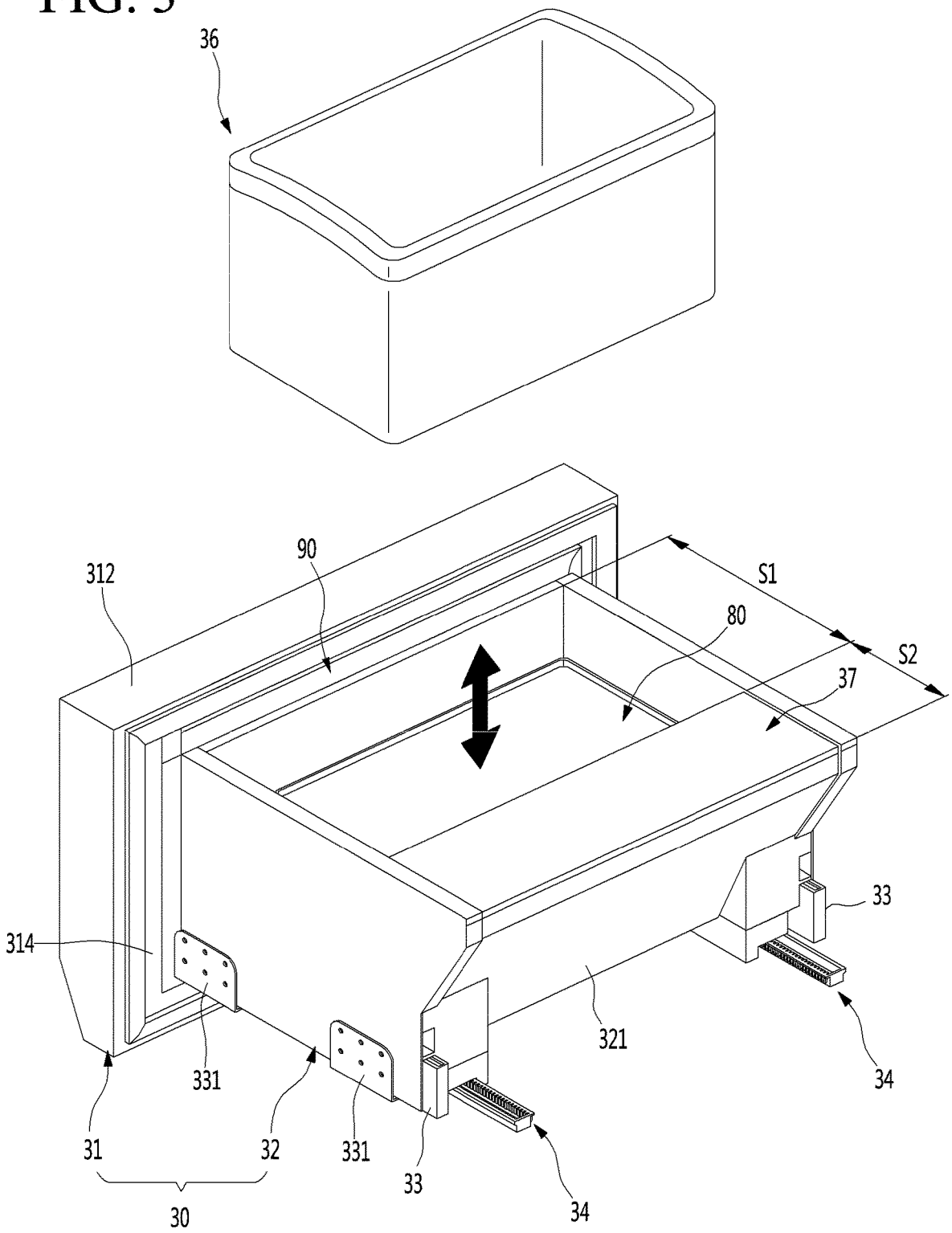
FIG. 3 is a perspective view illustrating a state in which the container of the drawer door is separated.
Figure 4:
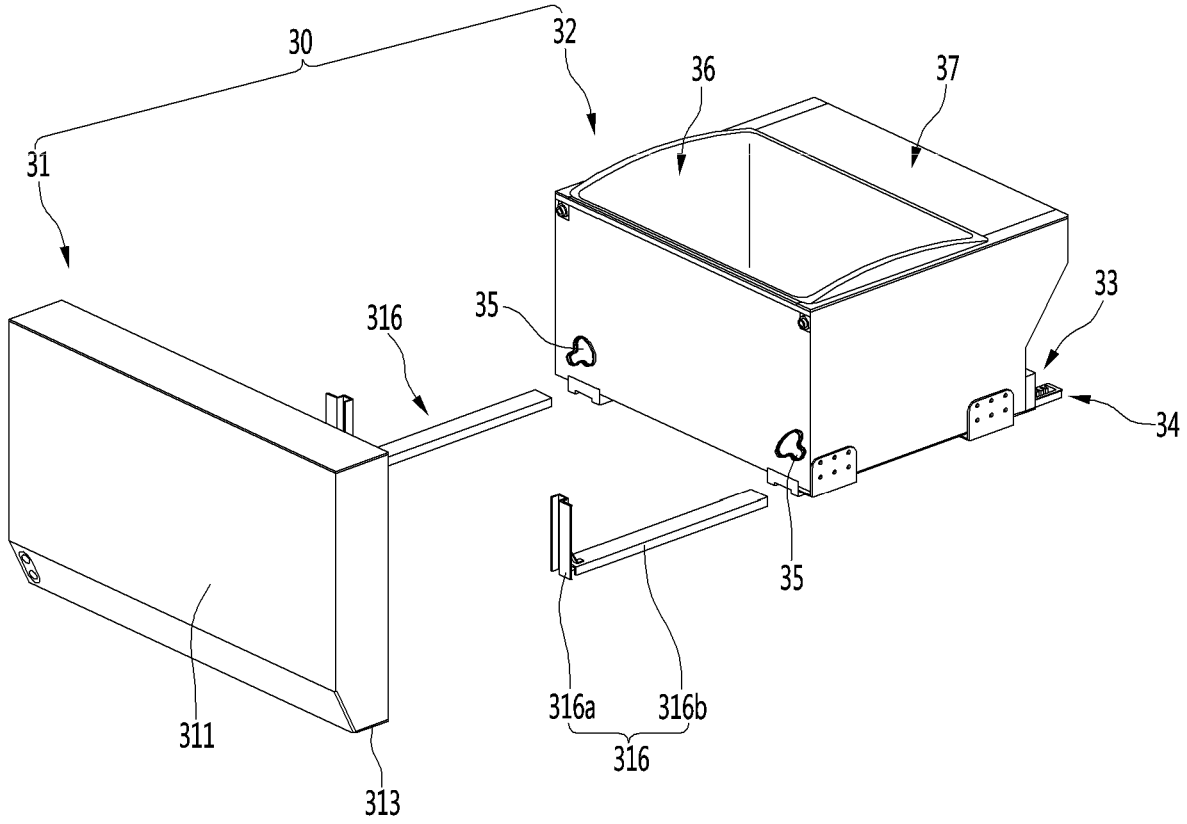
FIG. 4 is an exploded perspective view illustrating a state in which a drawer part of a drawer door and a door part are separated from each other when viewed from a front side.

FIG. 3 is a perspective view illustrating a state in which the container of the drawer door is separated. Also, FIG. 4 is an exploded perspective view illustrating a state in which the drawer part of the drawer door and the door part are separated from each other when viewed from a front side.

As illustrated in the drawings, the door 30 may include a door part 31 for opening and closing the storage chamber. The door 30 may also include a drawer part 32 that is coupled to a rear surface of the door part 31 and that is designed to be inserted and withdrawn together with the door part 31.

The door part 31 may be exposed to the outside of the cabinet 10 to define an outer appearance of the refrigerator 1, and the drawer part 32 may be disposed inside the cabinet 10 to define a storage chamber. Also, the door part 31 and the drawer part 32 may be coupled to each other and inserted and withdrawn in a forward/backward direction together with each other.

The drawer part 32 may be disposed on the rear surface of the door part 31 to define a space in which the food or container to be stored is accommodated. The inside of the drawer part 32 may provide an upwardly opened storage chamber, and an outer appearance of the drawer part 32 may be defined by a plurality of plates (see reference numerals 391, 392, and 395 in FIG. 11). Each of the plurality of plates 391, 392, and 395 may be made of a metal material and provided inside and outside the drawer part 32 such that the entire drawer part 32 is made of stainless steel. In some cases, a material having a texture of stainless steel may be used.

In the state in which the door 30 is inserted, a machine room 3, in which a compressor and a condenser for performing a refrigeration cycle are provided, may be disposed behind the door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the door 30 may be provided on each of both side surfaces of the drawer part 32. The door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multiple stages.

A rail bracket 331 may be provided on the draw-out rail 33, and the rail bracket 331 may extend from one side of the draw-out rail 33 to both sides of the drawer part 32. Also, the rail bracket 331 may be fixedly coupled to a sidewall surface inside the refrigerator. Thus, the drawer part 32, that is, the door 30, may be mounted to the cabinet 10 by the draw-out rails 33.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided at a lower ends of each of both sides of the drawer part 32 and may be called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the door 30. That is, when an operation is inputted into the manipulation parts 22 and 301, the draw-out motor 14 may be driven to insert and withdraw the door 30 according to movement of the draw-out rack 34. Here, the door 30 may be stably inserted and withdrawn by the draw-out rail 33.

The draw-out rack 34 may not be provided on the drawer part 32. Here, the user may hold a side of the door part 31 to push and pull the door part 31 so that the door 30 is directly inserted and withdrawn.

The inside of the drawer part 32 may be divided into a front space S1 and a rear space S2. The elevation device 80 that is vertically elevated and a container seated on the elevation device 80 to be elevated together with the elevation device 80 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the door 30 is withdrawn, the entire drawer part 32 may not be withdrawn to the outside of the storage chamber due to a limitation in draw-out distance of the door 30. That is, at least the front space S1 is withdrawn to the outside of the storage chamber, and the whole or a portion of the rear space S2 is disposed inside the storage chamber within the cabinet 10.

In such a structure, a draw-out distance of the door 30 may be limited by the draw-out rack 34 or the draw-out rail 33. As the draw-out distance becomes longer, the moment applied to the door 30 may become larger in the drawn-out state, and thus it can be difficult to maintain a stable state, thus resulting in possible deformation or damage of the draw-out rail 33 or the draw-out rack 34 may occur.

The elevation device 80 and the container 36 may be accommodated in the front space S1. While the elevation device is elevated, the food or container 36 seated on the elevation device 80 may be elevated together. Also, the elevation device 80 may be provided below the container 36, and the elevation device 80 may be covered by the container 36 when the container 36 is mounted. Thus, elements of the elevation device 80 may not be exposed to the outside.

A separate drawer cover 37 may be provided in the rear space S2. The front space S1 and the rear space S2 may be partitioned by the drawer cover 37. In a state in which the drawer cover 37 is mounted, a space in which front and top surfaces of the rear space S2 are covered and not be used may be not be exposed to the outside.

However, when the drawer cover 37 is separated, the user may access the rear space S2, and thus, food items may be easily accommodated in the rear space S2. To utilize the rear space S2, a separate pocket or a container corresponding to the shape of the rear space may be disposed in the rear space S2.

Also, the elevation device 80 inside the drawer part 32 may be easily separated and mounted to allow the utilization of the entire space inside the drawer part 32, and the elevation device 80 and the drawer cover 37 may be separated from each other to utilize the entire space of the drawer part 32.

The outer appearance of each of the inner and outer surfaces of the drawer part 32 may be defined by the separate plates 391, 392 and 395, which cover the components mounted on the drawer part 32, and thus, the outer and inner appearances may be seen to be neat. The plates 391, 392, and 395 may include a plurality of plates and may be made of stainless steel to provide a more luxurious and clean appearance.

As illustrated in the drawings, the door part 31 and the drawer part 32 of the door 30 may be may be separably coupled to each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the elevation device 80 may be provided. The driving device 40 for elevating the elevation device 80 may be disposed on the door part 31, and the door part 31 and the drawer part 32 may be selectively connected to each other.

In more detail, the driving part 40 provided in the door part 31 may be configured to receive power from the power source and to transmit the power to the elevation part 80. Thus, it is possible to remove the door part 31 when the service of the driving part 40 is necessary and to, if necessary, simply replace just the door part 31.

The door part 31 and the drawer part 32 may be coupled by a pair of door frames 316 provided on both sides. The door frame 316 includes a door coupling part 316*a* extending upward and downward to be coupled to the door part 31 and a drawer coupling part 316*b* extending backward from a lower end of the door coupling portion 316*a*. The door coupling part 316*a* may be coupled to the door part 31 by a separate coupling member and may be coupled to one side of the door part 31 by a simple coupling structure. Also, the drawer coupling part 31*b* may be mounted on each of both sides of the drawer part 32 and be inserted and mounted in a state of being coupled to the draw-out rail 33. The drawer coupling part 316*b* and the draw-out rail 33 may be covered by the plate 391 mounted on the drawer part 32 and thus may not be exposed to the outside.

Also, a connecting assembly 70 may be provided on the rear surface of the door 30 so that the driving part 40 and the elevation are 80 are connected to each other when the door part and the drawer part 32 are coupled. A drawer opening 35 through which a part of the elevation device 80 is exposed may be defined in a position corresponding to the connecting assembly 70 on the front surface of the drawer part 32.

The door part 31 may be configured to substantially open and close the storage chamber of the cabinet 10 and to define the front surface of the refrigerator 1.

The door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material 300 may be filled in the inside of the door part 31 between an outer case 311 and a door liner 314.

Hereinafter, a structure of the door part 31 of the door 30 will be described in more detail.

Figure 5:
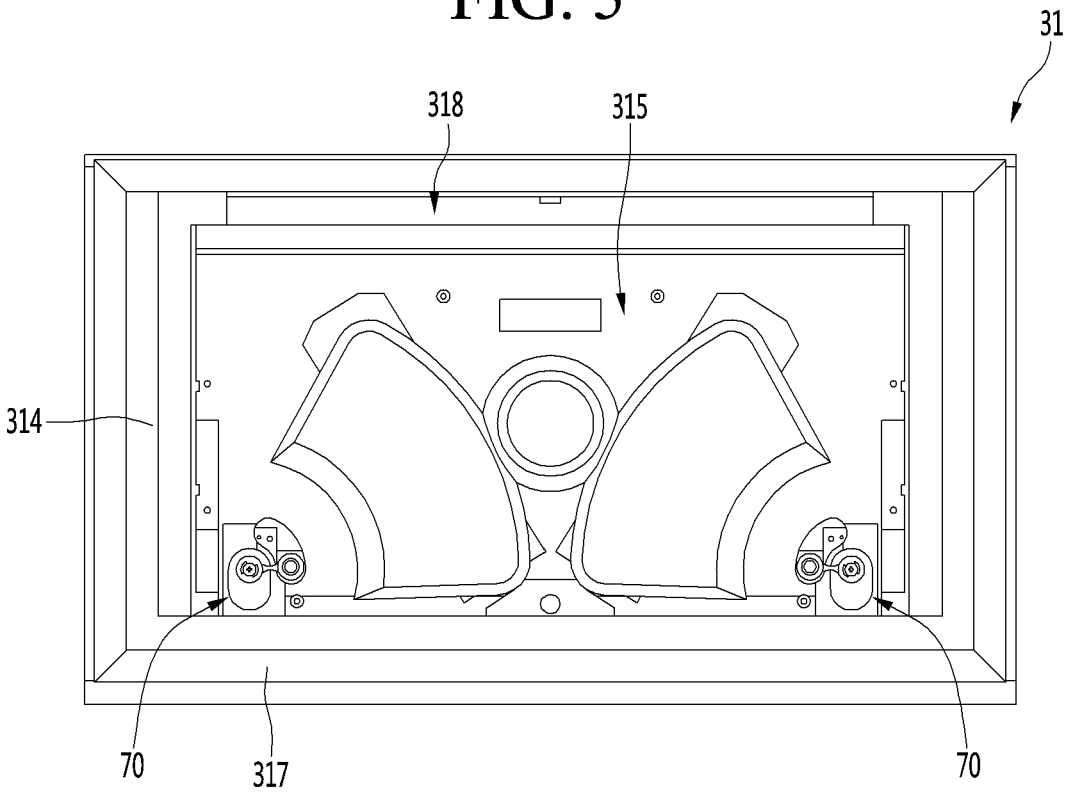
FIG. 5 is a view illustrating a rear surface of the door part.
Figure 6:
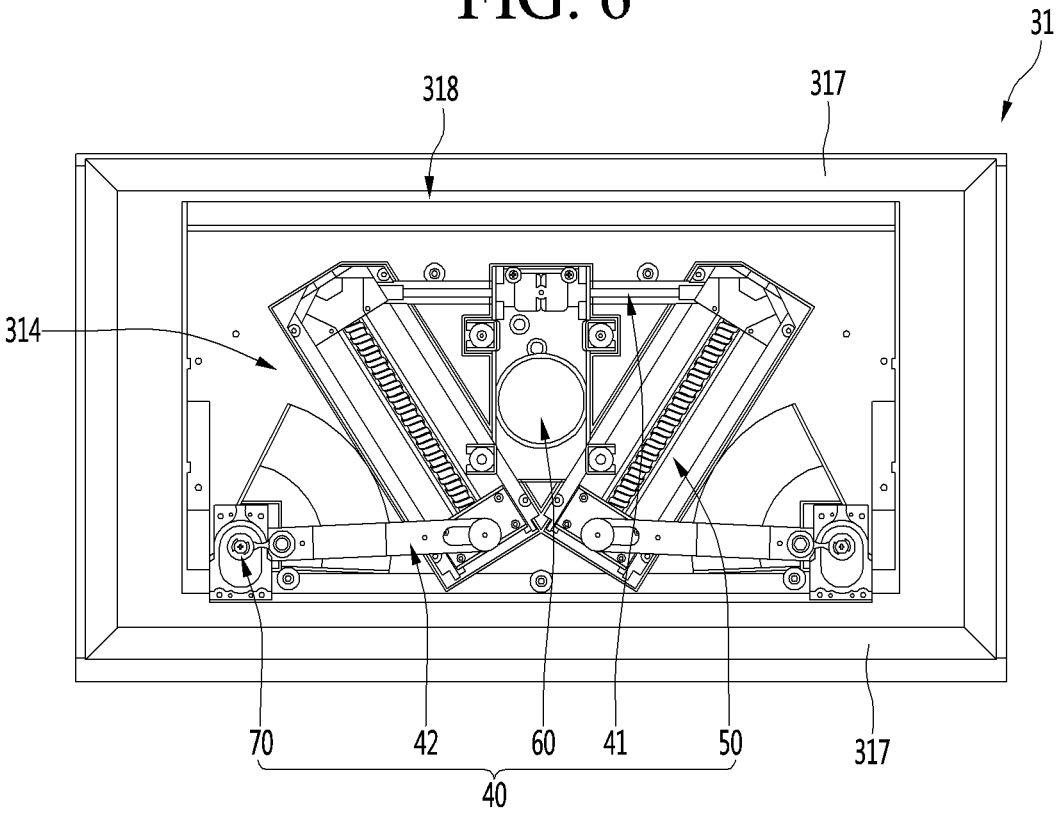
FIG. 6 is a rear view illustrating a state in which a door cover of the door part is removed.
Figure 7:
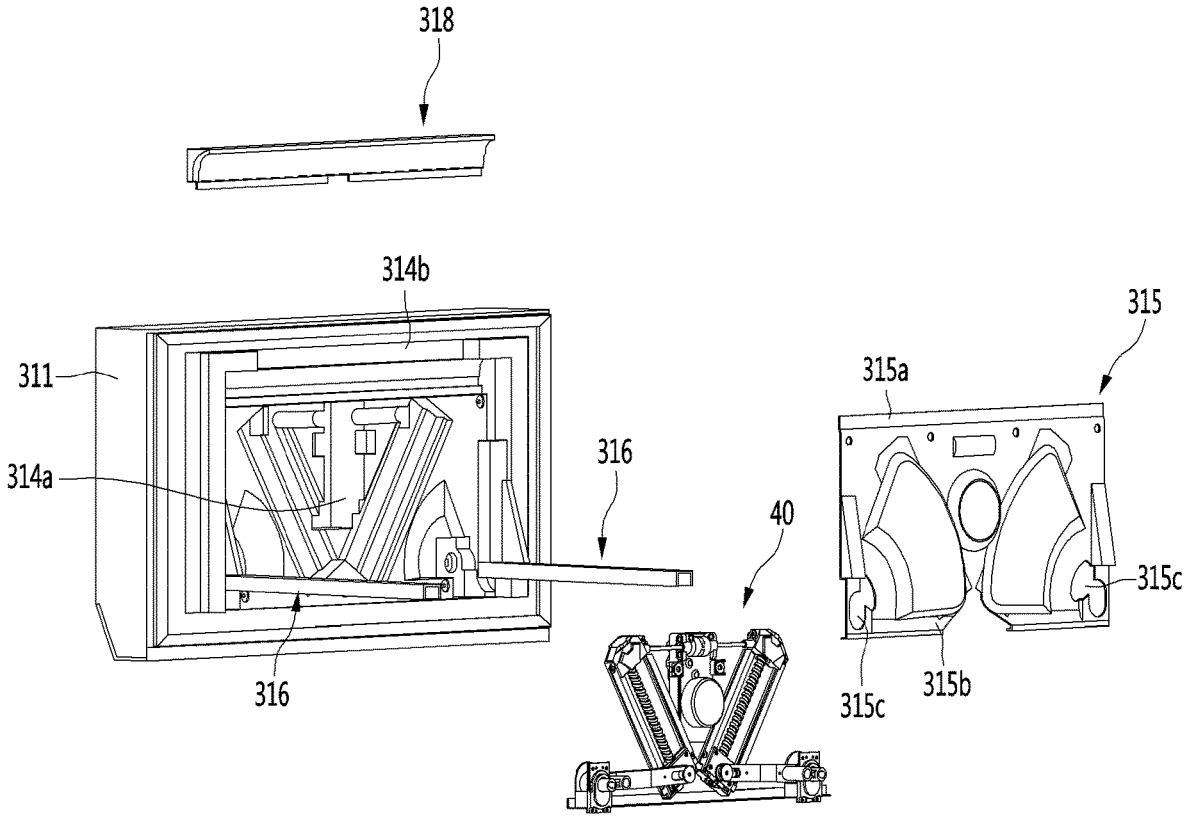
FIG. 7 is an exploded perspective view of the door part.

FIG. 5 is a view illustrating a rear surface of the door part. Also, FIG. 6 is a rear view illustrating a state in which a door cover of the door part is removed. Also, FIG. 7 is an exploded perspective view of the door part.

As illustrated in the drawings, a front surface of the door part 31 may be defined by the outer plate 311, and a rear surface may be defined by the door liner 314. Also, a driving device 40 for operating the elevation device 80 may be provided inside the door part 31. Although the driving device 40 may be disposed inside the door part 31, the driving device 40 but is not embedded in the insulation material 300 but is disposed inside a recessed space of the door liner 314. Then, the driving device 40 may be covered by the door cover 315 and thus may not be exposed to the outside.

In more detail, the insulating material 300 may be filled between the outer plate 311 and the door liner 314 to insulate the inside of the storage chamber 12. Also, the door liner 314 may have a door recess part 314*a* that is recessed inward. The door recess part 314*a* may have a shape corresponding to that of the driving device 40. Thus, the door recess part 314 may have a shape corresponding to that of each of the elements of the elevation device 80 so that the entire driving device 40 can be inserted into the internal space of the door 30.

Also, a lighting recess part 314*b* may be disposed in the upper portion of the rear surface of the door part 31, i.e., the upper portion of the door liner 314. The lighting unit 318 may be mounted in the lighting recess part 314*b*. The lighting unit 318 may be disposed above an opened top surface of the drawer part 32 to emit light to the inside of the drawer part 32 at the front side of the drawer part 32, thereby illuminating the inside of the drawer part 32.

In detail, the lighting unit 318 may be elongated in the lateral direction from the left side to the right side of the rear surface of the door 30 and may be disposed at the uppermost position of the inner side regions of a gaskets 317 disposed along the rear surface of the door 30.

The driving device 40 may be mounted in the door recess part 314*a* disposed below the lighting unit. The driving device 40 may be covered by the door cover 315 in the state of being mounted in the door recess part 314*a*. Alternatively, the door cover 315 may be omitted. When the door cover 315 is omitted, the front surface of the drawer part 32 may cover the driving device 40.

The driving device 40 may be connected to the elevation device 80 provided in the drawer part 32 by the connecting assembly 70. Thus, power of the driving device 40 may be transmitted to the elevation device through the connecting assembly 70. Here, power having the same intensity may be transmitted to both sides of the elevation device 80 through the connecting assemblies 70 disposed on both sides at the same time. Thus, the elevation device 80 may ascend and descend in the horizontal state at both left and right sides without being tilted or biased to one side.

The door cover 315 defining a portion of an outer appearance of the rear surface of the door part 31 may be mounted on the rear surface of the door part 31. The door cover 315 may cover the driving device 40 mounted on the door part 31. The door cover 315 may have a plate shape to cover the driving device so that the door cover 315 is not exposed in the driving device 40 is mounted. Here, the door cover 315 may have a shape that protrudes or is recessed at a position corresponding to the driving device 40.

Also, the door cover 315 may be spaced apart from at least a portion of the door liner 314 in the state of being mounted on the rear surface of the door part 31. Thus, cool air may be supplied therein to cool the driving device.

Also, an upper end 315*a* of the door cover 315 may contact the door liner 314 to cover a portion of the lighting unit 318. Here, a portion of an upper portion of the lighting unit 318 may be exposed. Thus, a space in which light is emitted into the drawer part 32 may be secured.

Also, the upper end 315*a* of the door cover 315 may contact the lighting unit 318. Thus, when the cool air of the lower storage chamber 12 flows to the lighting unit 318, the cool air may be guided by the rounded rear surface of the lighting unit 318 to flow downward along the door cover 315.

Also, a lower air guide 315*b* may be disposed on a lower end of the door cover 315. The lower air guide 315*b* may extend from a left side to a right side of the lower end of the door cover 315. Also, the lower air guide 315*b* may further protrude downward from the lower end of the drawer part 32 and also protrude to be rounded or inclined backward. Thus, the cool air flowing along the door cover 315 may be guided into a space between the bottom surface of the drawer part 32 and the lower storage chamber 12 along the lower air guide 315*b*.

The door opening 315*c* may be defined in each of both left and right sides of the lower portion of the door cover 315. The door opening 315*c* may be defined so that a portion of the connecting assembly 70 passes through the door opening 315*e* to protrude from the rear surface of the door part 31. Also, the door opening 315*c* may have a corresponding shape at a position facing the drawer opening 35. Thus, a portion of the connecting assembly 70 exposed through the door opening 315*c* when the door part 31 and the drawer part 32 are coupled may be coupled to the elevation device 80 to transmit the power Also, a push part 741 of the connecting assembly 70 may be exposed through the door opening 315*c*. The user may manipulate the push part 741 exposed to the rear surface of the door part 31 to selectively couple or separate the driving device 40 to/from the elevation device 80.

A door gasket 317 may be provided along the rear surface of the door part 31. When the door 30 is closed, the door gasket 317 may contact, in an airtight manner, the front surface of the cabinet 10 in the state in which the door 30 is closed.

Hereinafter, the elements of the driving device 40 will now be described in more detail with reference to the accompanying drawings.

Figure 8:
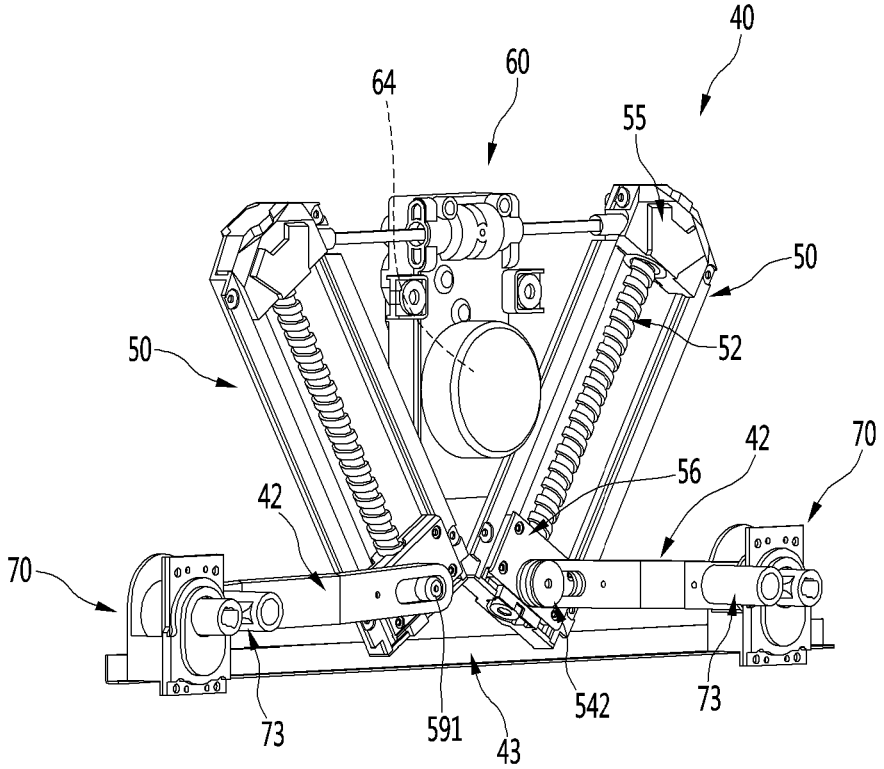
FIG. 8 is a perspective view of the driving device according to an implementation.
Figure 9:
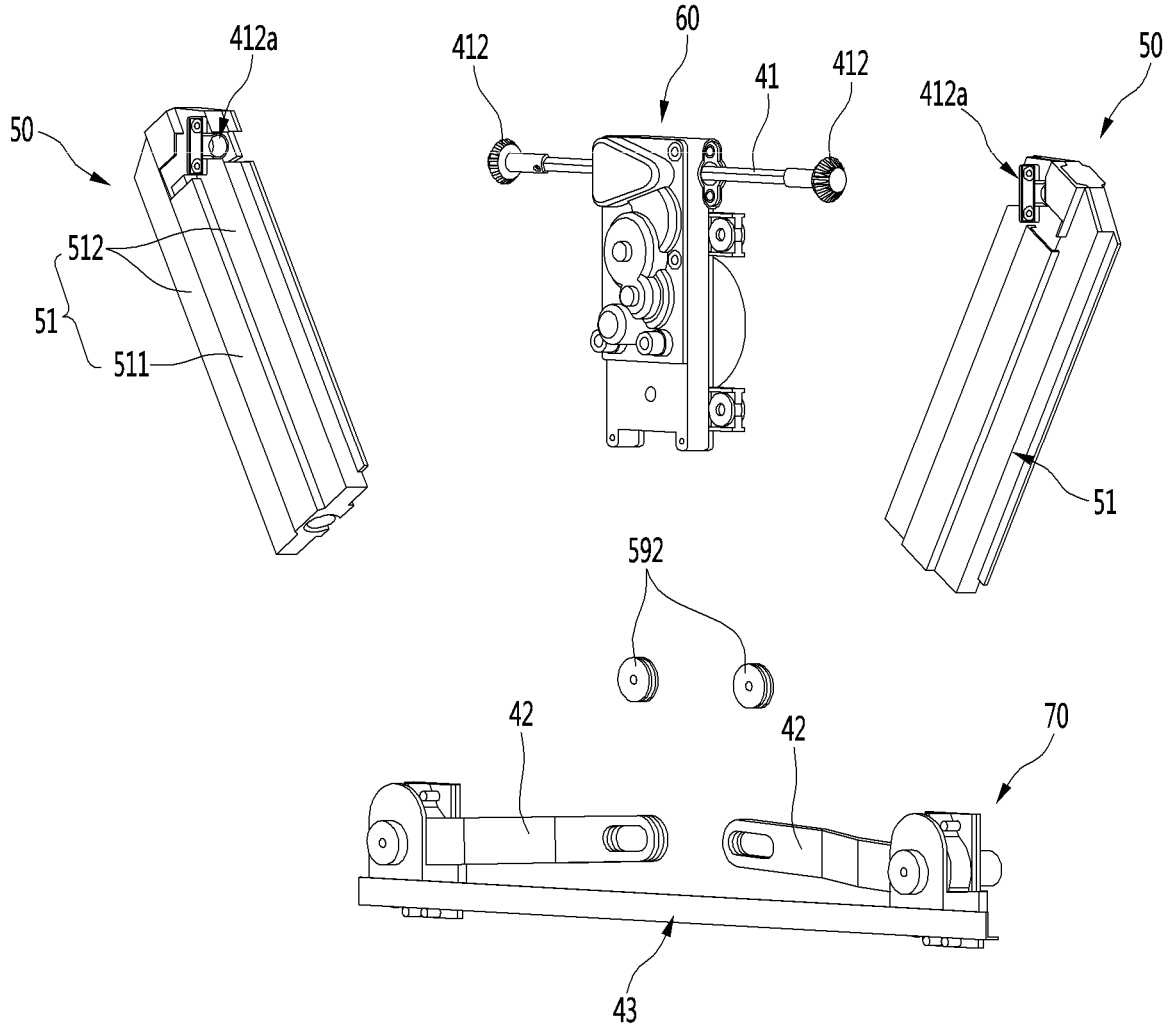
FIG. 9 is an exploded perspective view of the driving device.

FIG. 8 is a perspective view of the driving device according to an implementation. Also, FIG. 9 is an exploded perspective view of the driving device.

As illustrated in the drawings, the driving device 40 may include a motor assembly 60, a screw assembly 50 disposed on each of both sides of the motor assembly 60 and connected by a shaft 41, a lever 42 connected to the screw assembly 50, and the connecting assembly 70.

In detail, the motor assembly 60 may be disposed at a center of each of the left and right sides of the door part 31. Also, the driving device 40 may provide the power for elevating the elevation device 80. The driving device 40 may allow both the screw assemblies 50 and the lever 42 to be driven by the motor assembly, which includes a single driving motor 64.

Particularly, the motor assembly 60 may adjust magnitude of the decelerated and transmitted force through a combination of the plurality of gears. Also, a shaft 41 passing through the motor assembly 60 from the left to the right, i.e., in a horizontal direction may be disposed on an upper end of the motor assembly 60, and the plurality of gears may be combined in the motor assembly 60 for rotation of the shaft 41.

In some implementations, the motor assembly 60 may have a structure in which the driving motor 64 and the gears are arranged vertically to minimize the required recessed space when the motor assembly 60 is mounted on the door part 31. Accordingly a width in the left and right direction may be widened, and a thickness in the front and rear direction may be minimized. Also, the driving motor 64 of the motor assembly 60 may protrude toward the drawer part 32 to minimize a depth of the door part 31 and help increase insulation performance.

The shaft 41 may pass through the motor assembly 60 in the transverse direction and be coupled to the screw assembly 50 disposed at both sides of the motor assembly 60 so that the power of the motor assembly 60 is simultaneously to the screw assembly (50). Thus, the shaft 41 may be referred to as a power transmission member.

In one implementation, the shaft 41 may have a length such that both ends of the shaft 41 pass through the motor assembly 60 and are inserted into the screw assembly 50. Also, a shaft driving gear 411 may be provided at a center of the shaft 41. The shaft driving gear 411 may be coupled to the gears in the motor assembly 60 to rotate. Also, a shaft gear 412 may be disposed on each of both ends of the shaft 41. The shaft gear 412 may have a structure that is coupled to the screw assembly 50. The shaft gears 412 may have the same structure such that the rotation force is applied equally to both shaft gears 412. Accordingly, the driving force may be transmitted simultaneously to both screw assemblies 50.

The screw assemblies 50 may be disposed on both sides of the motor assembly 60. The upper end of the screw assembly 50 may be connected to the shaft 41 and also be gear-coupled to the shaft gear 412 to transmit the power so that the screw 52 rotates. A screw gear having a bevel gear shape gear-coupled to the shaft gear 412 may be further disposed on the screw 52.

When the screw 52 rotates, a screw holder 56 may move along the screw 52. Also, the lever 42 may be coupled to the screw holder 56 to allow the lever 42 to rotate according to the movement of the screw holder 56.

In some implementations, the upper end of the screw assembly 50 may be oriented outward, and the lower end of the screw assembly 50 may be inclined inward. Here, the screw assemblies 50 on both sides may be symmetrical to each other with respect to the motor assembly 60. Thus, the motor assembly 60 may be disposed between the screw assemblies 50 located on both sides of the screw assembly 50. The screw assembly 50 disposed on both sides of the motor assembly 60 may be provided so that a distance between the screw assemblies 50 gradually increases from the upper end to the lower end.

The screws 52 provided in the screw assembly 50 may be arranged in the same direction as the screw assembly 50, and extension lines of the screws 52 on both the left and right sides may cross each other. Also, the screw holder 56 may move along the screw 52 according to the rotation of the screw 52, and the lever 42 connected to the screw holder 56 may rotate along the connecting assembly 70. The screw assembly 50, the lever 42, and the connecting assembly 70 may be symmetrical to each other so that the lever 42 simultaneously rotates at the same angle as the screw assembly 50 is driven.

The lever 42 may connect the screw holder 56 to the connecting assembly 70. Thus, both ends of the lever 42 may be rotatably coupled to the screw holder 56 and the connecting assembly 70, respectively. Thus, when the screw holder 56 linearly moves, the lever 42 may be rotatable about the connecting assembly 70.

The connection assemblies 70 disposed on both the left and right sides may be connected to each other by a connector bracket 43, and the connecting assembly 70 may be firmly supported on the door part 31 to effectively transmit the rotation force to the elevation device 80.

Figure 10:
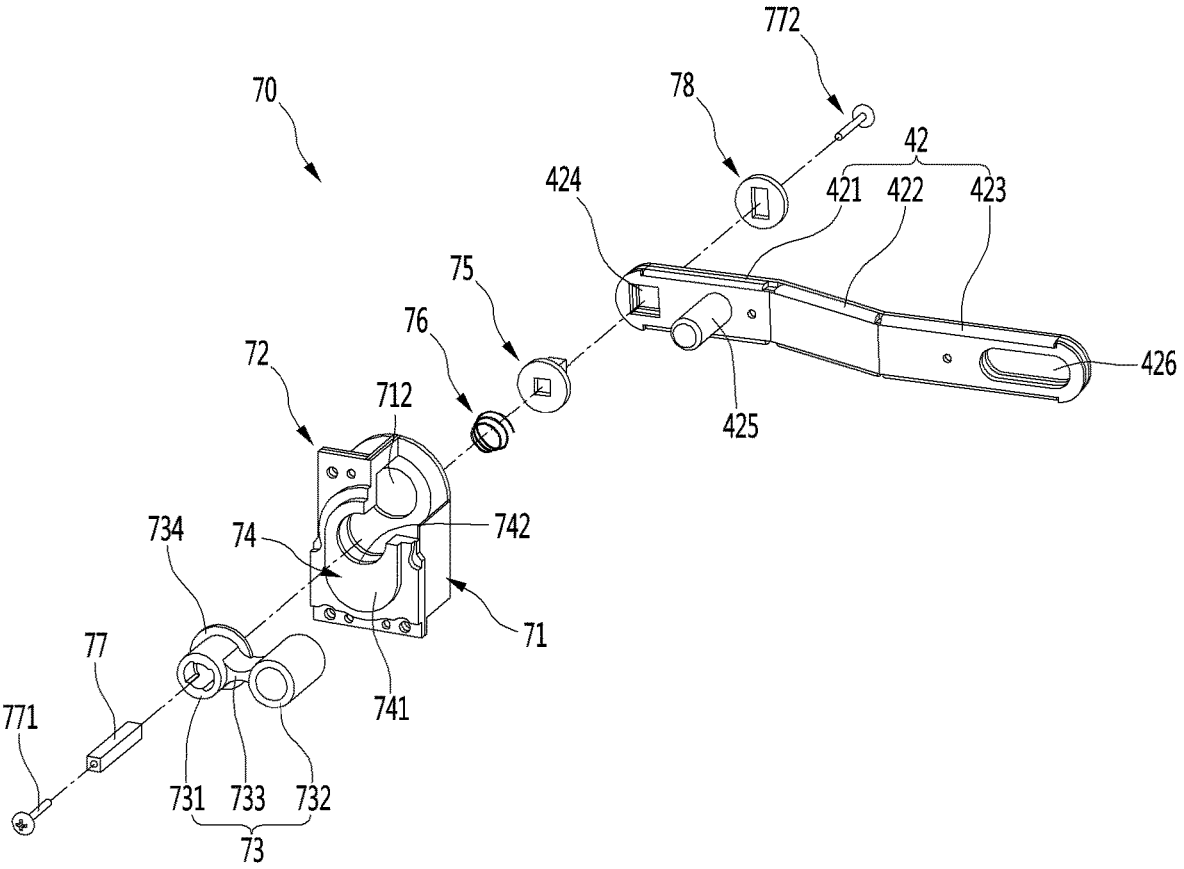
FIG. 10 is an exploded perspective illustrating a coupling structure of a connecting assembly, which is one component of the driving device, and a lever.

FIG. 10 is an exploded perspective illustrating a coupling structure of a connecting assembly, which is one component of the driving device, and a lever.

As illustrated in the drawing, the lever 42 may be configured to connect the screw assembly 50 to the connecting assembly 70.

As for the structure of the lever 42, the lever 42 may be provided in a rod or bar shape having a predetermined width and may extend from the rotation axis of the connecting assembly 70 to the holder protrusion 591 of the screw assembly 50.

In detail, the lever 42 may include a first extension part 421 connected to the connecting assembly, a second extension part 423 connected to the screw holder 56, and an intermediate portion 422 connecting the first extension part 421 to the second extension part 423.

The first extension part 421 and the second extension part 423 may be disposed parallel to each other, and the intermediate portion 422 may have an inclination. Also, the first extension part 421 may be further backward than the second extension part 423 by the inclination of the intermediate part 422.

Accordingly, the lever 42 may not be deformed or damaged even if a large amount of force is applied to the lever 42 due to the structure and shape of the bent lever 42. Also, the lever 42 may be made of a metal material to help realize more stable power transmission even when the elevation device 80 on which a heavy food is seated is elevated.

Also, the inclination of the intermediate portion 422 may allow the lever 42 to be connected between the connecting assembly 70 disposed relatively backward and the screw holder 56 disposed relatively forward.

A first lever hole 424 may be defined in the first extension part 421 to be connected to the lever fixing member 75 of the connecting assembly 70. The first lever hole 424 may be have a polygonal shape corresponding to one side of the lever fixing member 75 and may be opened in a rectangular shape as illustrated in the drawing. The lever fixing member 75 may also rotate together when the lever 42 rotates.

Also, the lever protrusion 425 may be disposed on the first extension part 421. The lever protrusion 425 may be spaced apart from the first lever hole 424 and disposed toward the intermediate part 422. The lever protrusion 425 may be configured to be coupled to the connection member 73 of the connecting assembly 70. That is, the rotation force of the lever 42 may be transmitted to the connecting assembly 70 by the lever protrusion 425 together with the first lever hole 424. Furthermore, the rotation force may be transmitted to the elevation device 80 to elevate the elevation device 80.

Also, a second lever hole 426 through which the holder protrusion 591 of the screw holder 56 is inserted may be defined in the second extension part 423. The second lever hole 426 may have a size corresponding to the holder protrusion 591 and also may have a long hole shape in the extension direction of the second extension part 423 so that the holder protrusion 591 move as the screw holder 56 move vertically. Thus, the holder protrusion 591 may be disposed on the left end of the second lever hole 426 in a state in which the screw holder 56 is disposed at the lowest position, and as the screw holder 56 move upward, the protrusion 591 moves to the right side of the second lever hole 426 so that the lever 42 rotates.

The connecting assembly 70 may be provided at one end of the lever 42, i.e., at a position corresponding to the first extension part 421. A connection member 73 for connecting the lever 42 to the elevation device 80 may be rotatably mounted on the inside of the connecting assembly 70.

The connection member 73 may be coupled to the lever fixing member 75 by the fixing shaft 77 and thus may rotate together with the rotation of the lever 42. Also, the connection member 73 may be connected to the lever protrusion 425 and the scissors protrusion 841*b* to transmit greater force to the elevation device 80, and thus, the elevation device 80 may be more effectively lifted. Thus, the elevation device 80 in the state in which the food is seated sufficiently while using only one of the drive motors 64 may be elevated, and a compact configuration may be realized.

The connecting assembly 70 may have an outer appearance defined by the connection case 71 and the connection cover 72, and the lever fixing member 75 and the connection member 73 may be mounted on the connection case 71.

The connecting assembly 70 may include the connection case 71, the connection cover 72, and the connection member 73, the push member 74, the lever fixing member 75, and the elastic member 76.

In detail, the connection case 71 may be opened on one side and includes a space for accommodating the lever fixing member 75, the connection member 73, the push member 74, and a portion of the lever 42. Also, a through-hole 712 may be defined in the space. An external fixing member 78 may be provided on the outer surface of the connection case 71 corresponding to the through-hole 712.

Also, the lever fixing member 75 may be accommodated in the space inside the connection case 71 and define a surface capable of supporting one end of the elastic member 76. Also, A first lever hole 424 of the lever 42 and the through-hole 712 may extend to be sequentially penetrated through a center of the lever fixing member 75 to allow the external fixing member 78 to be inserted therein.

The fixing shaft 77 may pass through the first connection part 731 of the connection member 73 and then be inserted into the lever fixing member 75. Also, coupling members 771 and 772 may be coupled to both ends of the fixing shaft 77, respectively. The lever fixing member 75, the external fixing member 78, and the connection member 73 may be coupled to the fixing shaft 77 through the coupling of the coupling members 771 and 772. Thus, when the lever fixing member 75 rotates by the rotation of the lever 42, the connection member 73 connected by the fixing shaft 77 may also rotate together.

The elastic member 76 may be provided between the connection member 73 and the lever fixing member 75. The elastic member 76 may be compressed when the connection member 73 moves. In detail, the elastic member 76 may have a coil spring structure and have one end supported by the lever fixing member 75 and the other end supported by the connection support part 734 of the connection member 73.

The connection member 73 may move in the front-rear direction within the space of the connection case 71. Here, the connection member 73 may have a structure that is inserted into or protrudes to the space by the guide of the fixing shaft 77.

In details of the structure of the connection member 73, the connection member 73 may include a first connection part 731 which passes through the fixing shaft 77 and is concentric with the rotation axis of the lever 42, a second connection part 731 which is spaced from the first connection part 731 and into which the lever protrusion 425 is inserted, and a connection part 733 connecting the first connection part 731 to the second connection part 732.

The first connection part 731 may have a hollow cylindrical shape. Also, the rotation shaft 841*a* of the elevation device 80 may be inserted into the first connection part to rotate together with the rotation shaft 841*a* of the elevation device 80.

In some implementations, a connection support part 734 protruding outward by a predetermined width may be disposed on one side of the first connection portion 731. The end of the elastic member 76 may contact the connection support part 734, and the end of the first connection part 731 may contact the connection support part 734. The connection support part 734 may protrude outward to support one end of the elastic member 76, and one end of the first connection part 731 may be inserted into the elastic member 76 to prevent the elastic member 76 from being separated.

The connection support part 734 may be larger than the size of the through-hole 742 defined in the push member 74 to maintain the state in which the connection support part 734 is in close contact with the rear surface of the push member 74. Thus, the connection support part 734 and the push member 74 may move together when the push member 74 is pressed or when the elastic member 76 returns to the initial position.

The second connection part 732 may be disposed at a position spaced apart from the first connection part 731 by the connection member 73. The second connection part 732 may have a cylindrical shape that is penetrated in the front and rear direction. The lever protrusion 425 may be inserted into one side of the second connection part 732, and the scissors protrusion 841*b* of the elevation device 80 may be inserted into the other side of the second connection part 732. Thus, the second connection part 732 may rotate together with the scissors protrusion 841*b* and the lever protrusion 425 when the elevation device 80 operates.

The connection part 733 may be disposed so that the rotating shaft 841*a* and the scissors protrusion 841*b* of the elevation device 80 are respectively inserted into the first connection part 731 and the second connection part 732. As the second connection part 732 move farther away from the first connection part 731, the elevation device 80 may be easily elevated. However, when the first connection part 731 and the second connection part 732 are spaced a set distance or more from each other, the moving trajectory of the lever protrusion 425 and the scissors protrusion 841*b*, which are inserted into the second connection part 732, may extend up to a high height on the rear surface of the door part 31 and the front surface of the drawer part. Thus, the opened trajectory may be exposed to deteriorate the outer appearance. Thus, The position of the second connection part 732 may be determined by the length of the connection part 733. Also, the second connection part 732 may be disposed at a height at which the rotation trajectory is not exposed, i.e., a position higher than the upper end of the elevation device 80.

In an alternative implementation, the scissors protrusion 841*b* of the elevation device 80 may be provided as a recessed portion that is configured to receive and become coupled to a corresponding protrusion provided by the second connection part 732, which may alternatively be provided as a protruded portion.

The push member 74 may be provided inside the connection device case 71 and may be exposed through the opening 721 of the connecting cover 72 so that the push member 68 is pressed by the user. The push member 74 may include a push part 741 that is exposed through the opening 721 of the connecting cover 72.

A through-hole 742 through which the first connection part 731 passes may be defined in the push part 741. The through-hole 742 may be larger than the outer diameter of the first connection part 731 and slightly smaller than the outer diameter of the connection support part 734. Thus, when the push member 741 may be pushed to move the push member 74, the first connection member 73 contacting the push member 74 may also move together to selectively connect the connection member 73 to the elevation device 80.

The connecting cover 72 may be mounted on the opened front side of the connecting case 71, and an opening 721 may be defined to expose the push part 741. The connecting cover 72 may be firmly fixed to the connecting case 71 by the coupling member. Thus, the configuration of the connecting case 71 may be maintained in the mounted state.

The connecting case 71, the push member 74, and a portion of the connecting cover 72 may be opened by cutting the connection member 73 by a rotational trajectory. Thus, the connection member 73 may be prevented from interfering with the connecting case 71, the push member 74, and the connecting cover 72 when the connection member 73 rotates.

In this structure, the user may manipulate the push member 74 of the connecting assembly 70 to selectively couple and separate the connecting assembly 70 to and from the elevation device 80.

Hereinafter, a structure of the drawer part 32 coupled to the door part 31 will now be described in more detail with reference to the accompanying drawings.

Figure 11:
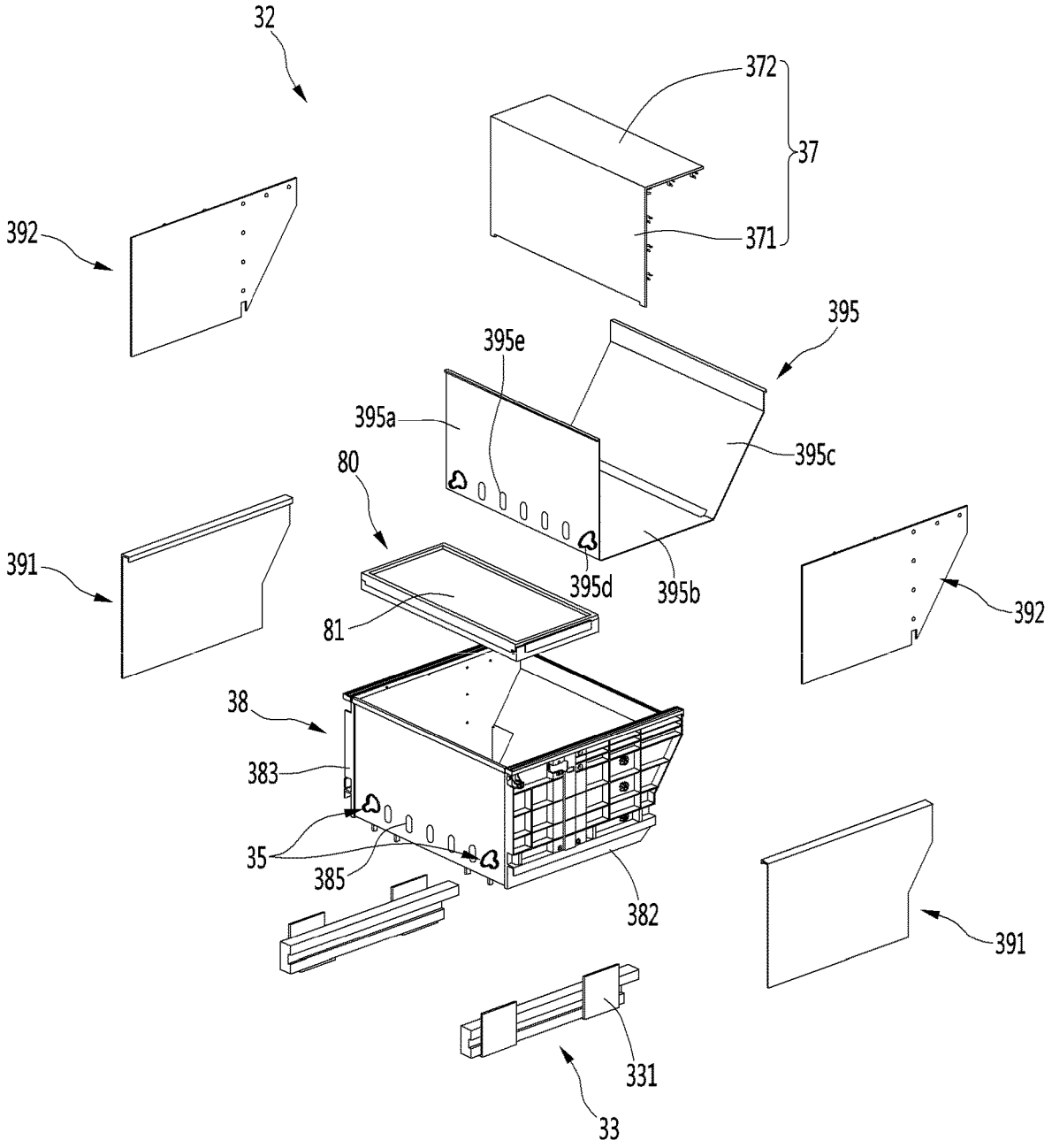
FIG. 11 is an exploded perspective view of the drawer part.
Figure 12:
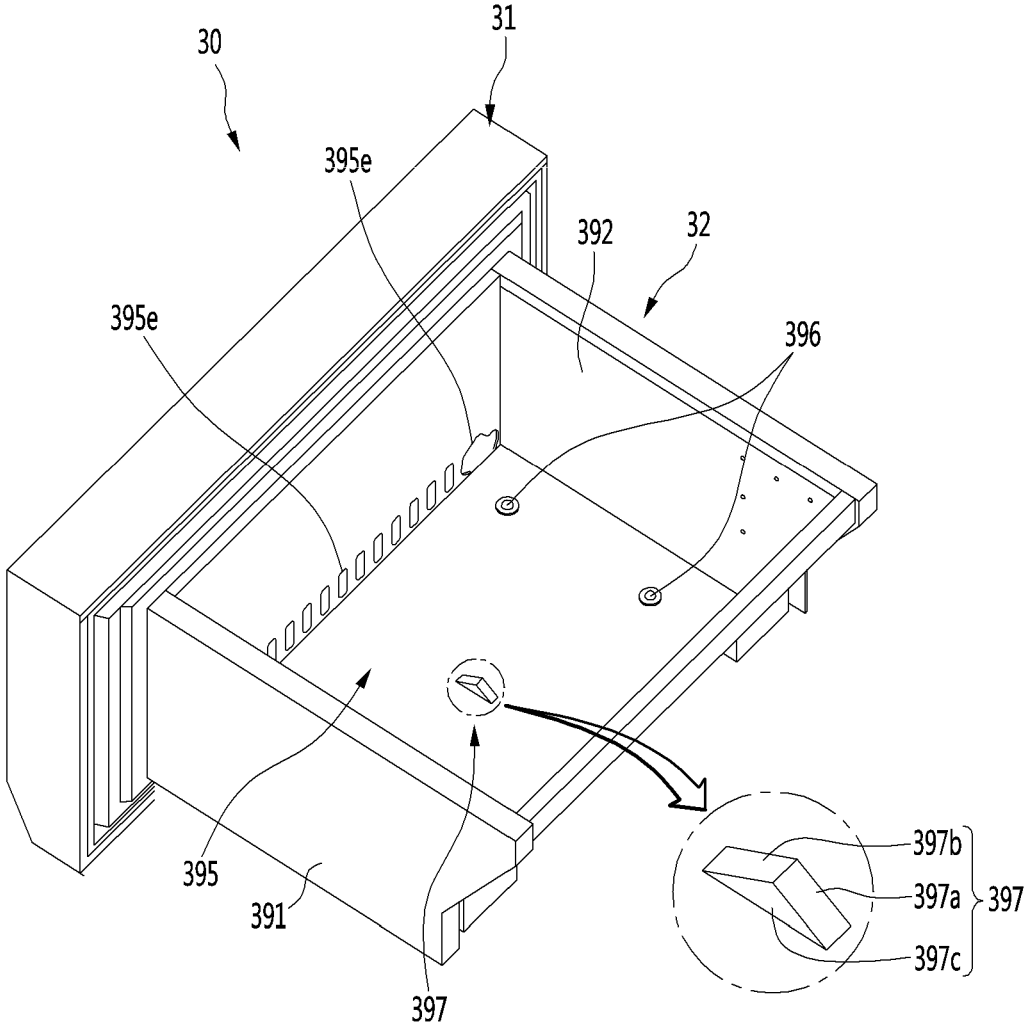
FIG. 12 is a view of the drawer door when viewed from an upper side.

FIG. 11 is an exploded perspective view of the drawer part. Also, FIG. 12 is a view of the drawer door when viewed from an upper side.

As illustrated in the drawings, the drawer part 32 may include a drawer body 38 defining an entire shape of the drawer part 32, an elevation device 80 provided in the drawer body 38 to elevate the container and food, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage chamber therein. An inclined surface 321 may be disposed on a rear surface of the drawer body 38. Thus, an interference with the machine room 3 may be prevented.

The door frames 316 may be mounted on both sides of the drawer part 32. The door frame 316 may be coupled to the lower frame of each of both sides of the bottom surface or both left and right surfaces of the drawer part 32. In the state in which the door frame 316 and the drawer part 32 are coupled to each other, the drawer part 32 and the door part 31 may be integrally coupled to be inserted and withdrawn.

The door frame 316 may be separated from the drawer part 32, and then the connecting assembly 70 may operate to separate the door part 31 from the drawer part 32 in order to separate the door part 31 from the drawer part 32. The door frame 316 and the drawer part 32 may be coupled to each other by a separate coupling member or a coupling structure between the door frame 316 and the drawer unit 32.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage chamber. Also, the draw-out rack 34 may be coupled to a pinion gear 141 disposed on the bottom surface of the storage chamber. Thus, when the draw-out motor 14 is driven, the pinion gear 141 may rotate to allow the draw-out rack 34 to move, and the door 30 may be inserted and withdrawn.

The door 30 may not be automatically inserted and withdrawn. That is, the user may push or pull the door 30 to be inserted and withdrawn. Here, the draw-out rack 34 may be omitted, and thus, the insertion and withdrawal may be performed through only the draw-out rail 33.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a multistage rail that extends in multiple steps. The draw-out rail 33 may have one end fixed to the storage chamber inside the cabinet 10 and the other end fixed to the rail mounting part 382 to achieve more stable insertion and withdrawal of the door 30.

Also, the plurality of plates 391, 392, and 393 that are made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, elements such as the door frame 316 and the draw-out rail 33, which are mounted on both the sides of the drawer body 38, may not be exposed to the outside.

A plurality of reinforcement ribs 384 may cross each other in vertical and horizontal directions on both outer surfaces of the drawer body 38. The reinforcement ribs 384 may reinforce the strength of the drawer body 38 itself so that the drawer body 38 is more rigidly shaped relative to the weight of the door, which increases by providing the driving device and the elevation. Also, the reinforcement ribs 384 may support the outer side plates 391 mounted on both side surfaces, and thus the outer appearance of the drawer part 32 may be firmly maintained.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The inner plate 395 may include a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* of the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the storage chamber within the drawer part 32 may have a metal texture on the whole, and the foods accommodated in the drawer part 32 may be more uniformly cooled and thus stored at a low temperature in the more uniform region. In addition, excellent cooling performance and storage performance that is also visually appealing may be provided to the user as a result.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the elevation device 80 is disposed, may be exposed in the drawer body 38, and the rear space S2 may be covered by the drawer cover 37.

The elevation 80 may be disposed in the drawer body 38. The elevation device 80 may be connected to the connecting assembly 70 and may be vertically movable. The left and right sides of the elevation device 80 may be elevated uniformly.

A drawer opening 35 may be defined in the lower part of the front surface of the drawer part 32 for coupling the elevation device 80 to the connecting assembly 70. The drawer opening 35 may provide a passage through which the connection member 73 is inserted to be coupled to the elevation device. Also, the drawer opening 35 may have an opening shape along the rotation path of the connection member 73 when the connection member 73 rotates to allow the connection member 73 to rotate, and thus, the stable rotation may be achieved without the interference.

The elevation device 80 may be provided as a scissors type so that the elevation device is folded in a descending state and unfolded in an ascending state. Thus, the container or food seated on the top surface may be elevated.

The elevation device 80 may be provided with a support plate 81, and the support plate 81 may provide a seating surface on which the container 36 or food is seated.

A plurality of ventilation holes 385 may be defined in a lower end of the front surface of the drawer body 38. The ventilation hole 385 may guide the cool air flowing downward along the rear surface of the door part 31 so as to be introduced to the bottom surface of the drawer part 32. A plurality of ventilation holes 385 may be continuously arranged at regular intervals.

Also, a plate hole 395*e* may be defined in a front surface of the inner plate 395 to correspond to the ventilation hole 385, and a connecting hole 395*d* corresponding to the drawer opening 35 may be further defined. The plate hole 395*e* and the connecting hole 395*d* may have the same size and shape as the ventilation hole 385 and the drawer opening 35 and may be defined in the same position.

Thus, the cool air flowing along the rear surface of the door part 31 may be introduced into the drawer part 32 through the ventilation hole 385 and the plate hole 395*e* in order. Also, the plate hole 395*e* and the connecting hole 395*d* may be collectively referred to as the ventilation hole 385 and the drawer opening 35.

Figure 27:
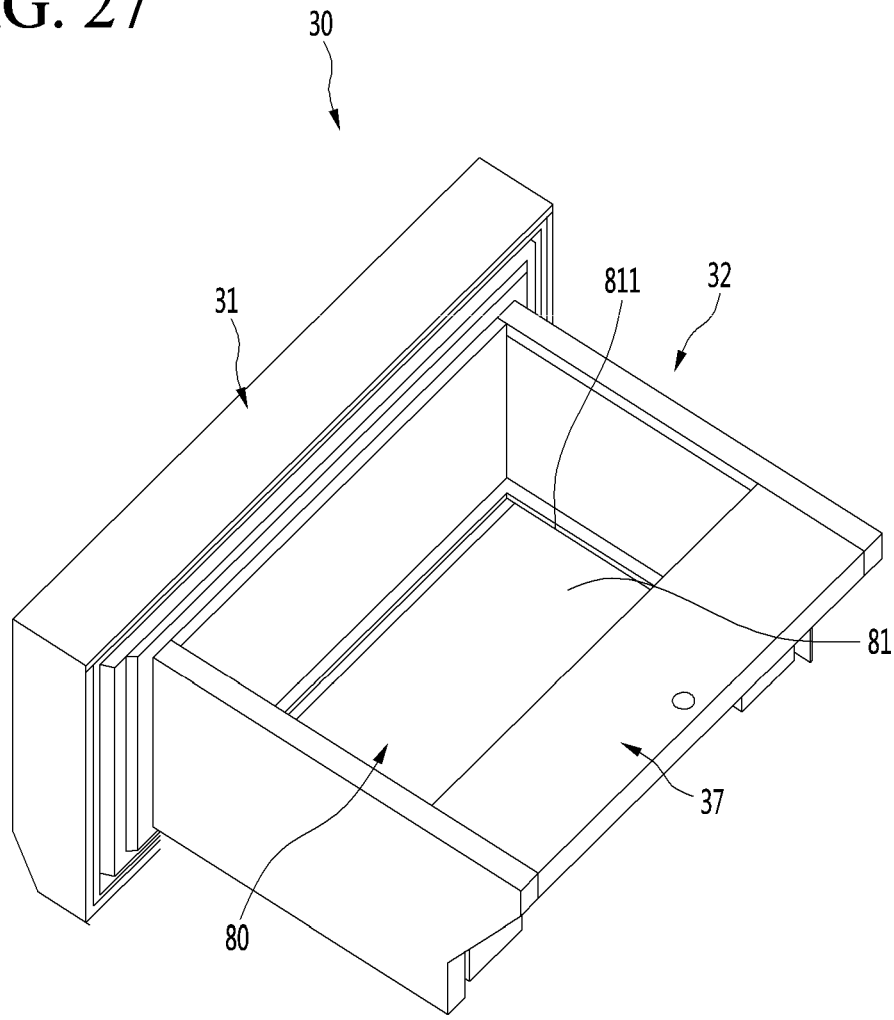
FIG. 27 is a perspective view illustrating a state in which the elevation device is mounted on the drawer door.

The ventilation hole 385 and the drawer opening 35 may be exposed as shown in FIG. 12 when the elevation device 80 is separated but may be covered as shown in FIG. 27 when the elevation device 80 is mounted. That is, the height of each of the ventilation hole 385 and the drawer opening 35 may be lower than the that of the elevation device 80. Thus, the ventilation hole 385 and the drawer opening 35 may be covered by the elevation device 80 when the elevation device 80 is mounted. Also, the connecting assembly 70 disposed on the drawer opening may be disposed lower than the top surface of the elevation device 80 and may be covered by the elevation device 80.

A seating protrusion 396 may protrude from an inner bottom surface of the drawer part 32 on which the elevation device 80 is mounted. The seating protrusion 396 may be disposed at a position corresponding to the seating hole 837 defined in each of four corners of the bottom surface of the elevation device 80. When the elevation device 80 is mounted inside the drawer part 32, the seating protrusion 396 and the seating hole 837 may be coupled to each other. The elevation device 80 may not move but be maintained in a stable mounting state even during the elevation operation of the elevation device 80.

A protrusion 397 may protrude from a transverse center of the front space S1. The protrusion 397 may be disposed a position corresponding to the restricting unit 90 to be described below. When the elevation device 80 is mounted, the restricting unit 90 may contact the restricting unit 90 so that the restriction of the restricting unit is released.

The protrusion 397 may have a pair of guide surfaces 397*a* and 397*b* of which ends are inclined to contact each other. The protrusion 397 may be provided in a rounded curved shape that is not provided as the pair of guide surfaces 397*a* and 397*b* but is lowered toward both sides.

The protrusion 397 may be mounted on the bottom surface of the drawer body 38 or may be integrated to protrude when the drawer body 38 is molded. The protrusion 397 may protrude upward by passing through the bottom surface of the inner plate 395.

The protrusion 397 may be formed by cutting a portion of the inner plate 395. A portion of the inner plate 395 may be cut to form an opening 397*c*, and the cut portion above the opening 397*c* may be bent to form the pair of the guide surfaces 397*a* and 397*b*.

The seating protrusion 396 and the protrusion 397 may be provided as separate elements so as to be mounted on the inner plate 395 or the drawer body. The seating protrusion 396 and the protrusion 397 may be integrated with the inner plate 395 or the drawer body 38.

Figure 13:
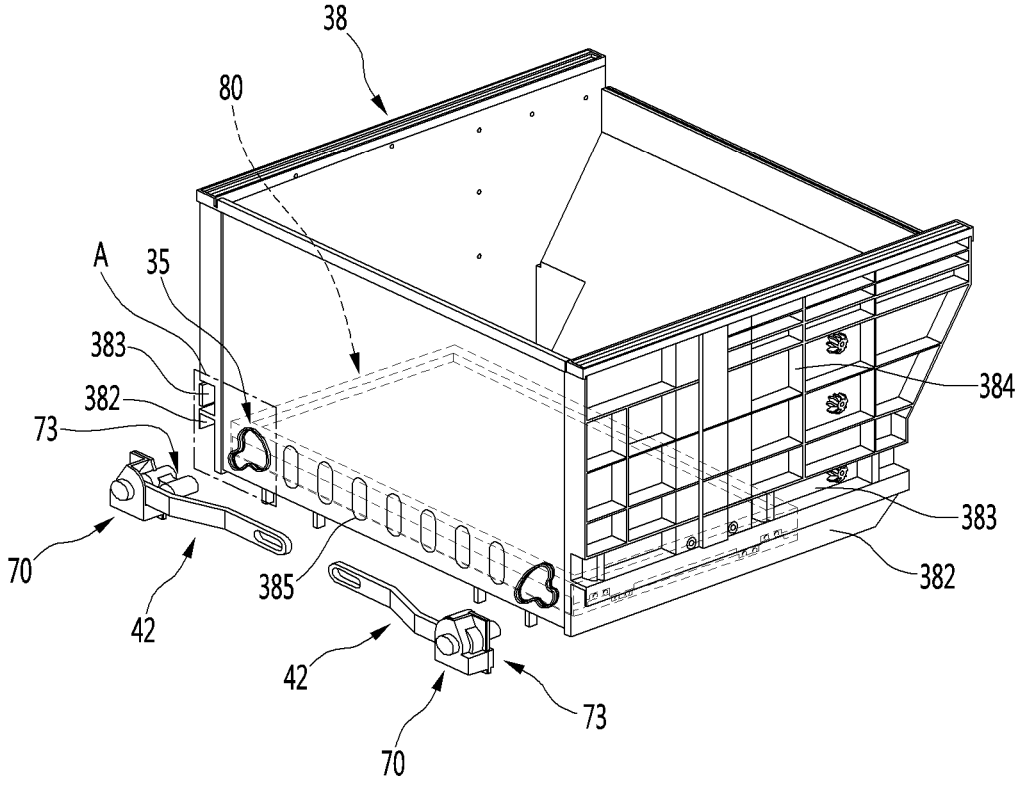
FIG. 13 is an exploded perspective view illustrating a coupling relationship between the drawer part and the connecting assembly.
Figure 14:
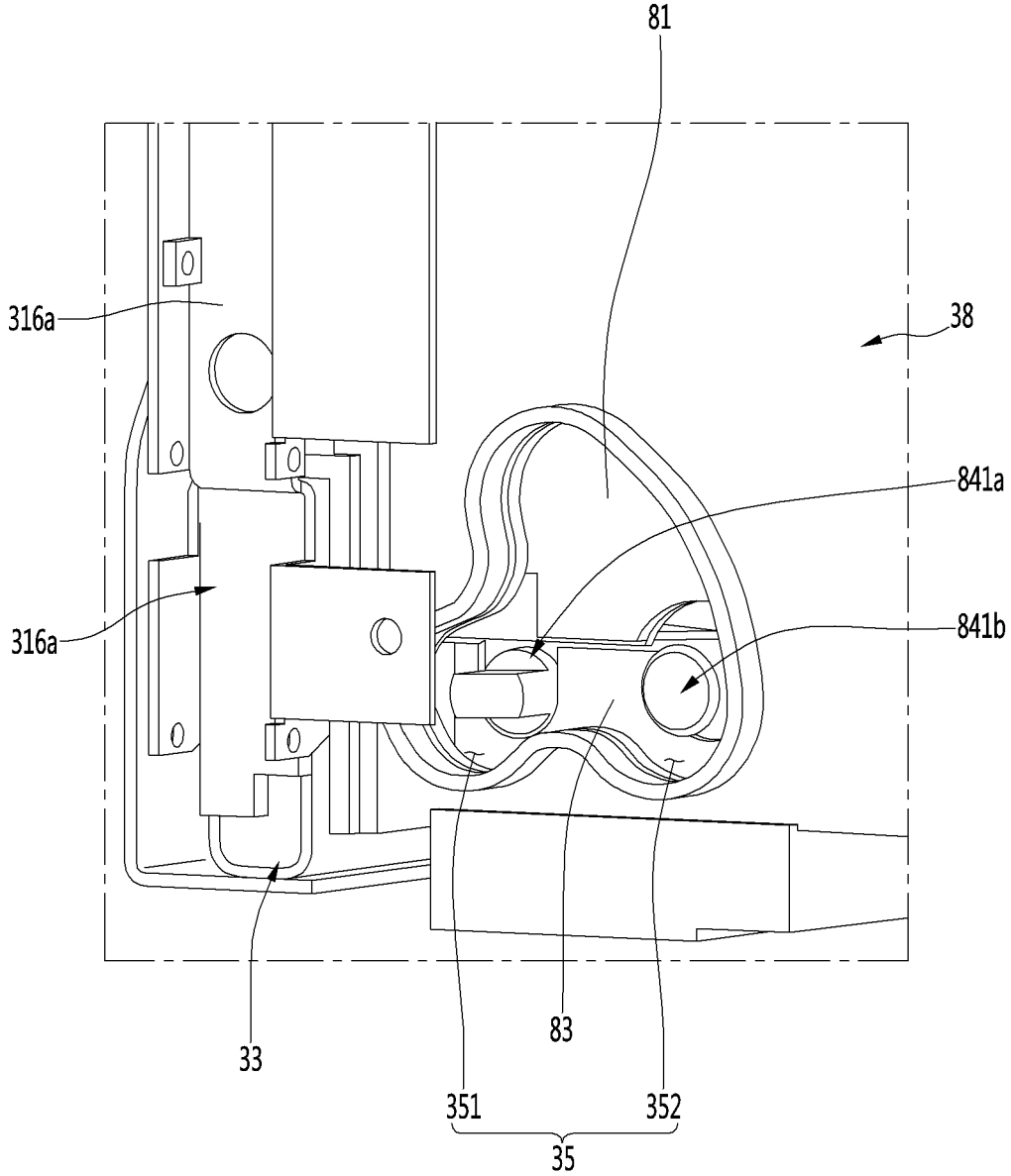
FIG. 14 is an enlarged view illustrating a portion A of FIG. 13.

FIG. 13 is an exploded perspective view illustrating a coupling relationship between the drawer part and the connecting assembly. Also, FIG. 14 is an enlarged view illustrating portion A of FIG. 13.

As illustrated in the drawings, the drawer opening 35 may be defined in the right and left sides of the lower front of the drawer part 32. The shape of the drawer opening 35 on each of both sides of the right and left sides may be symmetrical to each other, and the rotation shaft 841*a* of the elevation device 80 and the scissors protrusion 841*b* may be exposed through the drawer opening 35. That is, the drawer opening 35 may be opened at a position corresponding to the rotation shaft 841*a* of the elevation device 80 and the scissors protrusion 841*b*.

The drawer opening 35 may include a central portion 351 and a trajectory portion 352. The center portion 351 may be disposed at a position corresponding to the rotation shaft 841*a* of the elevation device 80 and may have a size such that the first connection part 731 of the connection member 73 is inserted. Also, the trajectory portion 352 may be connected to the center portion 351 and may be opened in a shape corresponding to the trajectory in which the second connection part 732 of the connection member 73 move to rotate. Thus, the rotation shaft 841*a* of the elevation device 80 may rotate on the central portion 351 while the scissors protrusion 841*b* of the elevation device 80 rotates along the trajectory portion 352. That is, the scissors protrusion 841*b* and the second connection part 732 may be disposed inside the center portion 351 and the trajectory portion 352 when the elevation device 80 moves vertically.

The height of the drawer opening 35 may be lower than the upper end of the elevation device 80, i.e., the top surface of the support plate 81. Thus, the drawer opening 35 may be prevented from being seen from the inside of the drawer part 32 in any state in the state in which the elevation device 80 is mounted.

The rotation shaft 841*a* and the scissors protrusion 841*b* of the elevation device 80 may be exposed through the drawer opening 35 while the elevation device 80 is mounted inside the drawer part 32. Also, in the state in which the sub door 30 is coupled, the connection member 73 of the connecting assembly 70 may be inserted through the inside of the drawer opening 35 so as to be coupled to the rotation shaft 841*a* of the elevation device 80 and the scissors protrusion 841*b*.

The connecting assembly 70 may be provided on each of both right and left sides of the drawer part 32 and may have a shape symmetrical to each other. The selective separation of the elevation device 80 and the connecting assembly 70 may be enabled through the manipulation of the push member 74.

The circumference of the support plate 81 may protrude upward so that the container 36 or food can be stably mounted. Also, the circumference of the support plate 81 may extend downward. Thus, the remaining elements of the elevation device may be accommodated below the support plate 81, and the covered and clean outer appearance may be realized by the circumference of the support plate 81.

In addition, the support plate 81 may have a size and a shape corresponding to the front space to prevent foreign matters from being introduced into the elevation device 80 provided below the front space S1, and also, to fundamentally prevent safety accidents from occurring by blocking the access to the elevation device 80.

Hereinafter, elements of the elevation device 80 will be described in more detail.

Figure 15:
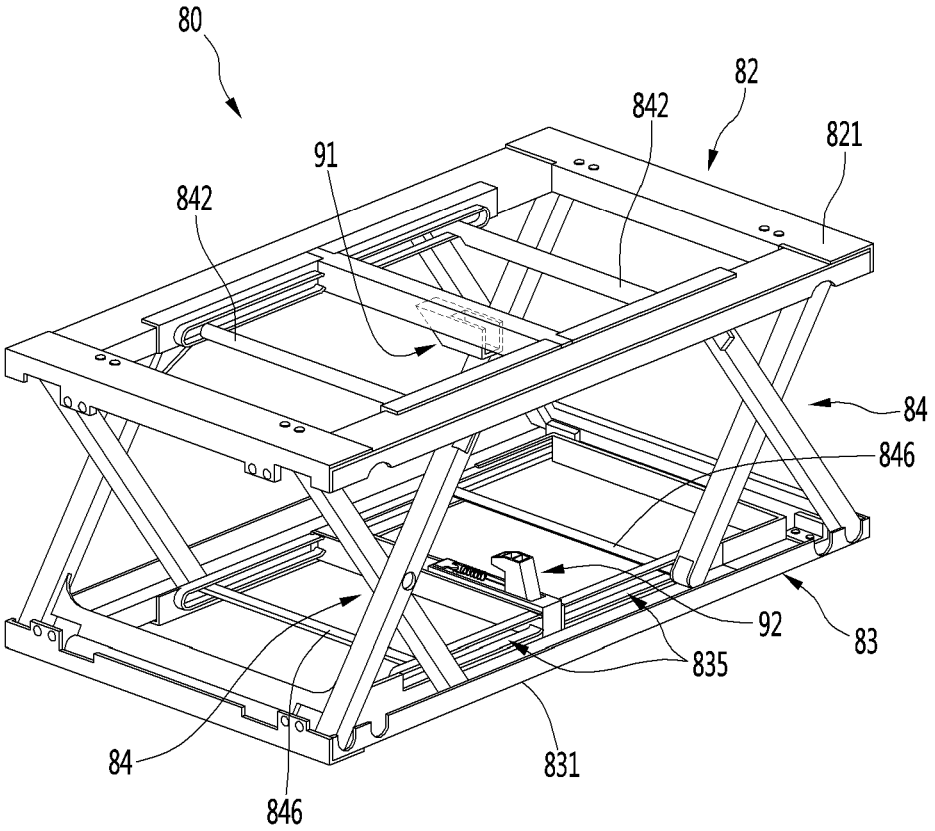
FIG. 15 is a perspective view of the elevation device according to an implementation.
Figure 16:
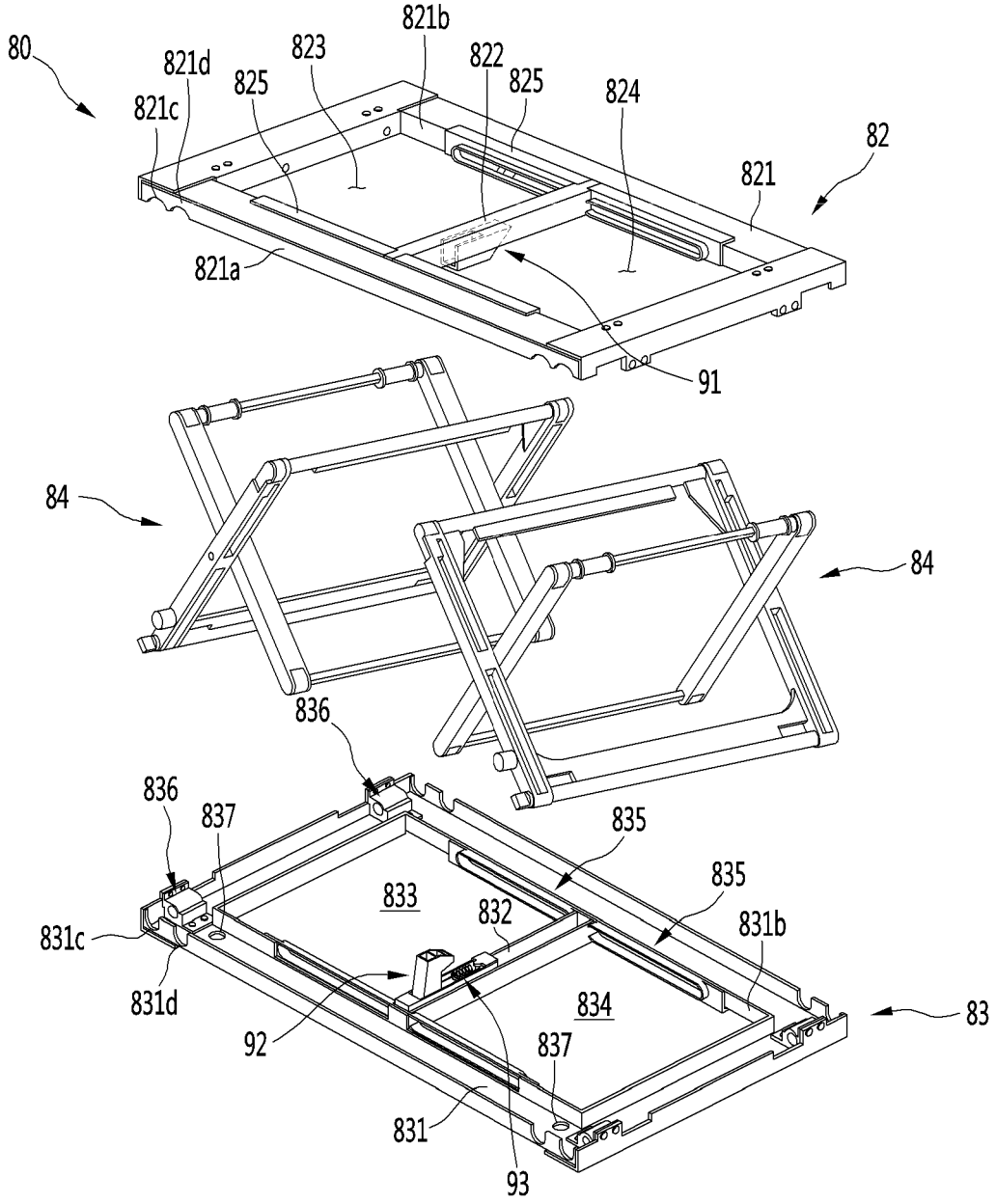
FIG. 16 is an exploded perspective view of the elevation device.
Figure 17:
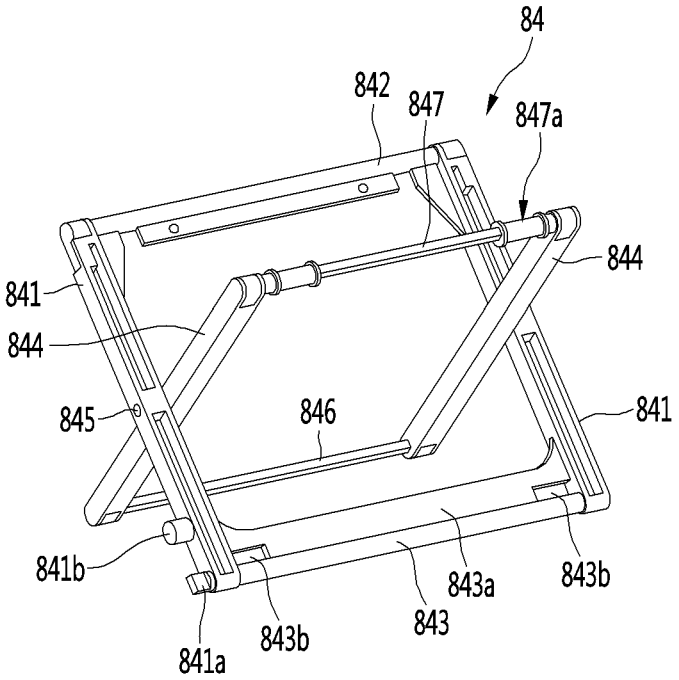
FIG. 17 is an perspective view of a scissors lift assembly that is one component of the elevation device.

FIG. 15 is a perspective view of the elevation device according to an implementation. Also, FIG. 16 is an exploded perspective view of the elevation device. Also, FIG. 17 is an perspective view of the scissors lift assembly that is one component of the elevation device.

As illustrated in the drawings, the elevation device 80 may be provided on the bottom surface of the inner side of the drawer part 32 and may be detachably installed on the inside of the drawer part 32. Also, the elevation device 80 may include an upper frame 82 and a lower frame 83 as a whole and a scissors lift assembly 84 disposed between the upper frame 82 and the lower frame 83.

In detail, the upper frame 82 may have a square frame shape corresponding to the size of the inner front space S1 of the drawer part 32 and may be configured to mount the support plate 81 on the top surface thereof.

The upper frame 82 of the elevation device 80 may move upward and downward and substantially supports the food or the container 36 together with the support plate 81. Also, the upper frame 82 may generally defines a frame part 821 which defines a circumferential shape of the upper frame 82 and an upper partition part 822 for partitioning the space inside the frame portion 821 into left and right sides.

Since the frame part 821 and the upper partition part 822 define an outer frame and support the support plate 81, high strength may be required, and thus, the frame part 821 and the upper partition part 822 may be made of a metal and may have shape in which both ends are bent to increase strength and prevent deformation.

Also, a slide guide 825 may be disposed on each of both sides of the inner side of the frame part 821 to accommodate the end of the scissors lift assembly 84 and guide the movement of the scissors lift assembly 84. The slide guides 825 may be disposed on both sides of the upper partition part 822. Also, the scissors lift assemblies 84 may be disposed in the spaces 823 and 824 on both sides partitioned by the upper partition part 822, respectively.

The slide guide 825 may be separately molded by using a plastic material having excellent abrasion resistance and lubrication performance and mounted on the upper frame 82. Also, a long hole 825*a* through which the sliding shaft 842 of the scissors lift assembly passes may be defined in the slide guide 825, and the sliding shaft 842 may move along the slide guide 825. Also, a sliding surface 825*b* having a predetermined width may be further disposed along the circumference of the lone hole 825*a*, and the sliding shaft 842 may be supported by the sliding surface 825*b* so that the scissors lift assembly 84 is more smoothly folded or unfolded.

The frame part 821 may include vertically curved edges 821*a* and 821*b* along the circumference thereof. The edges 821*a* and 821*b* may be disposed on the inner side and the outer side of the frame part 821, respectively. Also, the slide guide 825 may be disposed on the edge 821*b* inside the frame part 821. Also, edge grooves 821*c* and 821*d* may be defined in the outer edge 821*a* of the frame part 821.

The edge grooves 821*c* and 821*d* may be defined in the edge 821*a* by the grooves into which the rotation shaft 841*a* of the elevation device 80 and the scissors protrusion 841*b* are accommodated while the elevation device 80 completely descends and may include a first edge groove 821*c* and a second edge groove 821*d* corresponding to the rotation shaft 841*a* and the scissors protrusion 841*b* at the end of the first edge groove 821*c*. When the upper frame 82 completely descends to contact the lower frame 83, the upper frame 82 may contact the edge grooves 821*c* and 821*d* defined in the lower frame 83 to provide a complete hole shape so that the rotation shaft 841*a* and the scissors protrusion 841*b* pass therethrough.

The edge grooves 821*c* and 821*d* may be defined in a number corresponding to the rotation shaft 841*a* when the scissors protrusion 841*b* is not provided but only the rotation shaft 841*a* is provided. The edge grooves 821*c* and 821*d* and the rotation shaft 841*a* and the scissors protrusion 841*b* may be disposed adjacent to the left and right ends of the elevation device 80 and may be exposed through the drawer opening 35.

The frame part 821 may define a space of which a bottom surface is opened by the edges 821*a* and 821*b* on both sides. Also, scissors fixing members be provided at both ends of the inner space of the frame part 821. The scissors fixing member may fix the rotation shaft 847 of the scissors lift assembly 84, and a pair of scissors fixing members 826 may be provided at both ends. The scissors fixing member may also be made of an engineering plastic material having abrasion resistance due to continuous friction with the rotating shaft 847. Also, the scissors fixing member may have a through-hole through which the rotation shaft 847 passes.

A plurality of scissors fixing members 826 may be provided on both ends of the frame part 821 to fix both ends of the rotation shaft 847. The scissors fixing member 826 may stably fix the rotation shaft 847 to allow the scissors lift assembly 84 to be smoothly folded and unfolded.

The lower frame 83 may have the same structure as that of the upper frame 85 but only in the direction. The lower frame 83 may include a frame part 831 and a lower partition part 832 to define spaces 833 and 834 in which the scissors lift assemblies 84 are respectively installed.

Also, the slide guide 825 may be provided on the inner frame 821*b* of the frame part 821, and the first frame groove 831*c* and the second frame groove 831*d* may be defined in the outer frame 821*a*. Also, the scissors fixing member 826 may be provided in the inner space of the frame portion 821.

The outer frame 821*a* of the upper frame 82 and the outer frame 821*a* of the lower frame 83 may contact each other when the upper frame 82 completely move downward. Thus, the frame part 821 of the upper frame 82 and the frame part 821 of the lower frame 83 may contact each other to define a closed space therein, and the scissors lift assembly 84 may be accommodated in the closed space in the completely folded state. That is, the elements of the scissors lift assembly 84 may be disposed inside the frame part 821 of the lower frame 82 and the upper frame 82 in the state in which the elevation device 80 descends to the lowest state.

Thus, the additional space for accommodating the scissors lift assembly 84 in addition to the upper frame 82 and the lower frame 83 may not be required so that the loss of storage chamber inside the drawer unit 32 is minimized.

Furthermore, since the support plate 81 also has a structure capable of accommodating the upper frame 82 and/or the lower frame 83, a space for arranging the upper frame 82 and the lower frame 83 may not be additionally required to minimize the space loss.

That is, even if the elevation device 80 having the complicated scissors type is disposed, a space loss equivalent to the thickness of the support plate 81 may be generated to very effectively utilize the interior of the drawer unit 32.

A seating hole 837 may be defined in the bottom surface of the frame part 821 of the lower frame 83. The seating hole 837 may have an opened hole shape and be engaged with a seating protrusion 396 having a projection shape to protrude from the bottom surface of the drawer part 32 when the elevation device 80 is mounted inside the drawer part 32. That is, the elevation device 80 may be fixed to match the inside of the drawer part 32 by a simple operation that is seated inside the drawer part 32 and be maintained in the stable state even though the elevation device 80 operates. Also, the elevation device 80 may be easily lifted and separated from the drawer part 32 without any additional tool even if the elevation device 80 is not disposed in the drawer part 32.

The scissors lift assemblies 84 may be provided on both left and right sides of the scissors lift assembly 84. The scissors lift assemblies 84 may be connected to the connecting assembly 70 and may be independently driven by the power transmitted through the shaft 41 and the lever 42 to lift the upper frame 82. Here, the scissors lift assemblies 84 on both sides may not cause any misalignment or deviation in one of the driving motors 64 and the structure of the driving device 40 including the shaft 41 and the screw assembly 50 so as to provide a structure capable of being elevated by the same height.

Thus, the scissors lift assembly 84 may be effectively elevated by the pair of the scissors lift assemblies 84 which independently apply the forces to both sides even when the heavy load is supported by the scissors lift assembly 84. Here, the upper frame 82, i.e., the support plate 81 may be elevated in a horizontal state through the scissors lift assembly 84.

The scissors lift assembly 84 may include a pair of first rods 841 arranged in parallel to each other, a first sliding shaft 842 connecting both ends of the first rod 841, and a first rotation shaft 847.

Each of the first rod 841, the first sliding shaft 842, and the first rotation shaft 847 may have a width that is enough to be accommodated inside the frame part 821. Also, the first rod 841 may be disposed at a position corresponding to the region of the frame part 821, and the first rotation shaft 847 may also be disposed at an region corresponding to the frame part 821.

Also, the rotation shaft 841*a* and the scissors protrusion 841*b* may be disposed on one end of the first rod 841. Here, the rotation shaft 841*a* may be disposed on the same extension line as the first rotation shaft 847, and the first rotation shaft 847 may rotate when the rotation shaft 841*a* rotates.

The first rotation shaft 843 may further include a rotation enhancing part 843*a*. The rotation enhancing part 843*a* may be configured to connect a portion of the first rod 841 to the entire first rotation shaft 847. Thus, when the first rod 841 rotates, the first rotation shaft 847 may rotate together and also be enhanced to withstand the generated moment.

Also, a mounting hole 342*b* may be defined in each of both ends of the rotation enhancing part 843*a*, and the scissors fixing member 826 may be mounted to pass through the mounting hole 842*b*. Thus, the first rotation shaft 847 may be rotatably mounted on the scissors fixing member 826 of the lower frame 83.

Also, the first sliding shaft 842 may connect the other end of the first rod 841 and may be disposed to pass through the slide guide 825. Thus, the first sliding shaft 842 may move along the slide guide 825 of the upper frame 82 when the first rod 841 rotates.

Also, a pair of second rods 844 may be provided to cross the first rod 841. The first rod 841 and the second rod 844 may be connected to each other by the scissors shaft 845 so that the first rod 841 and the second rod 844 rotate in the state of crossing each other. A second sliding shaft 842 and a second rotating shaft 847 connecting both ends of the second rod 844 may be further provided.

The second rod 844, the second sliding shaft 842, and the second rotation shaft 847 may also have shapes and arrangements that are enough to be accommodated in the frame part 821. In this state, both the second rotation shafts 847 connecting the upper ends of the second rods 844 may be provided.

The second rotation shaft 847 may be rotatably mounted on the scissors fixing member 826 of the upper frame 82. Here, the second rotation shaft 847 passing through the scissors fixing member 826 may further include a rotation bush 847*a*. The rotation bush 847*a* may contact the inner surface of the scissors fixing member 826 and may be made of a plastic material having excellent lubrication performance and abrasion resistance. Thus, the operation of the scissors lift assembly 84 may be smoothly performed.

The lower ends of the second rods 844 disposed on both sides may be connected by the second sliding shaft 842. The second sliding shaft 846 may be mounted to pass through the slide guide 835 provided in the lower frame 83 and may move along the slide guide 835 as the elevation device 80 is elevated.

The upper frame 82 and the lower frame 83 connected by the scissors lift assembly 84 may be provided with the restraining unit 90. The restricting unit 90 may selectively restrict the elevation device 80 to prevent the elevation device 80 from operating. For example, the upper frame 82 and the lower frame 83 are restricted with respect to each other by the restricting unit 90 so as to not become unfolded when the elevation device 80 is separated from the drawer part 32 and lifted up. Thus, it is possible to prevent a safety accident from occurring by the elevation device 80 maintaining the restrained state, thereby facilitating the separation and transportation of the elevation device 80.

The upper frame 82 and the lower frame 83 may be provided at a central portion of the upper frame 82 and a central portion of the lower frame 83 so that the upper frame 82 and the lower frame 83 are stably maintained in the restrained state.

In detail, an upper locker 91 of the restricting unit 90 may be mounted on the upper partition part 822 which extends across the center of the upper frame 82. The upper locker 91 may be firmly fixed to an internal space of the upper partition part 822 bent downward to be opened downward and may protrude downward from a center of the upper partition part 822.

Also, a lower locker 92 and a locker case 93 of the restricting unit 90 may be mounted on a lower partition part 832 crossing the center of the lower frame 83. The lower locker 92 may be firmly fixed to the internal space of the lower partition part 832 bent to be opened upward and may protrude upward from the center of the lower partition part 832, i.e., a position corresponding to the upper locker 91.

Also, the upper locker 91 and the lower locker 92 may be hooked to be restricted with respect to each other to restrain the elevation device 80 so as not to be unfolded when the upper frame 82 is disposed closest to the lower frame 83.

The restricting unit 90 may be disposed on both sides of the elevation device 80. Here, the protrusion 397 may be disposed at a position corresponding to the restricting unit 90. The restricting unit 90 may be provided in a plurality of parts, and the protrusion 397 may be provided in number at a position corresponding to the restricting unit 90.

Hereinafter, the restricting unit will be described in detail with reference to the accompanying drawings.

Figure 18:
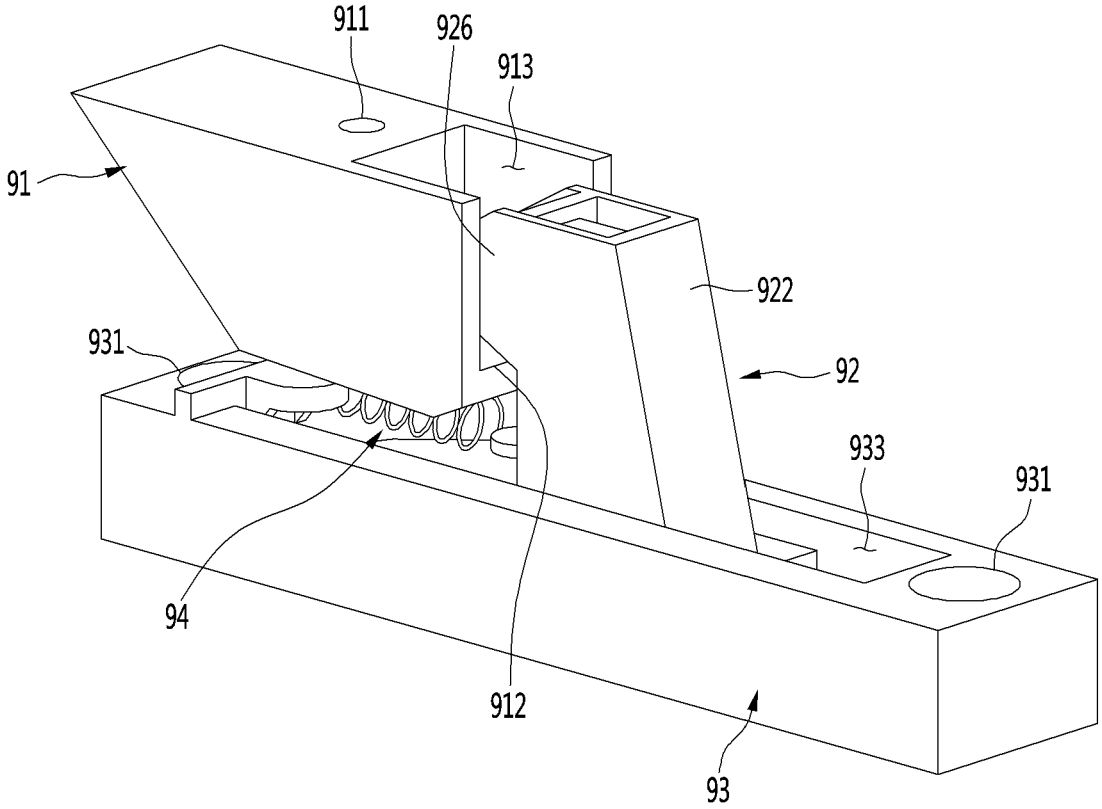
FIG. 18 is a perspective view of the restricting unit according to an implementation.
Figure 19:
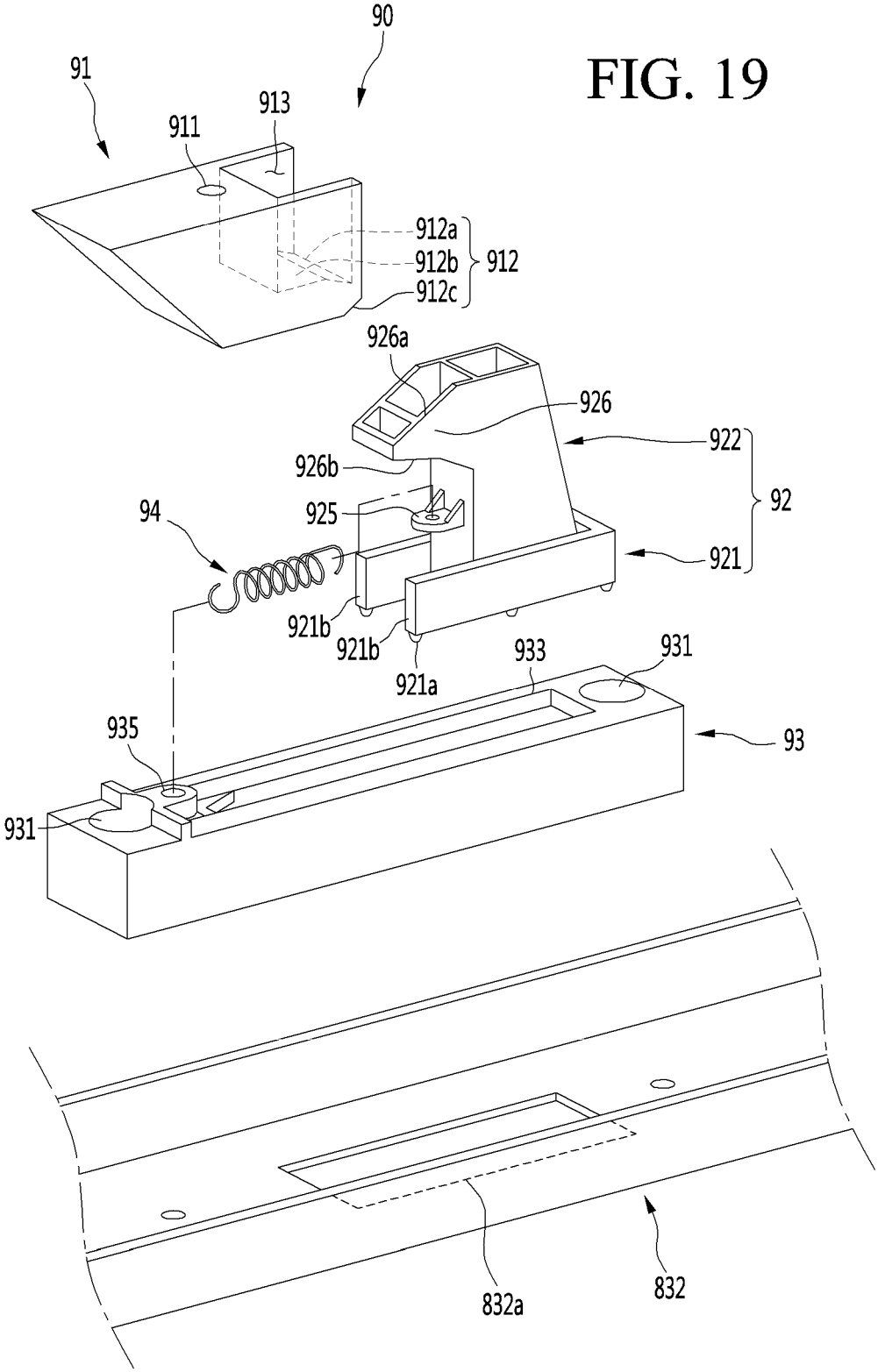
FIG. 19 is an exploded perspective view illustrating a coupling structure of the restricting unit when viewed from the upper side.
Figure 20:
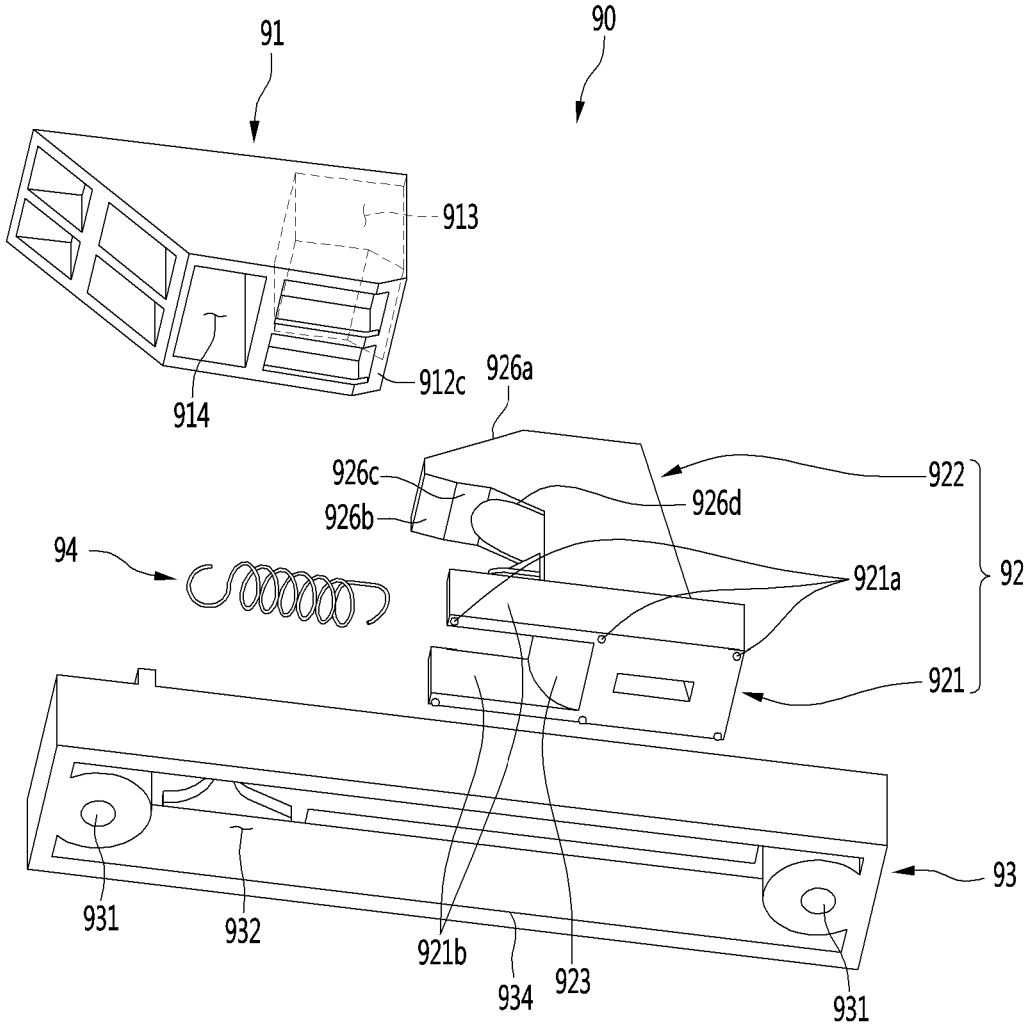
FIG. 20 is an exploded perspective view illustrating the coupling structure of the restricting unit when viewed from a lower side.

FIG. 18 is a perspective view of the restricting unit according to an implementation. Also, FIG. 19 is an exploded perspective view illustrating a coupling structure of the restricting unit when viewed from the upper side. Also, FIG. 20 is an exploded perspective view illustrating the coupling structure of the restricting unit when viewed from a lower side.

Hereinafter, the restriction state of the restricting unit 90 may be a state in which the upper locker 91 and the lower locker 92 are coupled to each other to restrict the upper frame 82 and the lower frame 83 so as not to be unfolded. The restriction release state may be a state in which the upper locker 91 and the lower locker 92 are separated from each other to allow the upper frame 82 and the lower frame 83 to be elevated while being unfolded or folded.

As illustrated in the drawings, the restricting unit 90 may include an upper locker 91, a lower locker 92, and a locker case 93. The upper locker 91 may be fixedly mounted on the upper frame 82, and the lower locker 92 and the locker case 93 may be mounted on the lower frame 83. Also, the upper frame 82 and the lower frame 83 may be selectively restricted with respect to each other by the selective coupling of the upper locker 91 and the lower locker 92.

In detail, the upper locker 91 may have a width corresponding to the upper partition part 822 and be inserted into a space defined by the upper partition part 822. A top surface of the upper locker 91 may have a planar shape and may contact a bottom surface of the upper partition part 822. Also, the upper locker 91 may extend further downward than the lower restricting part 926 of the lower locker 92 so that the upper locker 91 is maintained in a state of being restricted with the lower locker 92.

Also, the upper locker 91 may have an upper hole 911 vertically passing through the upper locker 91, and the upper locker 91 may be fixedly mounted on the upper partition part 822 by a screw S which is coupled below the upper locker 91.

Also, an opening 914 communicating with the upper hole 911 may be defined in the bottom surface of the upper locker 91, and the screw S may be inserted through the opening 914 and be coupled to the upper hole 911. An inner surface of the upper locker 91 may have a shape of a plurality of mutually intersecting ribs so as to maintain the shape without being deformed.

The upper restricting part 912 and the upper accommodation part 913 may disposed on a rear surface of the upper locker 91, i.e., in a direction that faces the lower locker 92.

The upper restricting part 912 may be hooked to be restricted with the lower restricting part 926 so that the restricting unit 90 is restricted. Also, the upper restricting part 912 may extend from a lower end of the upper locker 91 to a front end of the upper locker 91. Also, the upper restricting part 912 may be defined below the upper accommodation part 913 to define a bottom surface of a space defined below the upper accommodation part 913.

A first inclined surface 912*a* may be disposed on the top surface of the upper restricting part 912. Also, a second inclined surface 912*c* may be disposed on the lower front end of the upper restricting part 912. Also, a first extension surface 912*b* extending to a front end of the upper accommodation part 913 may be disposed on a front end of the first inclined surface 912*a*.

The first inclined surface 912*a* may be a portion at which the contact with the lower locker 92 starts when the restricting unit 90 moves so as to be in the restrained state and may be inclined upward toward the front side. Thus, as the lower locker 92 moves forward, the front end of the lower locker 92 may move along the first inclined surface 912*a* to enter into the inside of the upper accommodation part 913.

The first extension surface 912*b* may be disposed on a front end of the first inclined surface 912*a* to extend forward and then to contact an end of the lower locker 92 inserted into the upper accommodation part 913 so as to be hooked to be restricted. The first extension surface 912*b* may extend forward from the front end of at least the lower restricting part 926 and may define a space of the upper accommodation part 913 into which the lower locker 92 is inserted.

The second inclined surface 912*c* may contact the top surface of the lower locker 92 to push the lower locker 92 so as to move backward when the upper frame 82 moves downward. As a result, the restricting unit 90 may be changed from the restriction release state to the restriction state.

That is, when the upper frame 82 moves downward in the state in which the restricting unit 90 is released due to an abnormal operation or user's intention, the second inclined surface 912*c* and the top surface of the lower lockers 92 may contact each other to allow the lower locker 92 to move backward, and thus, the restricting unit 90 may be restricted again.

The upper accommodation part 913 may define a recessed space above the upper restricting part 912 and may be opened backward and upward so that the front end of the lower restricting part 926 is inserted. Also, the bottom surface of the upper accommodation part 913 may be defined by the first inclined surface 912*a* and the first extension surface 912*b*.

The lower locker 92 may be mounted on the locker case 93, and also, the locker case 93 may guide the movement of the lower locker 92 and be fixedly mounted on the lower partition part 832. The locker case 93 may have a width that is enough to be accommodated in the inside of the lower partition part 832, and the lower locker 92 may move forward and backward to be hooked and restricted with the upper locker 91. Therefore, the locker case 93 may extend up to one side of the rear side of the upper locker 91 vertically below the upper locker 91.

In detail, a screw hole 931 for fixedly mounting the locker case 93 may be defined in front and rear ends of the locker case 93. The screw S inserted from an upper side of the screw hole 931 may pass through the locker case 93 and may be coupled to the lower partition part 832 to fix the locker case 93.

The locker case 93 may have a top surface opening 933 and a bottom surface opening 934 in the top and bottom surfaces thereof, respectively. Also, a sliding space 932 may be defined below the lower locker 92, i.e., the slide part 921. The top surface opening 933 may communicate with the sliding space 932 at an upper side, and the lower opening 934 may communicate with the sliding space 932 at a lower side. Thus, the lower locker 92 may reciprocally move along the sliding space 932 while being slid forward and backward.

Also, the locker case 93 may be disposed at a position corresponding to a partition part opening 832*a* of the bottom surface of the lower partition part 832. That is, the partition part opening 832*a* may be defined inside the sliding space 932 when the locker case 93 is installed.

The partition part opening 832*a* may defined in a position corresponding to the position of the protrusion 397 on the bottom surface of the drawer part 32 and may correspond to or slightly larger than the size of the protrusion 397. Thus, the protrusion 397 may be positioned inside the sliding space 932 through the partition part opening 832*a* while the elevation device 80 is mounted on the drawer part 32.

The bottom surface opening 934 may have a size greater than that of each of the top surface opening 933 and the partition part opening 832*a*. The protrusion 397 and the lower locker 92 may contact with each other to guide the backward and forward movement of the lower locker 92 while being accommodated in the sliding space 932.

The length of the top surface opening 933 and the bottom surface opening 934 may be designed in consideration of a stroke of the lower locker 92. The top surface opening 933 and the bottom surface opening 934 may provide the stroke by which he front end of the lower restricting part 926 of at least the lower locker 92 move from a position at which the front end is completely accommodated in the upper restricting part 912 and is hooked to be restrained to a position at which the front end is completely separated from the upper restricting part 912.

Also, a case fixing part 935 for fixing one end of the elastic member 94 may be disposed on the front end of the top surface opening 933. The elastic member 94 may provide elastic force for allowing the lower locker 92 to move and may have a coil spring shape. Also, the other end of the elastic member 94 may be fixed to the lower locker 92.

The elastic member 94 may completely move forward to be disposed at the most forward position, i.e., a state in which the lower locker 92 is hooked to be restricted with the upper locker 91 so as to be in state in which the restricting unit 90 is initially restricted. Thus, the elastic member 94 may provide the elastic force so that when the restricting unit 90 moves backward to be in a state in which the restriction of the restricting unit 90 is released, the elastic member 94 is extended, and when external force is removed, the lower locker 92 moves forward up to the initial position.

The lower locker 92 may include a slide part 921 accommodated in the locker case 93 as a whole and a locking part 922 protruding upward from the locker case 93 to be hooked and restricted with the upper locker 91.

The slide part 921 may have a shape corresponding to the size of the sliding space 932 and be disposed to be movable backward and forward while being accommodated in the sliding space 932. The slide part 921 may have a width less than that of the bottom surface opening 934 and greater than that of the top surface opening 933. The slide part 921 may move forward and backward while being accommodated in the locker case 93 in a state in which the locker case 93 is mounted on the lower partition part 832.

A plurality of support protrusions 921*a* may be disposed on a bottom surface of the slide part 921. The plurality of support protrusions 921*a* may be disposed on both side ends of the bottom surface of the slide part 921 to protrude downward to contact the lower partition part 832. The lower locker 92 may be supported on the top surface of the lower partition part 832 by the support protrusions 921*a*. Thus, the slide part 921 may slidably move in a point contact state with the lower partition part 832.

Also, a side extension parts 921*b* extending forward may be disposed on each of both sides of the slide part 921, and a contact part 923 may be disposed between the side extension parts 921*b*. The contact part 923 may contact the protrusion 397 to allow the lower locker 92 to move backward. The contact part 923 may be disposed at a position corresponding to the protrusion 397 when the elevation device 80 is mounted.

The contact part 923 may be inclined upward toward the front side and may be rounded. Thus, the contact part 923 may start to contact the protrusion 397 when the elevation device 80 is mounted. As a result, the lower locker 92 may move backward by the corresponding inclinations or rounded shapes of the contact part 923 and the protrusion 397.

The locking part 922 may vertically extend upward from the slide part 921 and extend up to a height at which the locking part 922 is hooked to be restricted with the upper locker 91. Here, the front surface of the locking part 922 may extend perpendicularly to the slide part 921. Also, a locker fixing part 925 may be disposed on a front surface of the locking part 922 to fix one end of the elastic member 94.

The locker fixing part 925 may be disposed behind the case fixing part 935, and the elastic member 94 may be disposed between the case fixing part 935 and the locker fixing part 925. Thus, the elastic member 94 may be stretched or contracted by the movement of the lower locker 92 forward and backward and may provide elastic force to return to the initial position when the lower locker 92 moves backward.

A lower restricting part 926 protruding forward may be disposed on an upper end of the locking part 922. The lower restricting part 926 may be hooked to be restricted with the upper locker 91 and may protrude by a length that is enough to be inserted completely into the upper accommodation part 913 of the upper locker 91. Also, the lower locker 92 may have a width less than that of the upper accommodation part 913 so as to be able to enter and exit the inside of the upper locker 91.

A third inclined surface 926*a* and a fourth inclined surface 926*b* may be disposed on the top surface and the bottom surface of the lower restricting part 926.

The third inclined surface 926*a* may be disposed on a top surface of the lower restricting part 926 and may extend from a front end to a rear end of the lower restricting part 926. The third inclined surface 926*a* may have an inclination that protrudes upward toward the rear side. Also, the third inclined surface 926*a* may have an inclination corresponding to the second inclined surface 912*c* of the upper restricting part 912. When the upper restricting part 912 moves downward while the restriction of the restricting unit 90 is released, the second inclined surface 912*c* may contact the third inclined surface 926*a* to guide the backward movement of the lower locker 92.

The fourth inclined surface 926*b* may be disposed on a bottom surface of the lower restricting part 926 and may extend backward from a front end of the lower restricting part 926. Also, the fourth inclined surface 926*b* may be inclined downward toward the rear side. Also, the fourth inclined surface 926*b* may have an inclination corresponding to the first inclined surface 912*a*. Thus, the fourth inclined surface 926*b* may contact the first inclined surface 912*a* to guide the forward movement of the lower locker 92 when the lower locker 92 moves forward.

The fourth inclined surface 926*b* may start to contact the lower locker 92 in the initial restriction of the upper locker 91 so as to guide the movement of the lower locker 92. Also, the fourth inclined surface may be disposed on a portion of an area of the first portion of the entire bottom surface of the lower restricting part 926. The fourth inclined surface 926*b* may have a length corresponding to the length of the first inclined surface 912*a*.

Also, a second extension surface 926*c* may be disposed on a rear end of the fourth inclined surface 926*b*, and a fifth inclined surface 926*d* may be disposed on a rear end of the second extension surface 926*c*. The second extension surface 926*c* may be disposed parallel to the first extension surface 912*b*, and the fifth inclined surface 926*d* may have the same inclination as the fourth inclined surface 926*b*.

Thus, the first extension surface 912*b* and the second extension surface 926*c* may contact each other when the lower locker 92 is completely inserted into the upper accommodation part 913 so that the restricting unit 90 is in the restriction state. Here, the first inclined surface 912*a* and the fifth inclined surface 926*d* may contact each other to be closely attached to each other. Thus, the upper locker 91 and the lower locker 92 may be completely restricted with respect to each other, and thus, the effective restriction state may be maintained.

Hereinafter, the selective coupling and power connection of the elevation device 80 and the connecting assembly 70 will be described in more detail with reference to the drawings.

Figure 21:
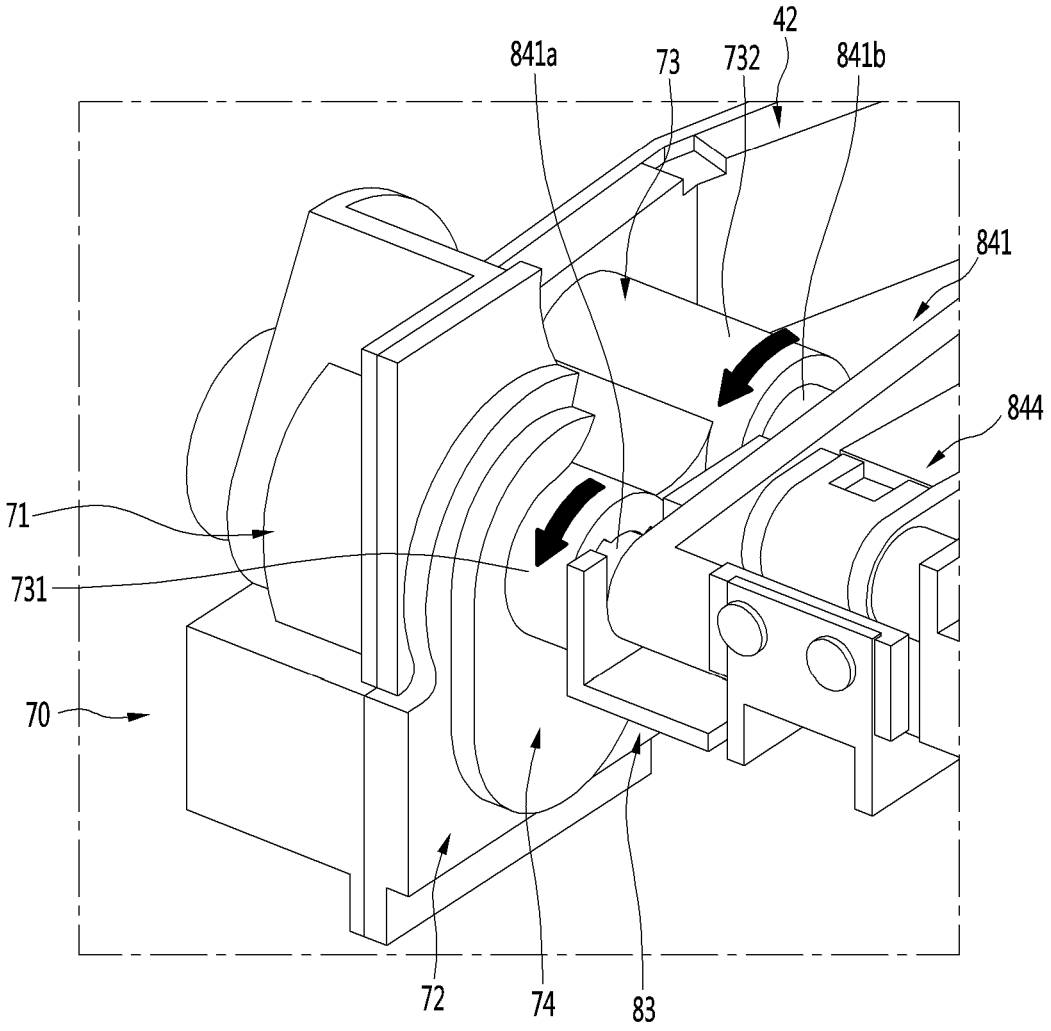
FIG. 21 is a perspective view illustrating a connection state between the connecting assembly and the elevation device.
Figure 22:
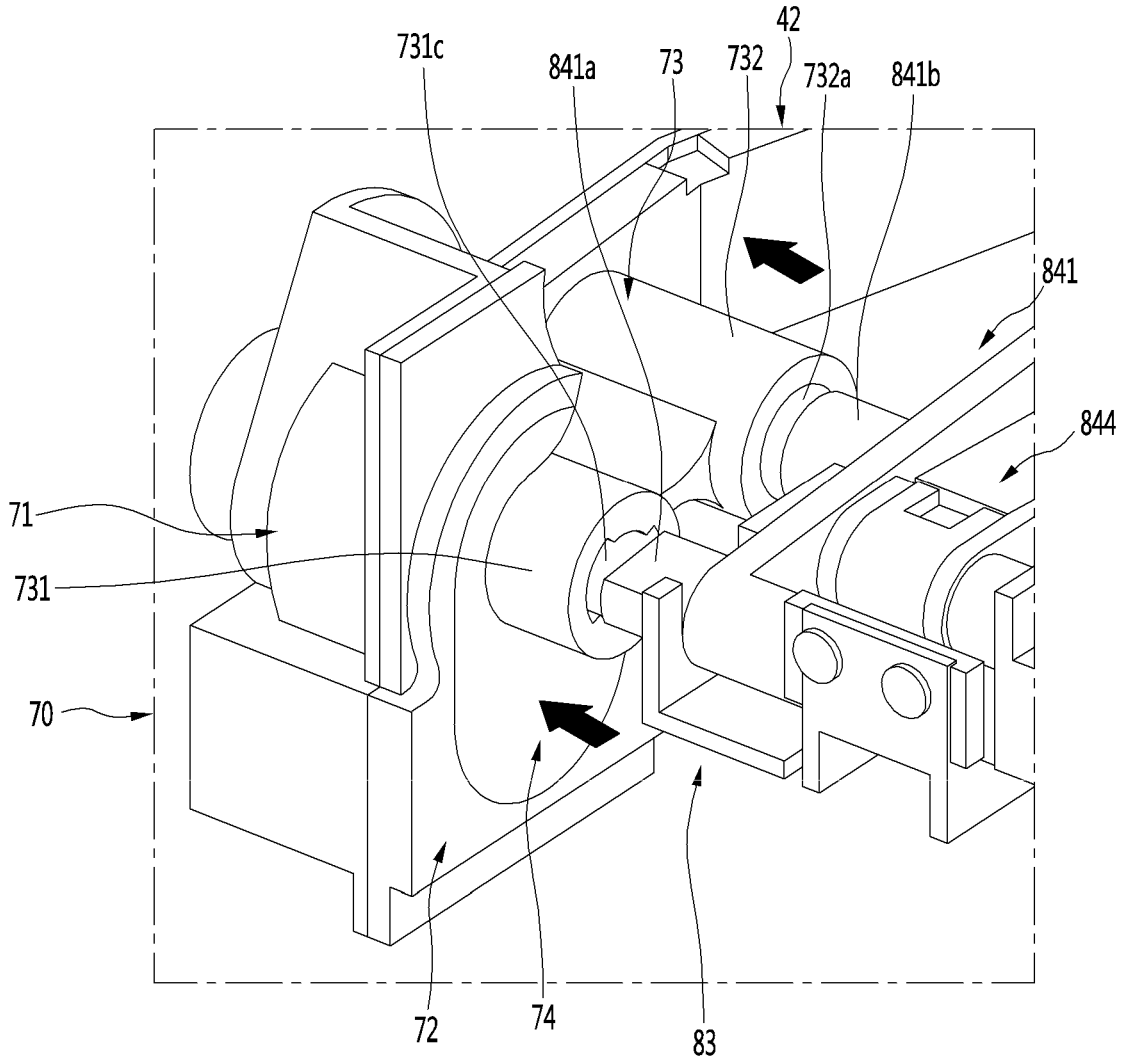
FIG. 22 is a perspective view illustrating a separation state of the connecting assembly and the elevation device.

FIG. 21 is a perspective view illustrating a connection state between the connecting assembly and the elevation device. Also, FIG. 22 is a perspective view illustrating a separation state of the connecting assembly and the elevation device.

As illustrated in the drawings, if the service of the driving device 40 or the elevation device 80 is necessary or if the use of the elevation device 80 is not desired, the driving device 40 and the elevation device 80 may be simply separated from and coupled to each other.

As illustrated in FIG. 21, the door part 31 and the drawer part 32 may be coupled to each other, and power transmission may be possible in the state in which the connecting assembly 70 and the elevation device 80 are connected to each other. Here, the connection member 73 may be connected to the lever 42 and the elevation device 80, and the first connection part 731 may be connected to the fixing shaft 77 and the rotation shaft 841*a* of the elevation device 80. The lever protrusion 425 and the scissors protrusion 841*b* may be inserted into the second connection part 732.

In this state, when the lever 42 rotates by the operation of the driving device 40, the rotation shaft 841*a* of the elevation device 80 may rotate by the first connection part 731, and the scissors lift assembly 84 of the elevation device 80 may rotate.

Here, since the second connecting part 732 is connected to the scissors protrusion 841*b* of the elevation device 80, greater force may be transmitted to the elevation device 80. In detail, the second connection part 732 may be disposed at a position away from the first connection part 731, and thus when the first connection part 731 rotates around the shaft, a moment similar to a leverage may be applied to the second connection part 732. Thus, a moment greater than the moment generated at the first connection part 731 may be applied together with the second connection part 732, and thus the elevation device 80 may rotate with larger force.

Furthermore, since the pair of scissors lift assemblies 84 are disposed on both sides of the scissors lift assembly 84, the power may be transmitted to the scissors lift assembly 84, thereby effectively elevating the elevation device 80 with less force.

The connection member 73 may have a single shaft structure that connects the lever 42 to the rotation shaft 841*a* of the elevation device 80 when the torque by the driving device 40 is sufficient. The scissors lift assembly 84 may also be configured so that the connection member 73 is connected to each of both sides of one of the scissors lift assemblies 84 to elevate the elevation device 80.

The user may push the push member 74 of the connecting assembly 70 to push the connection member 73 as illustrated in FIG. 21 in the state in which the service condition of the driving device or the elevation device 80 of the refrigerator 1 occurs. The coupling between the connection member 73 and the elevation device 80 may be released by allowing the connection member 73 to move forward.

In this state, the door part 31 may be separated from the drawer part 32, and the entire driving part 40 provided in the door part 31 may be completely separated from the drawer part 32 by a single operation.

The driving part 40 may be maintained in the state in which the door part 31 is separated, and the door part 31, which normally operates as necessary, may be replaced to be mounted. Here, the connection member 73 of the door part 31 may be coupled to the rotation shaft 841*a* and the scissors protrusion 841*b* of the elevation device without separate assembly and disassembly.

The door part 31 and the drawer part 32 may be rigidly coupled to each other by the door frame or other structure, and the door part 31 and the drawer part 32 may be additionally separated from or coupled to each other when the door part 31 and the drawer part 32 are separated from or coupled to each other.

Hereinafter, a state in which the door 30 of the refrigerator 1 is inserted and withdrawn and is elevated according to an implementation will be described in more detail with reference to the accompanying drawings.

Figure 23:
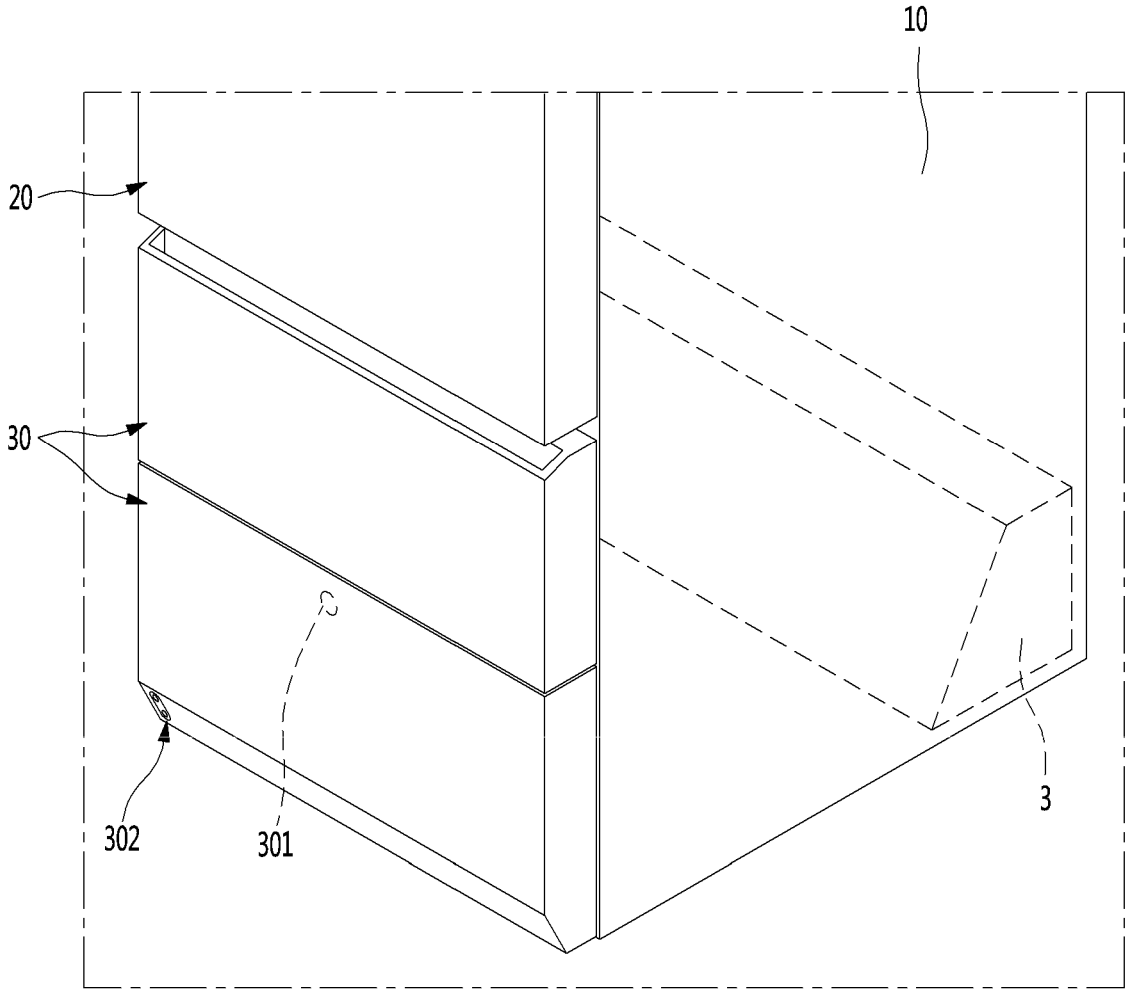
FIG. 23 is a perspective view illustrating a state in which the drawer door is closed.

FIG. 23 is a perspective view illustrating a state in which the drawer door is closed.

As illustrated in the drawing, in the state in which the food is stored, the refrigerator 1 may be maintained in a state in which all of the rotation door 20 and the door 30 are closed. In this state, the user may withdraw the door 30 to accommodate the food.

The door 30 may be provided in plurality in a vertical direction and be withdrawn to be opened by the user's manipulation. Here, the user's manipulation may be performed by touching the manipulation part 301 disposed on the front surface of the rotation door 20 or the door 30. Alternatively, an opening command may be inputted on the manipulation device 302 provided on the lower end of the door 30. Also, the manipulation part 301 and the manipulation device 302 may individually manipulate the insertion and withdrawal of the door 30 and the elevation of the elevation member 80. Alternatively, the user may hold a handle of the door 30 to open the drawer door 30.

Hereinafter, although the lowermost door 30 of the doors 30, which are disposed in the vertical direction, is opened and elevated as an example, all of the upper and lower doors 30 may be inserted and withdrawn and elevated in the same manner.

Figure 24:
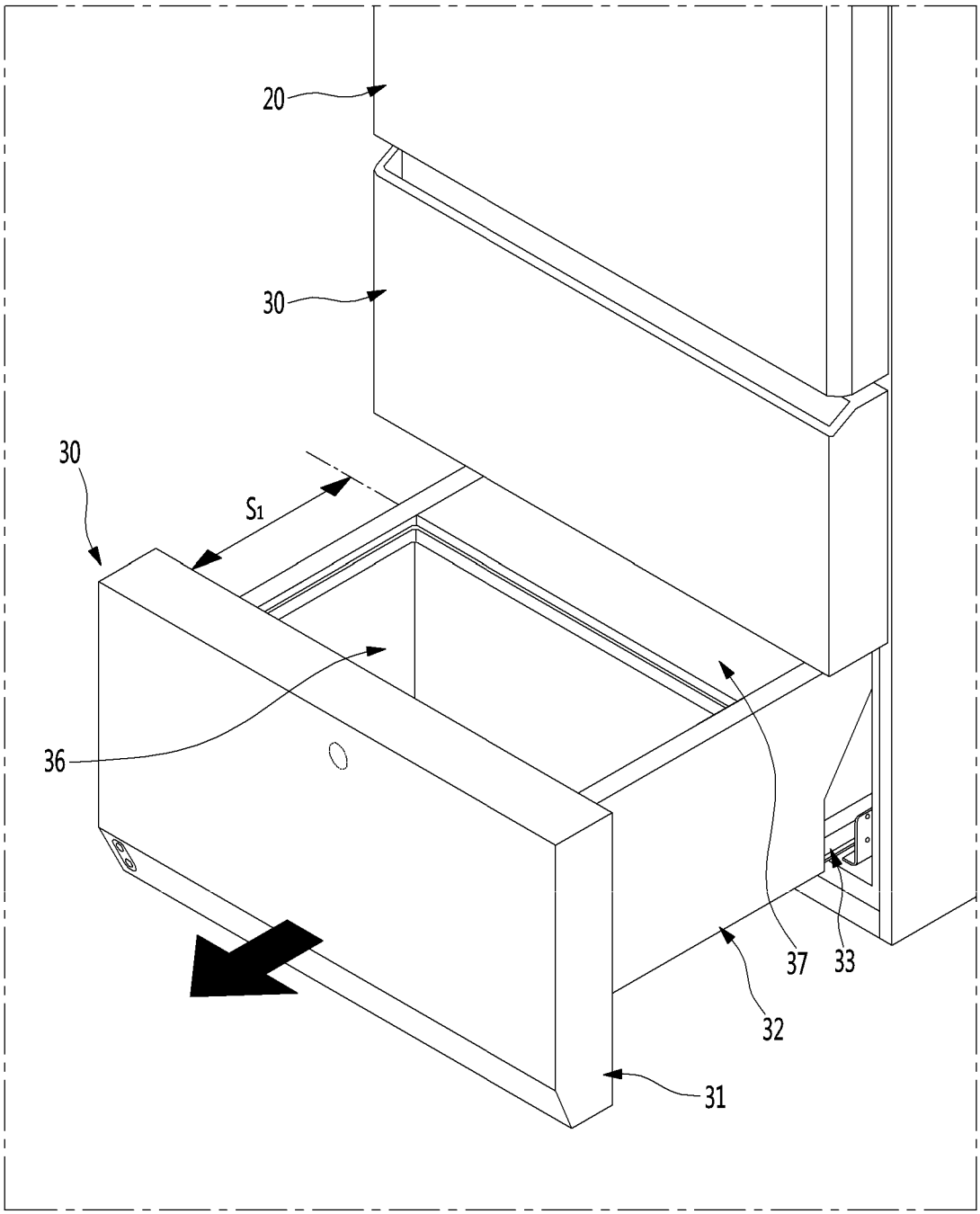
FIG. 24 is a perspective view illustrating a state in which the drawer door is completely opened.
Figure 25:
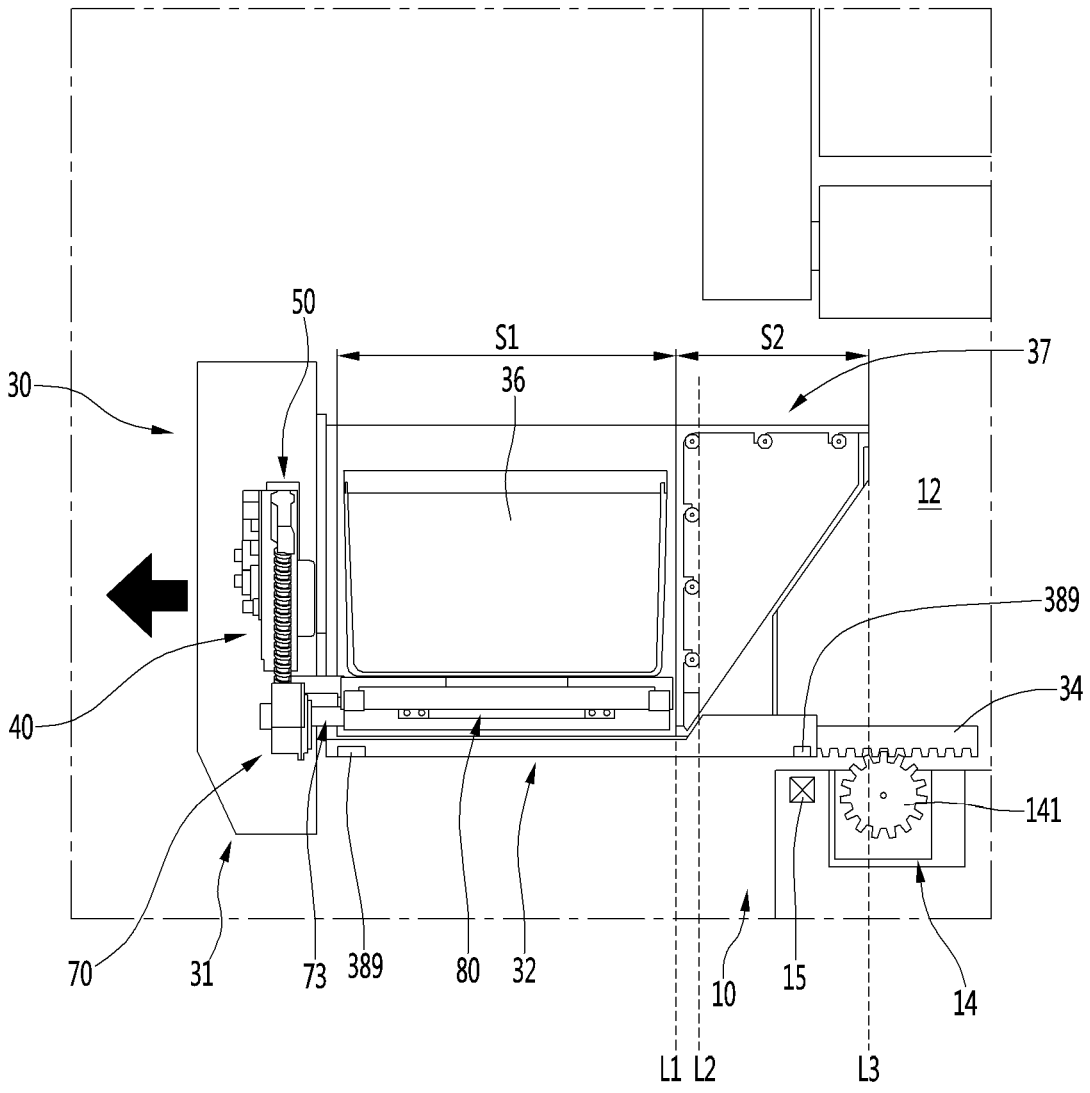
FIG. 25 is a cross-sectional view illustrating a state of the drawer door in a state in which the basket of the drawer door completely descends.

FIG. 24 is a perspective view illustrating a state in which the drawer door is completely opened. Also, FIG. 25 is a cross-sectional view illustrating a state of the drawer door in a state in which the basket of the drawer door completely descends.

As illustrated in the drawings, the user may manipulate the draw-out operation on the door 30 to withdraw the door 30 forward. The door 30 may be withdrawn while the draw-out rail 33 extends.

The door 30 may be configured to be inserted and withdrawn by the driving of the draw-out motor 14, not by a method of directly pulling the door 30 by the user. The draw-out rack 34 provided on the bottom surface of the door 30 may be coupled to the pinion gear 141 rotating when the draw-out motor 14 provided in the cabinet 10 is driven. Thus, the door 30 may be inserted and withdrawn according to the driving of the draw-out motor 14.

The draw-out distance of the door 30 may correspond to a distance at which the front space S1 within the drawer part 32 is completely exposed to the outside. Thus, in this state, when the elevation device 80 is elevated, the container or the food may not interfere with the doors 20 and 30 or the cabinet 10 disposed above it.

Here, draw-out distance of the door 30 may be determined by a draw-out detection device 15 disposed on the cabinet 10 and/or the door 30. The draw-out detection device 15 may be provided as a detection sensor that detects a magnet 389 to detect a state in which the door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the door 30 is closed and a position of the magnet 389 when the door 30 is completely withdrawn. Thus, the drawn-out state of the door 30 may be determined by the draw-out detection device 15.

Also, in some cases, a switch may be provided at each of positions at which the door 30 is completely inserted and withdrawn detect the drawn-out state of the door 30. In addition, the drawn-out state of the door 30 may be detected by counting the rotation number of draw-out motor 14 or measuring a distance between the rear surface of the door part 31 and the front end of the cabinet 10.

In the state in which the door 30 is completely withdrawn, the elevation motor 64 may be driven to elevate the elevation device 80. The elevation device 80 may be driven in an even situation in which the door 30 is sufficiently withdrawn to secure safe elevation of the food or container 36 seated on the elevation device 80.

That is, in the state in which the door 30 is withdrawn to completely expose the front space S1 to the outside, the elevation device 80 may ascend to prevent the container 36 or the stored food seated on the elevation device 80 from interfering with the doors 20 and 30 or the cabinet 10.

Referring to the drawn-out state of the door 30, the front space S1 is to be completely withdrawn to the outside of the lower storage chamber 12 in the state in which the door 30 is withdrawn for the elevation.

Particularly, the rear end L1 of the front space S1 is to be more withdrawn than the front end L2 of the cabinet 10 or the upper door 20. Also, the rear end L1 of the front space S1 is disposed at a further front side than the front end L2 of the cabinet 10 or the door 20 so at to prevent the elevation device 80 from interfering when the elevation device 80 is elevated.

Figure 31:
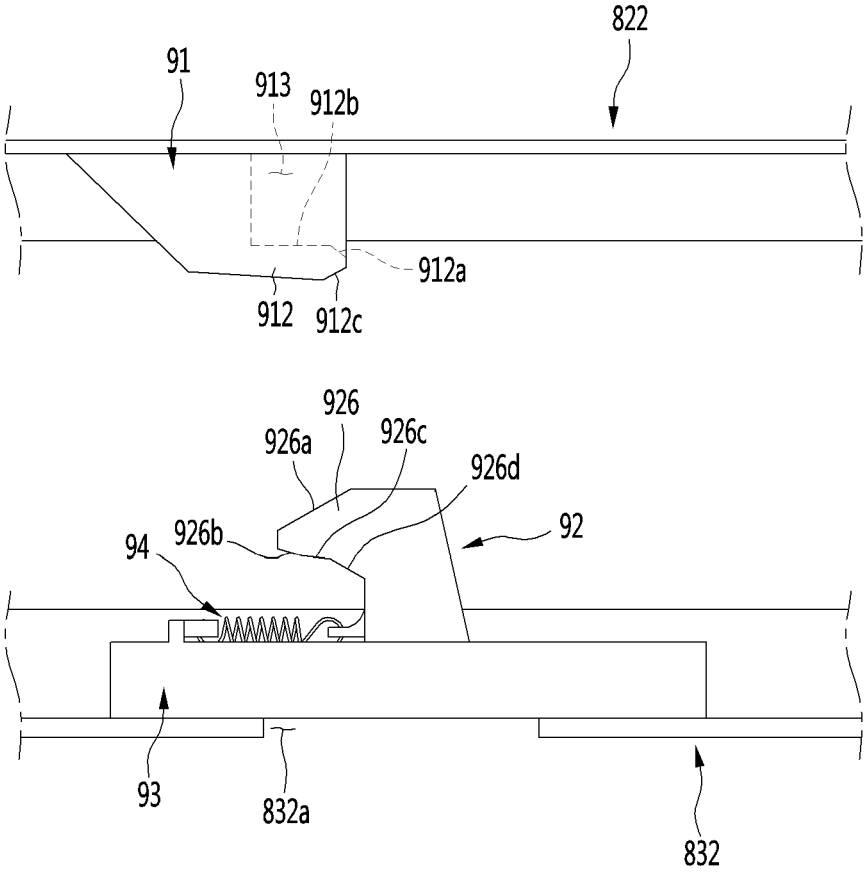
FIGS. 31 to 34 are views sequentially illustrating a process in which the restricting unit is changed from the restriction state to the restriction release state.

Also, when the elevation device 80 is completely withdrawn to be driven, the entire drawer part 32 may not be completely withdrawn but withdrawn up to only a position for avoiding interference when the elevation device 80 is elevated as illustrated in FIG. 31. Here, at least a portion of the rear space S2 of the drawer part 32 may be disposed inside the lower storage chamber 12. That is, the rear end L3 of the drawer part 32 may be disposed at least inside the lower storage chamber 12.

Thus, even when the weight of the stored object is added to the weight of the door 30 itself including the driving device 40 and the elevation device 80, the deflection or damage of the draw-out rail 33 or the door 30 itself may not occur to secure the reliable draw-out operation.

The ascending of the elevation device 80 may start in a state in which the door 30 is completely withdrawn. Also, to secure the user's safety and prevent the food from being damaged, the ascending of the elevation device 80 may start after a set time elapses after the door 30 is completely withdrawn.

After the door 30 is completely withdrawn, the user may manipulate the manipulation part 301 to input the ascending of the elevation device 80. That is, the manipulation part 301 may be manipulated to withdraw the door 30, and the manipulation part 301 may be manipulated again to elevate the elevation device 80.

Also, in the state in which the door 30 is manually inserted and withdrawn, the manipulation part 301 may be manipulated to elevate the elevation device 80.

As illustrated in FIG. 25, the driving device 40 and the elevation device 80 may not operate until the door 30 is completely withdrawn, and the elevation device 80 may be maintained in the lowest state.

Figure 26:
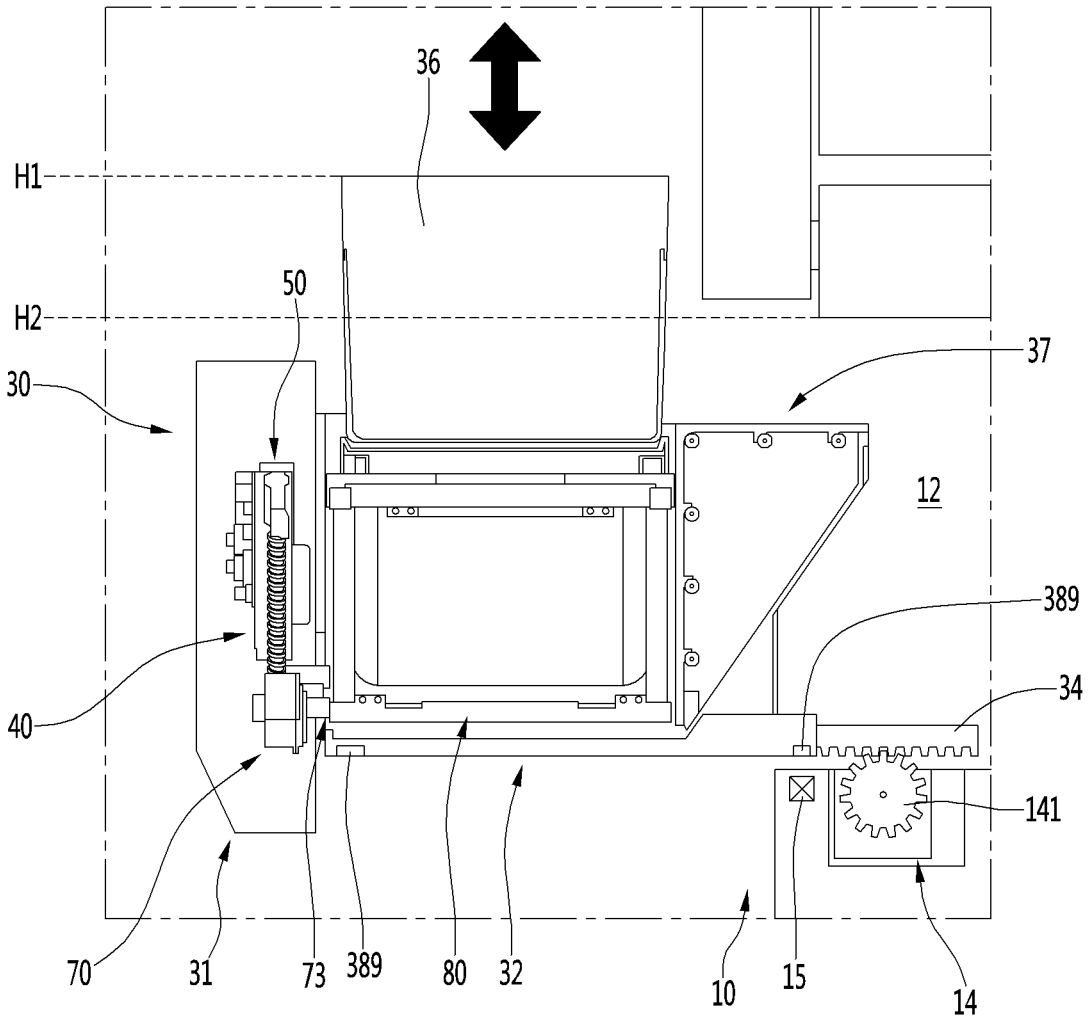
FIG. 26 is a cross-sectional view illustrating a state of the drawer door in a state in which the basket of the drawer door completely ascends.

FIG. 26 is a cross-sectional view illustrating a state of the drawer door in a state in which the basket of the drawer door completely ascends.

As illustrated in FIG. 25, in the state in which the door 30 is withdrawn, when the operation signal of the driving device is inputted, the driving device 40 may operate, and the state as illustrated in FIG. 26 may be obtained by elevating the elevation device 80.

The driving device 40 may be connected to the elevation device 80 by the connecting assembly 70 so that the power is transmitted to the elevation device 80. The power may be transmitted to the elevation device 80 by the connecting assembly 70 together with the operation of the driving device 40, and the elevation device 80 may start to ascend.

The elevation device 80 may continuously ascend and then be stopped when ascend to a sufficient height to facilitate access to the food or container 36 seated on the elevation device 80 as illustrated in FIG. 26. In this state, the user may easily lift the food or container 36 without overtaxing the waist.

When the elevation completion signal of the elevation device 80 is inputted, the driving of the driving motor 64 may be stopped. For this, a height detection device 16 capable of detecting the position of the elevation device 80 may be provided. The height detection device 16 may be provided on the door part 31 and may be disposed at a position corresponding to the maximum height of the elevation device 80 and at a position corresponding to the lowest height of the elevation device 80.

The height detection device 16 may be provided as a detection sensor that detects a magnet 389. The height detection device 16 may detect the magnet 389 disposed on the elevation device 80 to determine whether the ascending of the elevation device 80 is completed. Also, the height detection device 16 may be provided as a switch structure to turn on the switch when the elevation device 80 maximally ascends. Also, the height detection device 16 may be provided on the elevation rail 44 or the screw 52 to detect the maximally ascending position of the elevation member 80. Also, whether the elevation device 80 maximally ascends may be determined according to a variation in load applied to the elevation motor 64.

The driving of the elevation motor 64 is stopped in the state in which the elevation device 80 maximally ascends. In this state, although the elevation device 80 is disposed inside the drawer part 32, the food or container 36 seated on the elevation device 80 may be disposed at a position higher than the opened top surface of the drawer part 32. Thus, the user may easily access the food or container 36. Particularly, it is not necessary to excessively bend at the waist for lifting the container 36, thus resulting in safer and more convenient operation.

In the maximally ascended state of the elevation device 80, the elevation device 80 may be elevated by driving the driving device 40 and be disposed at least at a lower position than the upper end of the drawer part 32.

In the driving device 80, when viewed with respect to the container 36 in the state in which the container 36 is seated, the upper end H1 of the container 36 may ascend to a position higher than the upper end H2 of the lower storage chamber 12. Here, the height of the container 36 may reach a height suitable for the user to reach the container 36 without stretching his/her waist.

That is, the driving device 40 may have a structure in which the container 36 ascends from the inside of the drawer part 32. However, when the container 36 is mounted on the elevation device 80, the container 36 may be disposed at an accessible height.

After the user's food storing operation is completed, the user may allow the elevation device 80 to descend by manipulating the manipulation part 301. The descending of the elevation device 80 may be performed by reverse rotation of the elevation motor 64 and may be gradually performed through the reverse procedure with respect to the above-described procedure.

Also, when the descending of the elevation device 80 is completed, i.e., in the state of FIG. 25, the completion of the descending of the elevation device 80 may be performed by the height detection device 16. The height detection device 16 may be further provided at a position that detects the magnet disposed on the elevation device 80 when the elevation device 80 is disposed at the lowermost descending position. Thus, when the completion of the descending of the elevation device 80 is detected, the driving of the driving motor 40 is stopped.

Also, after the driving of the elevation motor 64 is stopped, the door 30 may be inserted. Here, the door 30 may be closed by the user's manipulation or by the driving of the draw-out motor 14. When the door 30 is completely closed, a state of FIG. 23 may become.

Hereinafter, a state in which the elevation device of the drawer door is separated will be described with reference to the accompanying drawings.

FIG. 27 is a perspective view illustrating a state in which the elevation device is mounted on the drawer door. Also, FIG. 28 is a cutaway perspective view illustrating a state of the restricting unit in a state in which the elevation device is mounted.

As illustrated in the drawings, when the user desires to use the elevation function, the elevation device 80 may be maintained in the state in which the elevation device 80 is mounted inside the drawer part 32.

When the elevation device 80 is seated in the drawer part 32, the elevation device 80 and the support plate 81 of the elevation device 80 may cover the front space S1 Also, a container 36 such as a basket may be seated on the top surface of the support plate 81. In this state, the elevation device 80 may be elevated when the driving device 40 operates. The ventilation hole 385 and the drawer opening 35 in the front surface of the inside of the drawer part 32 may be completely covered when the elevation device 80 is mounted.

Figure 28:
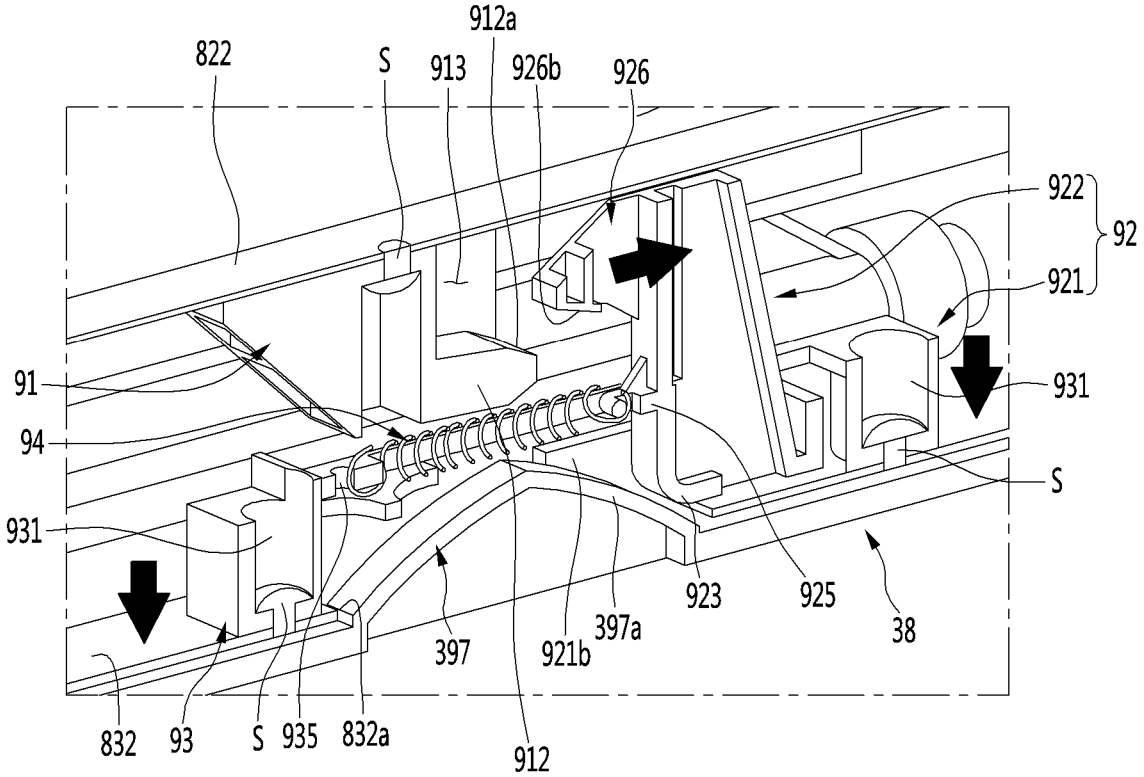
FIG. 28 is a cutaway perspective view illustrating a state of the restricting unit in a state in which the elevation device is mounted.

The protrusion 397 on the bottom surface of the drawer part 32 may pass through the partition part opening 832*a* defined in the lower partition part 832 as shown in FIG. 28 and may contact the contact part 923 of the lower locker 92 so that the lower locker 92 is disposed at the rearmost position.

Here, the bottom surface of the elevation device 80 may be maintained in close contact with the bottom surface of the drawer part 32 by the weight of the elevation device 80. Also, the rear end of the protrusion 397 may contact the contact part 923 so that the lower locker 92 does not move forward when the elevation device 80 is mounted.

The lower restricting part 926 may be disposed outside the upper accommodation part 913 of the upper locker 91 and be separated from the upper restricting part 912 so as not to be vertically restricted. That is, the restricting unit 90 may be in a restriction release state.

The restricting unit 90 may ascend and descend at any time in such the restriction release state. That is, when the driving of the driving device 40 is started, the upper frame of the elevation device 80 may move away from the lower frame 83.

The lower frame 83 may be coupled to the seating protrusion 396 on the bottom surface of the drawer part 32 to maintain the stable mounting without causing the movement. Particularly, the operation of the driving device 40 may allow the upper frame 82 to be maintained in the mounted state without shaking even when the upper frame 82 is elevated.

When the lower locker 92 moves backward, the elastic member 94 is extended. When the lower locker 92 is located at the rearmost position as shown in FIG. 28, the elastic member 94 may be maximally extended to provide elastic restoring force forward. However, the contact part 923 of the lower locker 92 may be maintained on the lower end of the protrusion 397 by the weight of the elevation device 80.

The upper restricting part 912 of the upper locker 91 may be disposed further downward than the lower restricting part 926 of the lower locker 92 in the state in which the upper frame 82 completely descends. When the external force applied to the rear side of the lower locker 92 is removed, the elastic restoring force of the elastic member 94 may maintain a standby state so that the lower locker 92 quickly moves forward.

Figure 29:
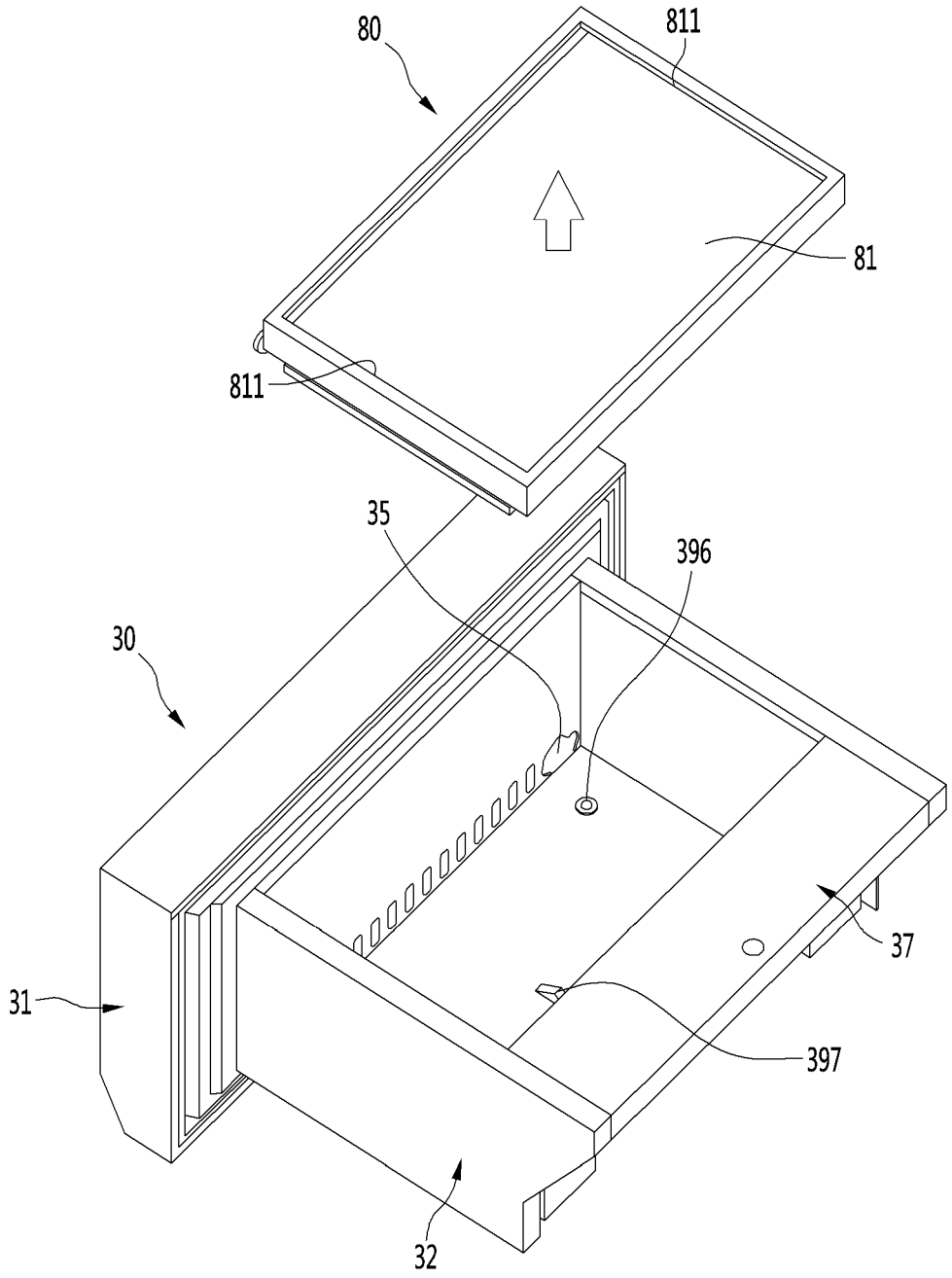
FIG. 29 is a perspective view illustrating a state in which the elevation device is separated from the drawer door.
Figure 30:
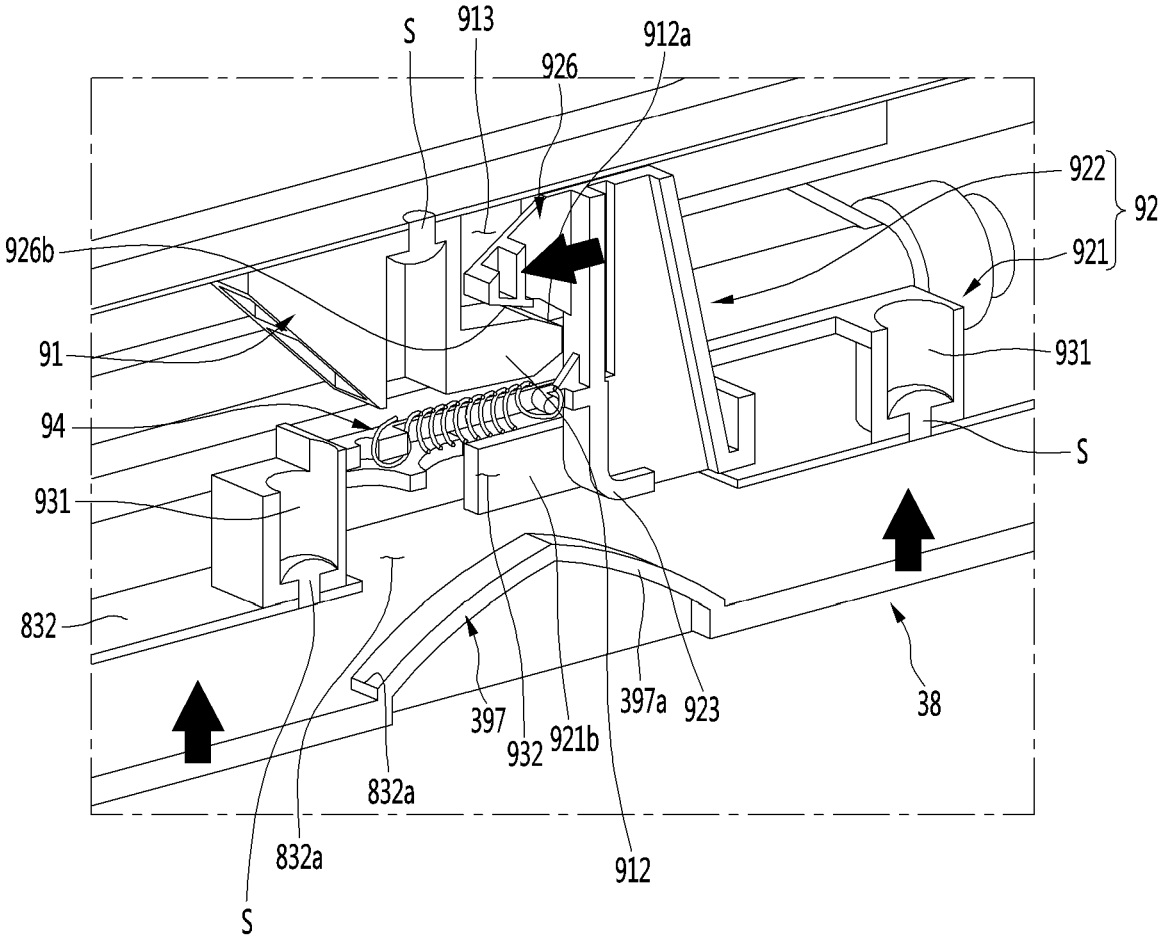
FIG. 30 is a cutaway perspective view illustrating a state of the restricting unit in a state in which the elevation device is separated.

FIG. 29 is a perspective view illustrating a state in which the elevation device is separated from the drawer door. Also, FIG. 30 is a cutaway perspective view illustrating a state of the restricting unit in a state in which the elevation device is separated.

As illustrated in the drawings, when the user desires not to use the elevation function of the drawer door 30, the elevation device 80 may be separated from the drawer part 32. When the elevation device 80 is removed according to the user's needs, an amount of available contents of the drawer part 32 may increase, and the user may adjust the capacity of the drawer part 32 through the detachment of the elevation device 80.

The elevation device 80 may be connected to the connecting assembly 70 in the state in which the elevation device 80 is mounted on the drawer part 32. Thus, the connecting assembly 70 operates to thereby separate the elevation device 80.

Also, the elevation device 80 may be separated from the connecting assembly 70 after the elevation device 80 slightly moves backward to separate the elevation device 80 from the connecting assembly 70.

When the elevation device 80 moves backward, the contact part 923 may move away from the protrusion 397, and the lower locker 92 may move forward by the elastic restoring force of the elastic member 94 so as to be hooked and restricted with the upper locker 91.

The elevation device 80 may be lifted upward to separate the elevation device 80. Also, a handle 811 may be recessed inside the periphery of the support plate 81 so that the user easily holds the elevation device 80 to be lifted.

Since the front end of the elevation device 80 is inserted into the connecting assembly 70 at the moment when the elevation device 80 is lifted upward, the elevation device 80 may be in a temporarily tilted state in which the front portion is lowered, and the rear portion. The contact part 923 and the protrusion 397 of the lower locker 92 may be separated from each other and move forward by the elastic restoring force of the elastic member 94 at the moment when the contact part 923 and the protrusion 397 are separated from each other so as to be hooked and restricted with the upper locker 91.

In this state, if the handle 811 is further lifted, the front end of the elevation device 80 may be separated from the connecting assembly 70. Thus, the elevation device 80 may be separated from the drawer part 32.

Also, when being separated from the drawer unit 32, the restriction unit 90 may be maintained in the restriction state by the elastic member 94 because the upper locker 91 and the lower locker 92 are be coupled to each other. Thus, the scissors lift assembly 84 of the elevation device 80 may be maintained in the folded state, and thus, the scissors lift assembly 84 may not be unfolded arbitrarily so that the elevation device 80 may be safely and easily separated.

To separate and mount the elevation device 80, the elevation device 80 may be mounted in the reverse order of the above-described process. Since the front end of the elevation device 80 and the connecting assembly 70 have to be connected when the elevation device 80 is mounted, and the front end of the elevation device 80 may be inclined to be lowered so that the elevation device 80 is inserted into the inside.

When the elevation device 80 is completely lowered on the bottom of the drawer part 32 in a state in which the front end of the elevation device 80 is inserted into the connecting assembly 70, the state of FIG. 28 may be realized to maintain the state in which the restriction of the restricting unit 90 is released, and the elevation device is elevatable at any time.

The restricting unit 90 may be arbitrarily released in restriction as necessary, and after the necessary operation is performed in such a state, the restriction state may be brought again by a simple operation.

FIGS. 31 to 34 are views sequentially illustrating an example process in which the restricting unit is changed from the restriction state to the restriction release state.

The restricting unit 90 may be released from the restriction by the user's need, or the restricting unit 90 may be released in a specific situation. When the restricting unit 90 is released from the restriction, the upper locker 91 and the lower locker 92 may be spaced apart from each other vertically as shown in FIG. 31.

In this state, the upper frame 82 and the lower frame 83 may freely move upward and downward. Also, the lower locker 92 is in a state of being at frontmost position, and the elastic member 94 is in a maximally compressed state.

In this state, the upper frame 82 and the lower frame 83 may move close to each other so as to be changed again into the restriction state of the restricting unit 90 due to performance of all necessary operations desired by the user or other reasons. For example, the restricting unit 90 may be restricted by its own weight by a simple operation of placing the elevation device 80 on the floor so that the lower frame 83 is placed on the floor.

In detail, when the elevation device 80 is placed on the floor, the upper frame 82 and the lower frame 83 may be close to each other by their own weight, and the scissors lift assembly 84 may be gradually folded. As illustrated FIG. 32, when the upper frame 82 and the lower frame are close to a certain distance, the upper locker 91 and the lower locker 92 may contact each other.

The lower locker 92 may be still in the most forward position, and the elastic member 94 may also be maintained in the contracted state. Also, the second inclined surface 912*c* of the upper locker 91 and the third inclined surface 926*a* of the lower locker 92 may contact each other.

Figure 32:
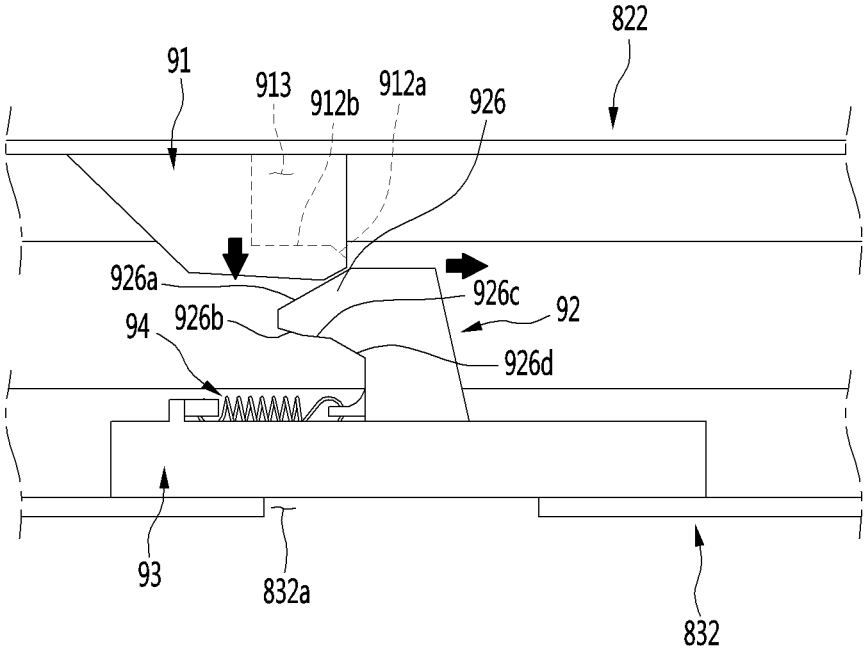

The upper locker 91 may move closer to the lower locker 92 by its own weight in the state shown in FIG. 32. When the user pushes the upper locker 91 from the upper side, the upper locker 91 may move further downward.

When the upper frame 82 and the lower frame 83 are close to each other in the state of FIG. 32 in which the second inclined face 912*c* and the third inclined face 926*a* contact each other, the lower locker 92 may move backward. That is, the lower locker 92 may move relative to the fixed upper locker 91 to move backward.

The elastic member 94 may be extended by the backward movement of the lower locker 92, and the lower locker 92 may be extended until the front end of the lower locker 92 is disposed at the rear end of the upper locker 91, and the elastic member 94 may be extended while the locker 92 may move backward.

Figure 33:
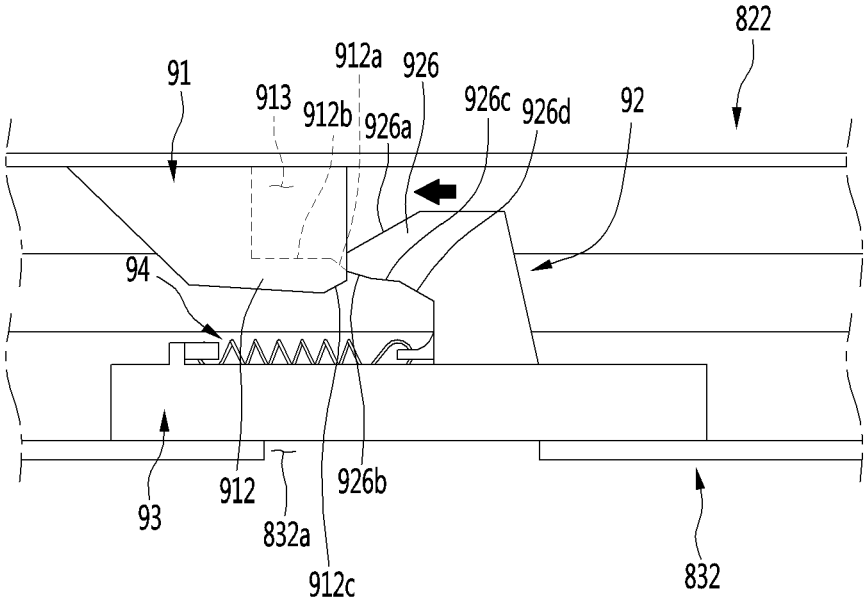

In the state of FIG. 33, the front end of the lower locker 92 may move beyond the second inclined surface 912*c*, and the upper frame 82 may further move downward by its own weight in the state in which there is no downward restriction.

Here, the lower locker 92 may be allowed to move forward, and therefore, the lower locker 92 may move forward due to the elastic restoring force of the elastic member 94.

Figure 34:
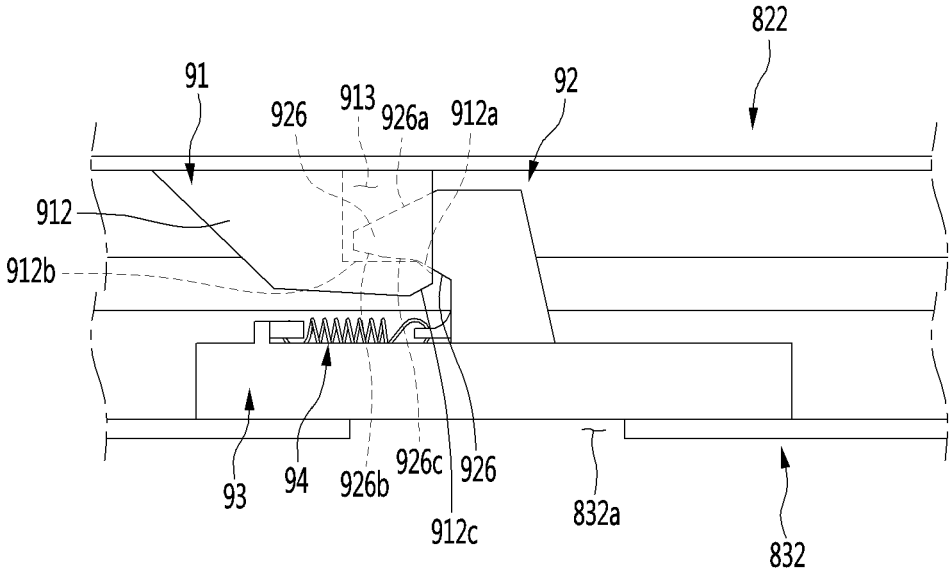

The lower locker 92 may move forward until the state shown in FIG. 34 is reached. In this state, the restricting unit 90 may be restricted again. In the restriction state, the upper frame 82 and the lower frame 83 may be in the closest state. In some cases, the lower end of the upper frame 82 and the upper end of the lower frame may contact each other or be very close to each other.

The restricting unit 90 may be in a state in which the lower restricting part 926 is completely inserted into the upper accommodating part 913. The second extension surface 926*c* may contact the first extension surface 912*b*, and the fifth inclined surface 926*d* may contact the first inclined surface 912*a* so that the lower locker 92 and the upper locker 91 are in the maximum contact state. The restricting unit 90 may be maintained in the stable restriction state, and the user may accommodate mount the elevation device 80 in the above-described state of the drawer part 32 or in a state of being separated.

In addition to the foregoing implementation, various implementations may be exemplified.

Hereinafter, another implementations will be described with reference to the accompanying drawings. In the other implementations of the present disclosure, the same reference numerals are used for the same components as those of the above-described implementations, and a detailed description thereof will be omitted.

Figure 35:
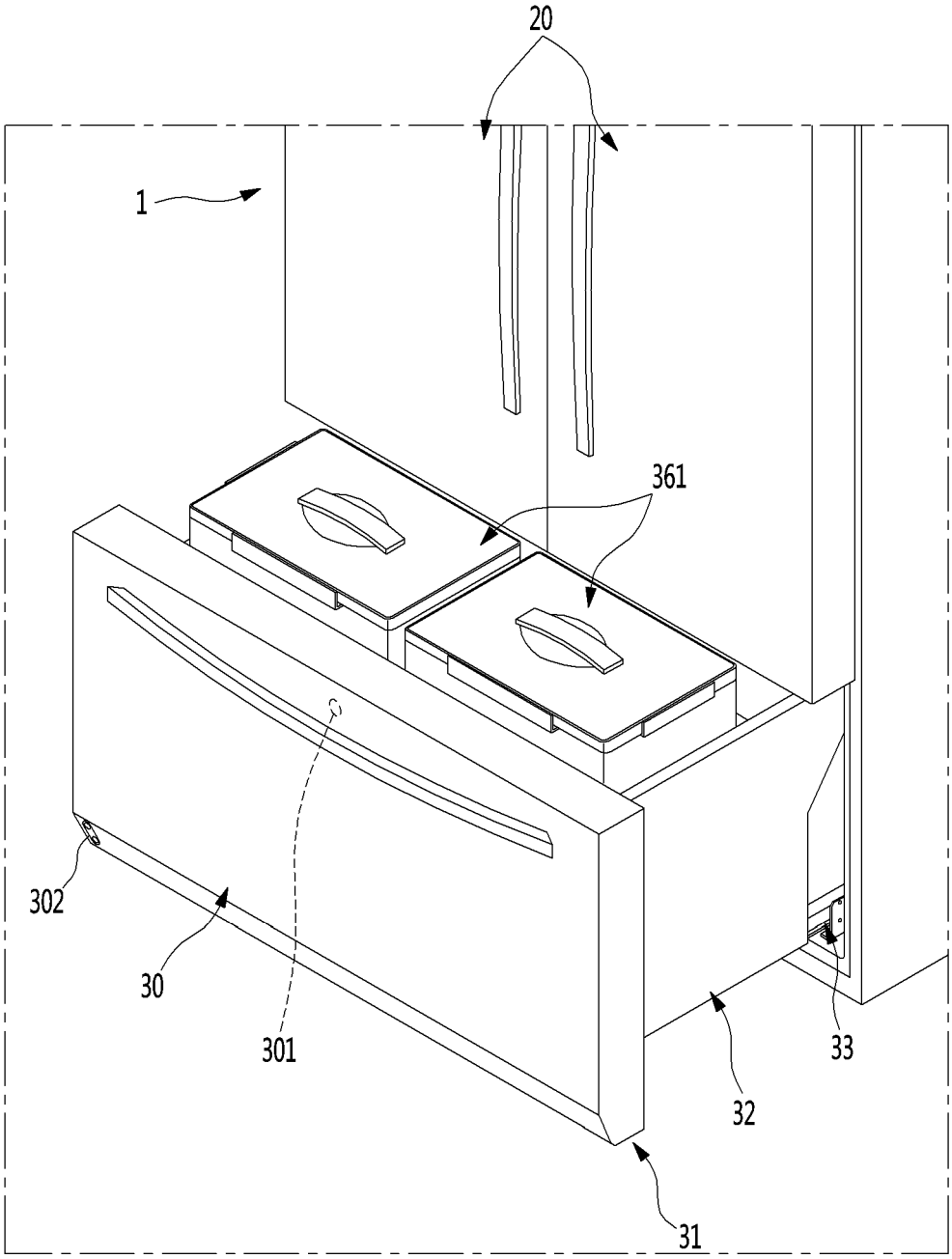
FIG. 35 is a perspective view of a refrigerator according to another implementation.

FIG. 35 is a perspective view of a refrigerator according to another implementation.

As illustrated in the drawing, a refrigerator 1 according to another implementation may include a cabinet 10 having a storage chamber that is vertically partitioned and a door 2 opening and closing the storage chamber.

The door 2 may include a rotation door 20 which is provided in an upper portion of a front surface of the cabinet 10 to open and close an upper storage chamber and a door 30 disposed in a lower portion of the front surface of the cabinet 10 to open and close a lower storage chamber. The door 30 may be inserted and withdrawn forward and backward in the above implementation, and the container and the food inside the drawer part 32 may be vertically elevated by the operation of the driving device 40 and the elevation device 80 inside the door 30.

The elevation device 80 may be provided in the region of the front space of the inside of the drawer part 32. Thus, the elevation device 80 may elevate the food in the region of the front space among the entire region of the drawer part 32.

A manipulation part 301 or a manipulation device 302 may be provided at one side of the door part 31, and the driving part 40 may be installed inside the door part 31. Also, the pulling-out operation of the drawer door 30 and/or the elevation of the elevation device 80 may be carried out by the manipulation of the manipulation part 301 or the manipulation device 302.

The drawer part 32 may be provided with the elevation device 80. The elevation device 80 may be elevated by a connecting assembly that connects the driving device to the elevation device. Also, the elevation device 80 may be separated from the drawer part 32 by the user as necessary. When the elevation device 80 is mounted on the drawer part 32, the restricting unit 90 may be in the release state so as to be elevatable also may be in the restriction state at the moment when being separated from the drawer part 32 so that the elevation device 80 is safely separated. implementation A plurality of containers 361 may be provided in the elevation device 80. The container 361 may be a sealed container such as a kimchi box, and a plurality of the containers 361 may be seated on the elevation device 80. The container 361 may be elevated together with the elevation device 80 when the elevation device 80 is elevated. Thus, in the state in which the container 361 ascends, at least a portion of the drawer part 32 may protrude, and thus, the user may easily lift the container 361.

The elevation device 80 may interfere with the rotation door 20 in the rotation door 20 is opened even though the drawer door 30 is withdrawn. Thus, the elevation device 80 may ascend in a state in which the rotation door 20 is closed. For this, a door switch for detecting the opening/closing of the rotation door 20 may be further provided.

Figure 36:
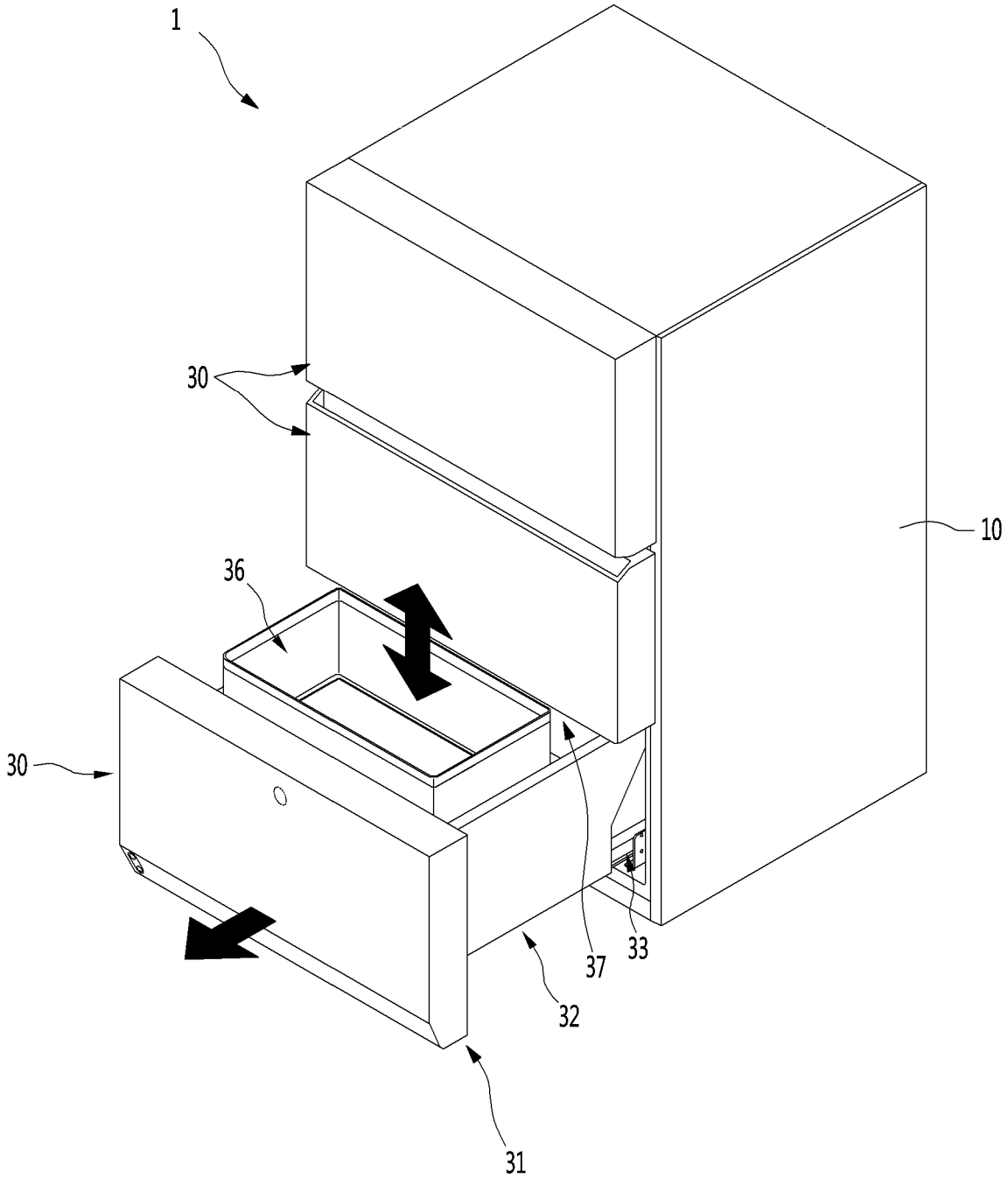
FIG. 36 is a perspective view of a refrigerator according to another implementation.

FIG. 36 is a perspective view of a refrigerator according to another implementation.

As illustrated in the drawings, a refrigerator 1 according to another implementation includes a cabinet 10 defining a storage chamber therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of the drawer doors 30 may be continuously arranged in the vertical direction. Also, the drawer doors 30 may be independently withdrawn by the user's manipulation. The drawer door 30 may be provided with the driving device 40 and the elevation device 80.

The driving part 40 may be installed in the door part 31, and the elevation part 80 may be provided inside the drawer part 32. Also, the driving device 40 and the elevation device 80 may be connected to each other by the connecting assembly 70 when the door part 31 and the drawer part 32 are coupled to each other. Also, the elevation device 80 may be disposed in the front space S1 of the total storage chamber of the drawer part 32.

Also, the elevation device 80 may be separated from the drawer part 32 by the user as necessary. When the elevation device 80 is mounted on the drawer part 32, the restricting unit 90 may be in the release state so as to be elevatable also may be in the restriction state at the moment when being separated from the drawer part 32 so that the elevation device 80 is safely separated.

The insertion and withdrawal of the drawer door 30 and the elevation of the elevation device 80 may be individually performed. After the drawer door 30 is withdrawn, the elevation device 80 may ascend. Then, after the elevation device 80 descends, the insertion of the drawer door 30 may be continuously performed.

Also, when the plurality of drawer doors 30 are vertically arranged, the elevation device 80 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the elevation device 80 ascends in the state in which the drawer door 30 that is disposed at the uppermost side is withdrawn in FIG. 36, all of the drawer doors 30 disposed at the upper side may also be elevated by the elevation device 80 that is provided inside.

If a height of each of the drawer doors 30 disposed at the upper side is sufficiently high, only the drawer door 30 disposed at the lowermost position or the elevation device 80 of the of drawer doors 30 disposed relatively downward may be elevated.

Figure 37:
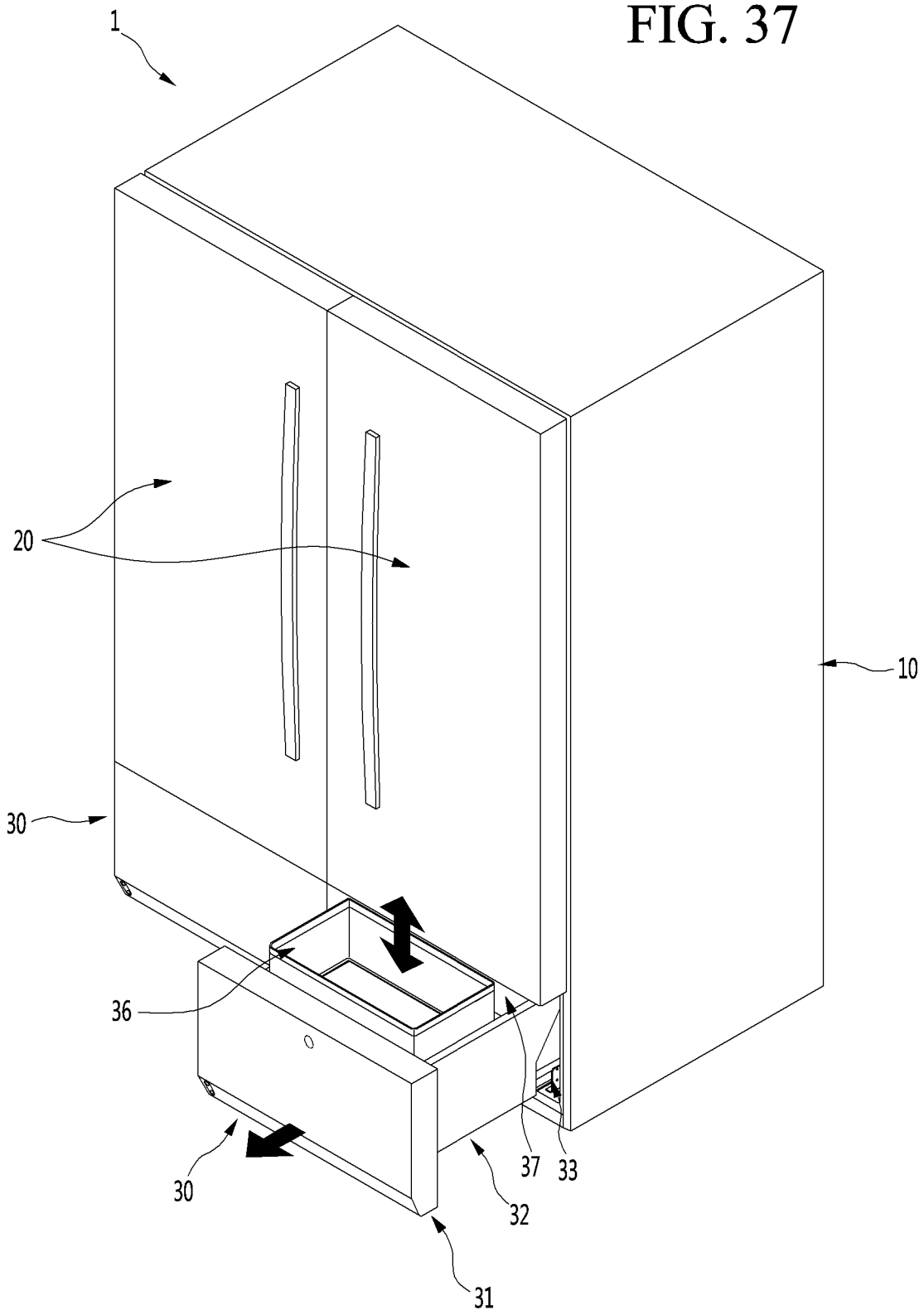
FIG. 37 is a perspective view of a refrigerator according to another implementation.

FIG. 37 is a perspective view of a refrigerator according to another implementation.

As illustrated in the drawings, a refrigerator 1 according to another implementation includes a cabinet 10 defining a storage chamber therein and a door 2 opening and closing an opened front surface of the cabinet 10, which define an outer appearance of the refrigerator 1.

The inside of the cabinet 10 may be divided into an upper space and a lower space. If necessary, the upper and lower storage chambers may be divided again into left and right spaces.

The door 2 may include a rotation door 20 which is provided in an upper portion of the cabinet 10 to open and close the upper storage chamber and a drawer door 2 disposed in a lower portion of the cabinet 10 to open and close the lower storage chamber.

Also, the lower space of the cabinet may be divided into left and right spaces. The drawer door 30 may be provided in a pair so that the pair of drawer doors 30 respectively open and close the lower spaces. A pair of the drawer doors 30 may be arranged on both sides of the right and left sides of the drawer door 30. The drawer door 30 may include the driving device 40 and an elevation device 80.

The driving part 40 may be installed in the door part 31, and the elevation part 80 may be provided inside the drawer part 32. Also, the driving device 40 and the elevation device 80 may be connected to each other by the connecting assembly 70 when the door part 31 and the drawer part 32 are coupled to each other. Also, the elevation device 80 may be disposed in the front space S1 of the total storage chamber of the drawer part 32.

Also, the elevation device 80 may be separated from the drawer part 32 by the user as necessary. When the elevation device 80 is mounted on the drawer part 32, the restricting unit 90 may be in the release state so as to be elevatable also may be in the restriction state at the moment when being separated from the drawer part 32 so that the elevation device 80 is safely separated.

The drawer door 30 may have the same structure as the drawer door according to the foregoing implementation. Thus, the drawer door 30 may be inserted and withdrawn by user's manipulation. In the drawer door 30 is withdrawn, the elevation device 80 may ascend so that a user more easily accesses a food or container within the drawer door 30.

The following effects may be expected in the refrigerator according to the proposed implementations of the present disclosure.

The refrigerator according to the implementation, the portion of the storage chamber within the drawer door may be elevated in the state in which the drawer door is withdrawn. Thus, when the food is accommodated in the drawer door disposed at the lower side, the user may not excessively turn its back to improve the convenience in use.

Also, the driving device that includes the electric devices for providing the power may be provided inside the door part, and the elevation device for the elevation may be provided inside the drawer part so that the driving device and the elevation device are not exposed to the outside to improve the outer appearance.

Particularly, the driving device including the electric devices may be disposed inside the door part, and it may be possible to prevent the user from accessing the door to prevent the occurrence of the safety accident.

Also, the driving device may be provided in the door to block the noise and reduce noise during the use.

Also, the driving part that occupies a large space may be disposed in the door part to minimize the storage capacity loss of the drawer part. Also, the elevation device or the structure that is compactly folded and accommodated in the descending state may be provided to secure the storage capacity in the refrigerator.

Also, the elevation device may be easily detached from the drawer part through the connection with the connecting assembly. Thus, the elevation device may be mounted and separated through the simple operation without a separate tool or operation technique to improve the serviceability and ease of use.

Also, since the elevation device is easily detached, the storage capacity of the drawer part may be variably adjusted by mounting or separating the elevation device at any time according to the user's needs. Thus, the elevation device may be suitably changed and used according to the application and environment.

Also, when the elevation device is mounted, the ventilation hole and the opening may be configured to cover the elevation device to realize the more clean internal configuration of the drawer part while easily introducing the cool air into the drawer part.

Also, the restricting unit may be provided in the elevation device to maintain the folded restriction state of the elevation device by the restricting unit without being arbitrarily unfolded when the elevation device is separated, thereby preventing the safety accident and facilitating the separation and storage of the elevation device.

Also, the restricting unit may contact the bottom surface of the drawer part so as to be released in restriction when the elevation device is mounted on the drawer part so that the elevation device freely operates in the state in which the elevation device is mounted.

Particularly, the elevation device may contact the contact part by its own weight without any operation while the drawer part is mounted, and the restricting unit may operate to release the restriction, thereby more improving the usability.

Also, when the elevation device is lifted to be separated from the drawer part, the elevation device may automatically be in the restricted state by the elastic member, and thus, the elevation device may be separated from the drawer part in the state of being restricted and folded.

Therefore, the elevation device may be more easily separated from the drawer part, and also, the elevation device may be unfolded during the separation to prevent the safety accidents from occurring or prevent the elevation device or the refrigerator from being damaged.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage chamber;

a drawer door configured to be inserted into and withdrawn out of the storage chamber, the drawer door comprising:

a drawer part that defines a storage space configured to store a food object, the drawer part being configured to be inserted into and withdrawn out of the storage chamber, and a door part that is configured to, based on the drawer part being inserted into the storage chamber, close at least a portion of the storage chamber;

a driving device disposed at the drawer door; and an elevation device detachably disposed inside the drawer part and configured to be elevated by a driving force of the driving device, the elevation device comprising:

a lower frame configured to be seated on a bottom surface of the drawer part, an upper frame configured to be elevated relative to the lower frame and to support the food object, and a restricting unit disposed at each of the upper frame and the lower frame and configured to selectively restrict the upper frame and the lower frame from moving relative to each other, wherein the drawer part comprises a protrusion that is configured to:

contact the restricting unit based on the elevation device being mounted to the drawer part to thereby release a restriction of the restricting unit and allow relative movement between the upper frame and the lower frame, and separate from the restricting unit based on the elevation device being detached from the drawer part to thereby enable the restricting unit to restrict the upper frame and the lower frame from moving relative to each other.

2. The refrigerator according to claim 1, wherein the restricting unit comprises:

an upper locker disposed at the upper frame and configured to be elevated based on operation of the elevation device;

a lower locker disposed at the lower frame and configured to contact the protrusion based on the elevation device being mounted to the drawer part, the lower locker being configured to, based on contacting the protrusion, move toward or away from the upper locker; and an elastic member configured to provide an elastic force that moves the lower locker toward the upper locker.

3. The refrigerator according to claim 1, wherein the elevation device further comprises a scissors lift assembly coupled to the lower frame and the upper frame, the scissors lift assembly being configured to:

be unfolded by the driving device to elevate the upper frame relative to the lower frame, and be folded by the driving device to lower the upper frame toward the lower frame.

4. The refrigerator according to claim 3, wherein the restricting unit comprises:

an upper locker fixed to the upper frame and configured to be elevated together with the upper frame;

a locker case fixed to the lower frame;

a lower locker disposed at the locker case and configured to move along the locker case, the lower locker being configured to interfere with the upper locker based on movement of the lower locker along the locker case; and an elastic member that connects the locker case to the lower locker, the elastic member being configured to provide an elastic force that moves the lower locker toward the upper locker.

5. The refrigerator according to claim 4, wherein the protrusion protrudes upward from the bottom surface of the drawer part, the protrusion having an upper surface that is round or inclined upward with respect to the bottom surface of the drawer part, and wherein the upper surface of the protrusion is configured to contact the lower locker to thereby allow the lower locker to move away from the upper locker and release the restriction of the restricting unit.

6. The refrigerator according to claim 5, wherein the lower frame defines a first opening at a bottom surface of the lower frame, and the locker case defines a second opening at a bottom surface of the locker case, and wherein the protrusion is configured to insert into an inside of the locker case through the first opening and the second opening.

7. The refrigerator according to claim 4, wherein the restricting unit further comprises:

an upper partition part that is disposed at a center of the upper frame and partitions the upper frame into left and right portions, the upper locker being disposed at the upper partition part; and a lower partition part that is disposed at a center of the lower frame and partitions the lower frame into left and right portions, and wherein the locker case and the lower locker are disposed at the lower partition part.

8. The refrigerator according to claim 7, wherein the upper partition part and the lower partition part extend along a common extension line, and wherein the scissors lift assembly comprises:

a left scissor lift assembly disposed between the left portion of the upper frame and the left portion of the lower frame, and a right scissor lift assembly disposed between the right portion of the upper frame and the right portion of the lower frame.

9. The refrigerator according to claim 4, wherein the upper locker comprises an upper restricting part that protrudes toward the lower locker, the upper restricting part defining an upper accommodation part recessed from an upper portion thereof, and wherein the lower locker protrudes toward the upper locker, the lower locker comprising a lower restricting part configured to insert into the upper accommodation part to thereby restrict the upper locker from being separated from the lower locker.

10. The refrigerator according to claim 9, wherein the upper locker has an upper top inclined surface that is disposed at a top surface of the upper accommodation part, wherein the lower locker has a lower bottom inclined surface disposed at a bottom surface of the lower restricting part and configured to face the upper top inclined surface, and wherein the upper top inclined surface and the lower bottom inclined surface are configured to, based on the lower locker interfering with the upper locker, contact each other and allow the lower restricting part to move into the upper accommodation part.

11. The refrigerator according to claim 9, wherein the upper locker has an upper bottom inclined surface that is disposed at a bottom surface of the upper restricting part, wherein the lower locker has a lower top inclined surface that is disposed at a top surface of the lower restricting part, and wherein the upper bottom inclined surface and the lower top inclined surface are configured to, based on the upper locker moving downward to the lower locker, contact each other to allow the upper locker to push the lower locker away from the upper locker.

12. The refrigerator according to claim 1, wherein the driving device is disposed in the door part and configured to connect to the elevation device through a front surface of the drawer part.

13. The refrigerator according to claim 12, further comprising a connecting assembly that is configured to couple the driving device to the elevation device and to transfer the driving force from the driving device to the elevation device.

14. The refrigerator according to claim 13, wherein the drawer part defines a drawer opening at the front surface of the drawer part, and wherein a front end of the elevation device is exposed through the drawer opening, the elevation device being configured to connect to the connecting assembly through the drawer opening.

15. The refrigerator according to claim 13, wherein one of the connecting assembly or the elevation device comprises a projection part, and wherein the other of the connecting assembly or the elevation device comprises a connection part configured to couple to and decouple from the projection part.

16. The refrigerator according to claim 12, wherein the elevation device further comprises a scissors lift assembly coupled to the lower frame and the upper frame, the scissors lift assembly being configured to:

be unfolded by the driving device to elevate the upper frame relative to the lower frame, and be folded by the driving device to lower the upper frame toward the lower frame, wherein the scissors lift assembly comprises a pair of scissors lift assemblies, each of the pair of scissors lift assemblies comprising a plurality of rods that are rotatably coupled to each other and cross each other, and wherein the refrigerator further comprises a pair of connecting assemblies that are configured to couple to the pair of scissors lift assemblies, respectively.

17. The refrigerator according to claim 16, wherein the pair of connecting assemblies are disposed at left and right sides of the door part, respectively, and wherein the pair of scissors lift assemblies are configured to operate together by rotation of the pair of connecting assemblies.

18. The refrigerator according to claim 16, wherein the elevation device further comprises a support plate that is supported by the pair of scissors lift assemblies and configured to be elevated by the pair of scissors lift assemblies, the support plate being configured to support the food object or a container.

19. The refrigerator according to claim 1, wherein the protrusion protrudes from the bottom surface of the drawer part toward the restricting unit.

20. The refrigerator according to claim 1, wherein the elevation device further comprises a plurality of restricting units disposed at the upper frame and the lower frame and configured to restrict the upper frame and the lower frame from moving relative to each other, the restricting unit being one of the plurality of restricting units, wherein the drawer part further comprises a plurality of protrusions that protrude from the bottom surface of the drawer part and are configured to contract the plurality of restricting units, respectively, the protrusion being one of the plurality of protrusions, and wherein a number of the plurality of protrusions is equal to a number of the plurality of restricting units.

* * * * *